US006802361B2

(12) United States Patent
Hatanaka

(10) Patent No.: US 6,802,361 B2
(45) Date of Patent: Oct. 12, 2004

(54) CEILING PANEL STRUCTURE FOR A CEILING-MOUNTED AIR-CONDITIONING APPARATUS OR THE LIKE

(75) Inventor: Iwayoshi Hatanaka, Chiba (JP)

(73) Assignee: Air Techno Company Limited, Chiba (JP)

( * ) Notice: Subject to any disclaimer, the term of this patent is extended or adjusted under 35 U.S.C. 154(b) by 0 days.

(21) Appl. No.: 09/873,346

(22) Filed: Jun. 5, 2001

(65) Prior Publication Data

US 2001/0054493 A1 Dec. 27, 2001

(30) Foreign Application Priority Data

Jun. 22, 2000 (JP) ..... 2000-187145
Feb. 21, 2001 (JP) ..... 2001-045391

(51) Int. Cl.[7] ..... F24F 13/06
(52) U.S. Cl. ..... 165/53; 165/54; 454/248
(58) Field of Search ..... 165/53, 57, 54, 165/56; 454/233, 313, 237, 241, 243, 245, 248

(56) References Cited

U.S. PATENT DOCUMENTS 3,768,395 A * 10/1973 Rick
3,791,281 A * 2/1974 Steiner
3,945,306 A * 3/1976 Brown
4,672,888 A * 6/1987 Crombie et al.
4,821,628 A * 4/1989 Sarazen, Jr. et al.
5,487,766 A * 1/1996 Vannier
5,569,078 A * 10/1996 Kirkpatrick
5,577,958 A * 11/1996 Kumekawa et al. ..... 454/233
5,595,068 A 1/1997 Amr
5,810,658 A * 9/1998 Seo ..... 454/233
6,030,287 A * 2/2000 Core
6,089,972 A * 7/2000 Gunji et al. ..... 454/233
6,250,373 B1 * 6/2001 Vecchi et al. ..... 165/53
6,263,632 B1 * 7/2001 Cadorette
6,345,667 B1 * 2/2002 Hata et al. ..... 165/53 X
6,386,970 B1 * 5/2002 Vernier, II et al.
6,450,880 B1 * 9/2002 Asahina et al. ..... 454/233
RE37,985 E * 2/2003 Felsen

FOREIGN PATENT DOCUMENTS

| | | | | |
|---|---|---|---|---|
| EP | 1 003 002 A2 | | 5/2000 | |
| JP | 62-120151 | | 7/1987 | |
| JP | 62-194128 | * | 8/1987 | ..... 165/53 |
| JP | 1-217141 | * | 8/1989 | ..... 165/53 |
| JP | 7-12847 | | 3/1995 | |
| JP | 7-324802 | | 12/1995 | |
| JP | 8-94160 | | 4/1996 | |
| JP | 8-100942 | | 4/1996 | |
| JP | 08-261552 | | 10/1996 | |
| JP | 8-313042 | | 11/1996 | |
| JP | 9-222237 | | 8/1997 | |

* cited by examiner

*Primary Examiner*—Ljiljana Ciric
(74) *Attorney, Agent, or Firm*—Wenderoth, Lind & Ponack L.L.P.

(57) ABSTRACT

A ceiling panel structure (10, 310) is mounted on a ceiling surface (201) downstream of an air-outlet (211) of a ceiling-mounted air-conditioning apparatus (indoor unit) (200) having an air-inlet (210) at a central portion and the conditioning air-outlet (211) at a peripheral portion. The ceiling panel structure minimizes the smudging of the ceiling surface, and is applicable even to the pre-mounted or existing air-conditioning apparatus. The ceiling panel structure (10, 310) can be mounted on the ceiling surface (201) outside of the air-conditioning apparatus (200), and has a deflection induction portion (47, 347) substantially rigid against the airflow to deflect a part (S1, S2) of the conditioning air blown out through the air-outlet (211) of the air-conditioning apparatus (200) back to the room air-inlet (210). The ceiling panel structure (10, 310) includes, typically, a base member (20, 320) mounted on the ceiling 201, and a cover member (40, 340) attached to the base member (20, 320) and having portions such as the deflection induction portion (47, 347).

25 Claims, 31 Drawing Sheets

200

11
12
10

10
200
201
10a
10b

200c

200a

200b

*Fig.4A*
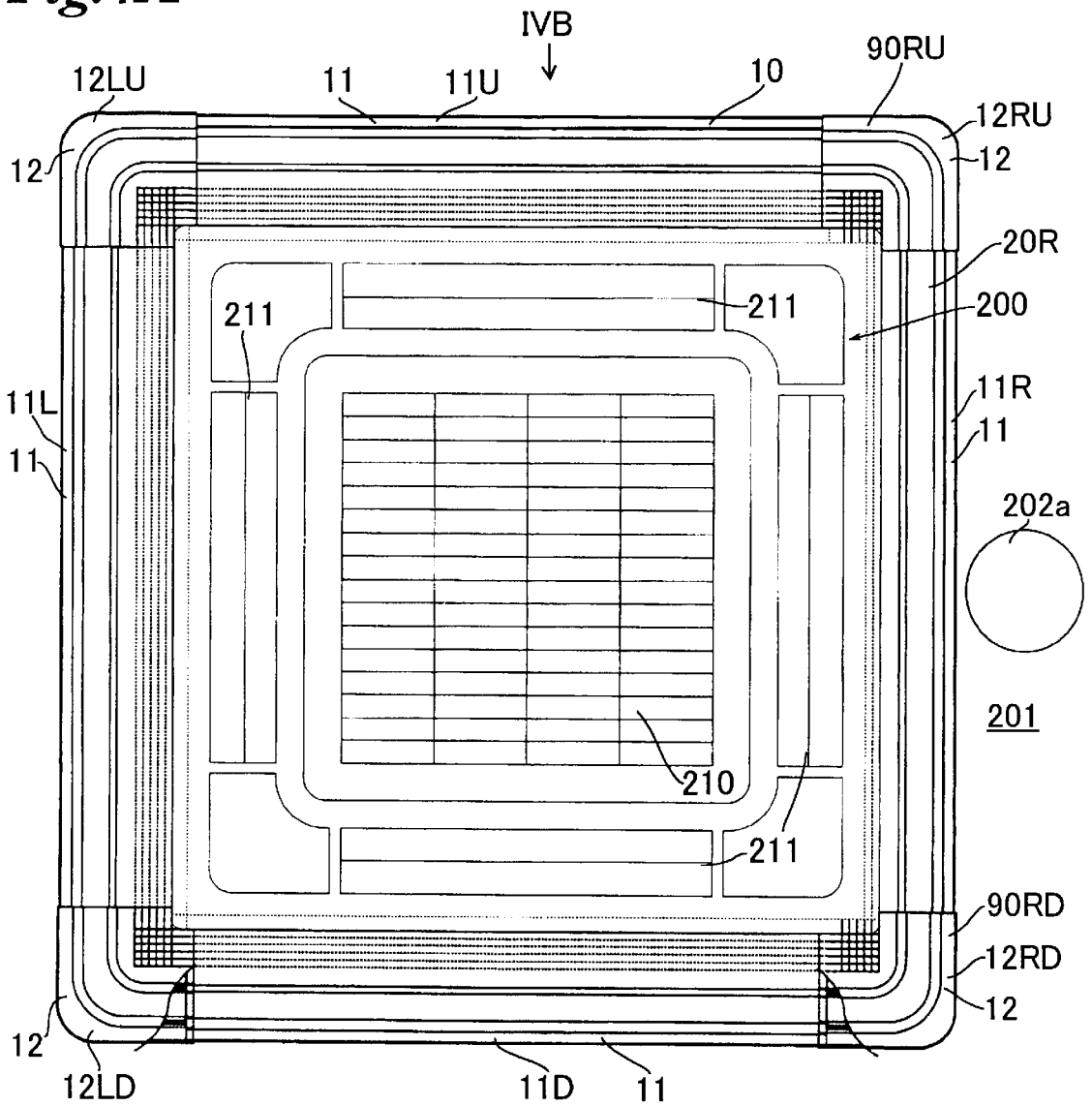
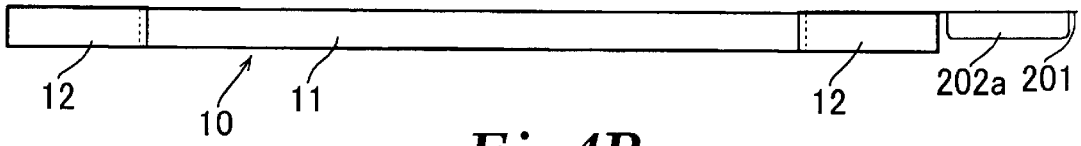
*Fig.4B*

*Fig.6A*
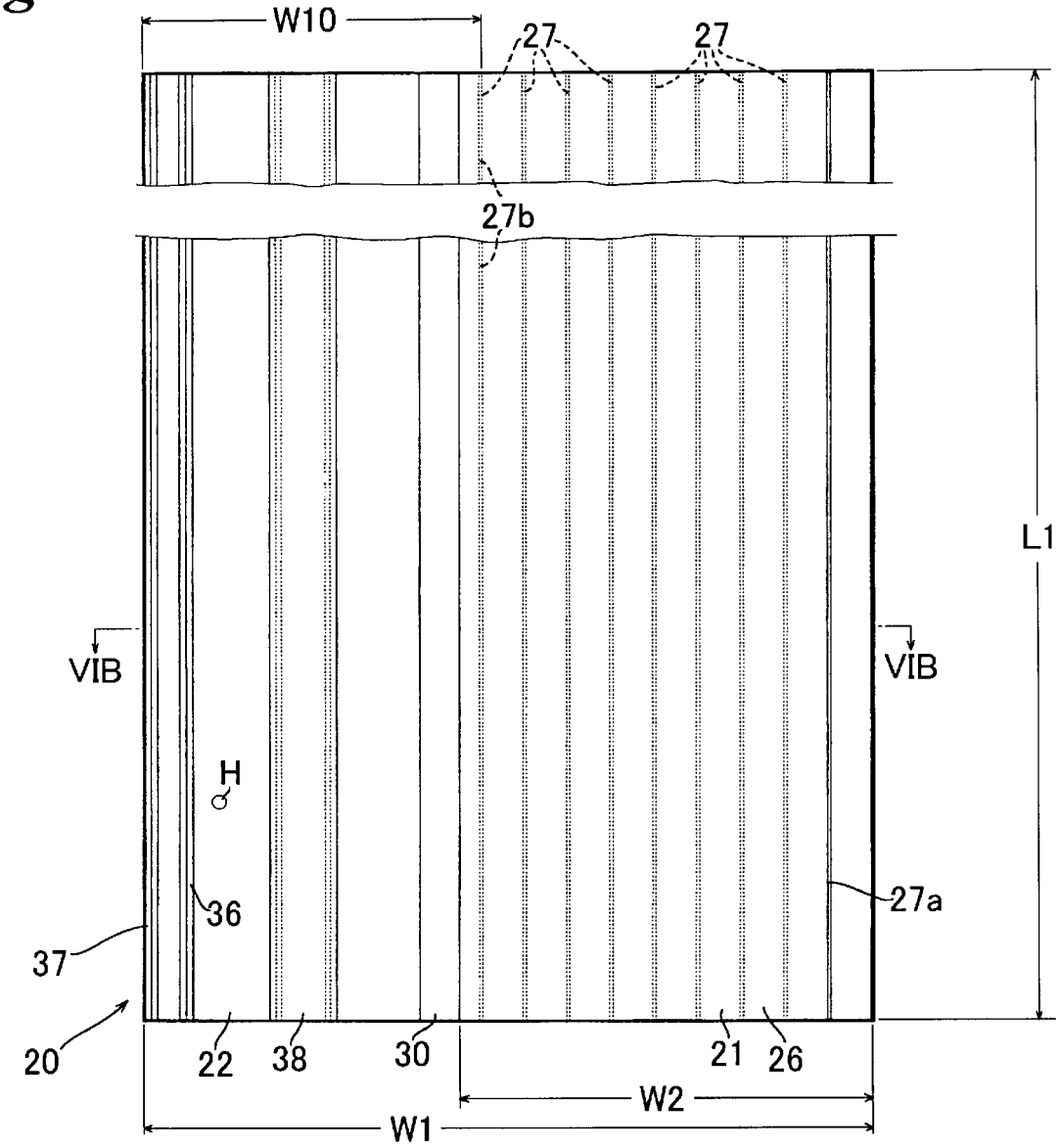
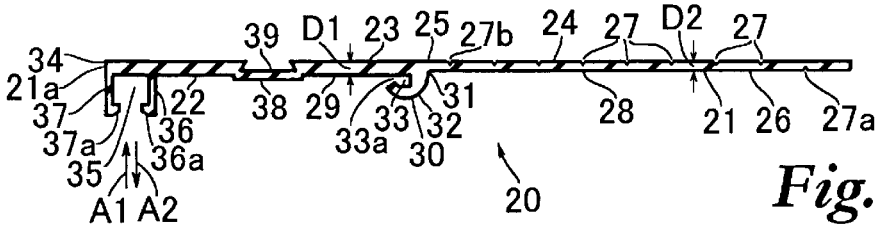
*Fig.6B*

Fig.9A
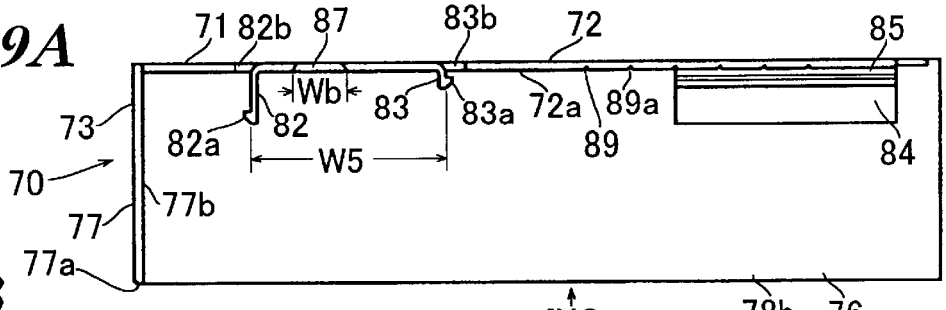
Fig.9B
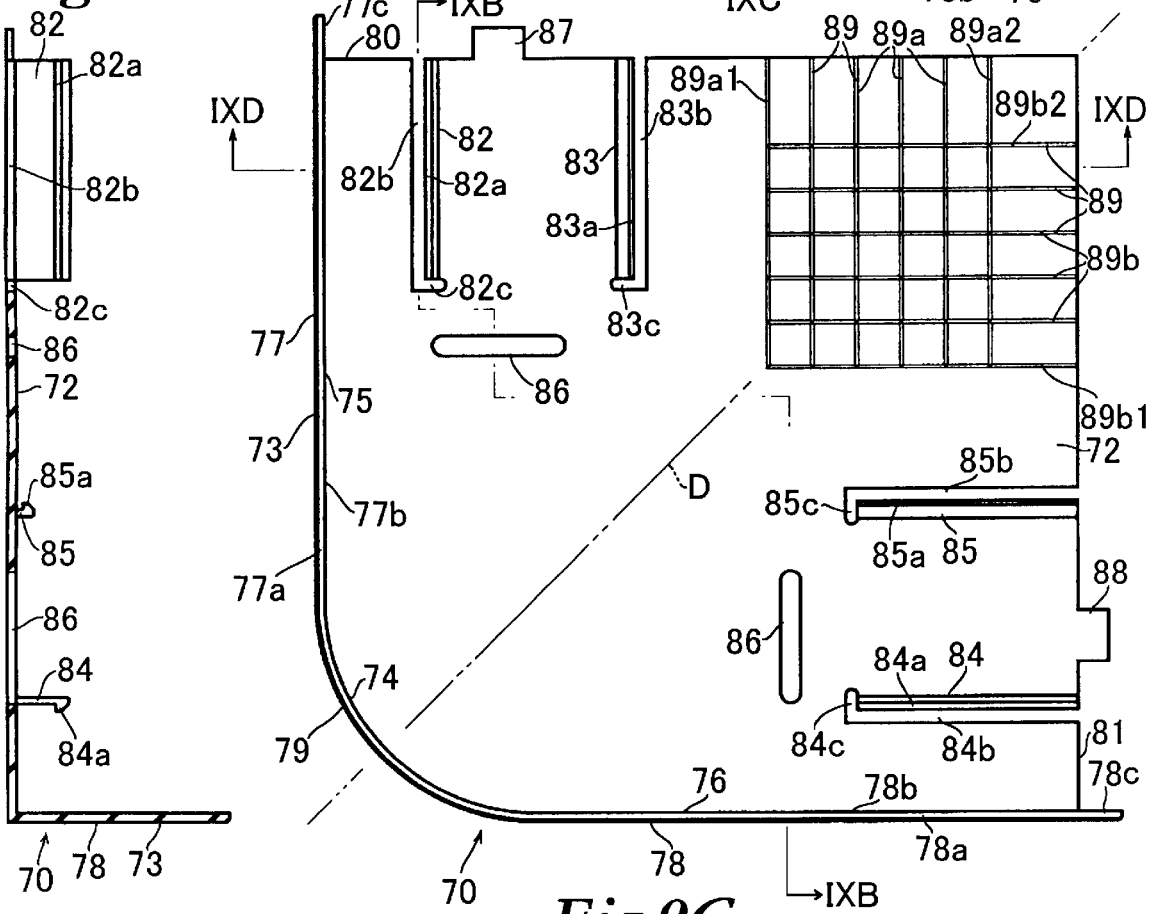
Fig.9C
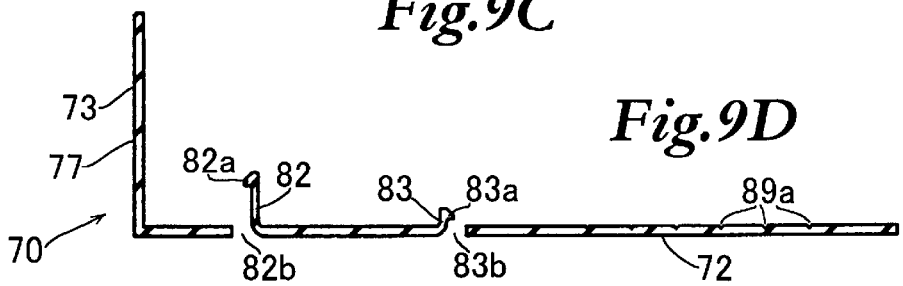
Fig.9D

*Fig.19A*
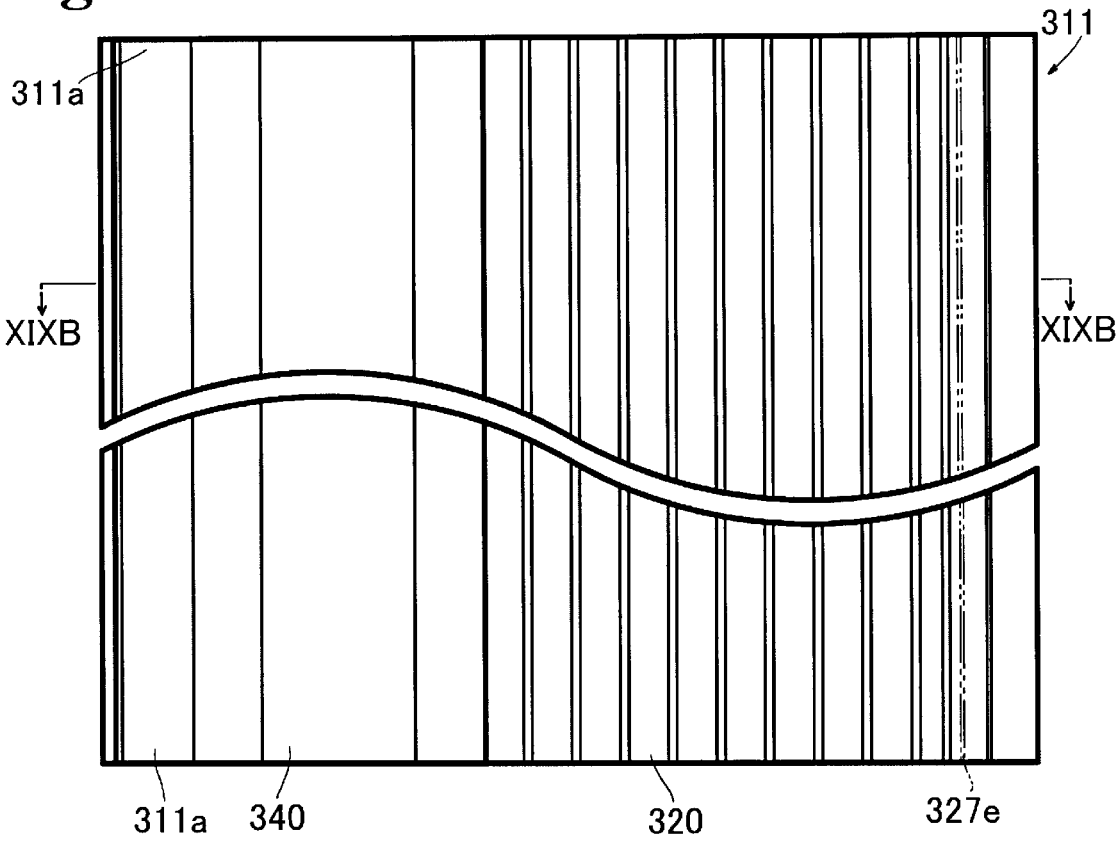
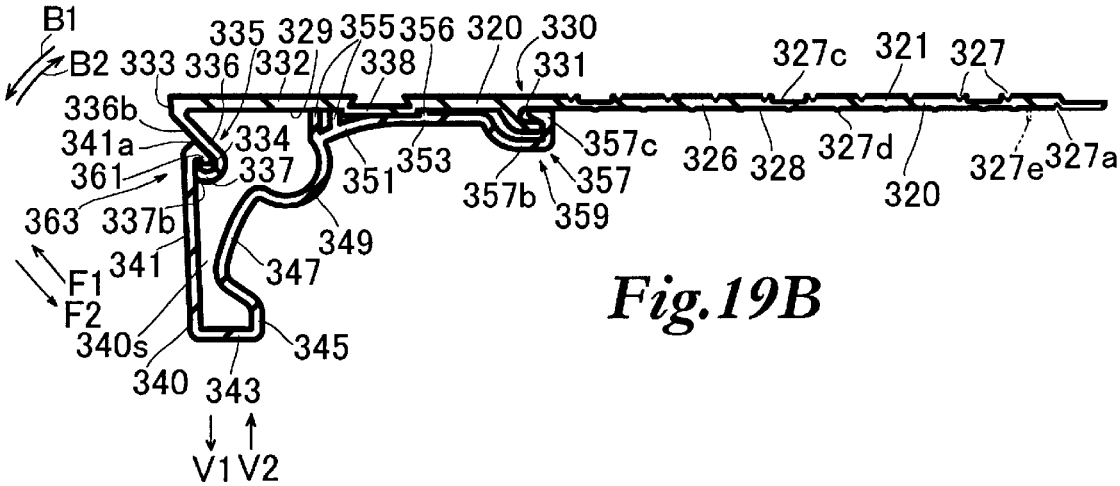
*Fig.19B*

Fig.23A
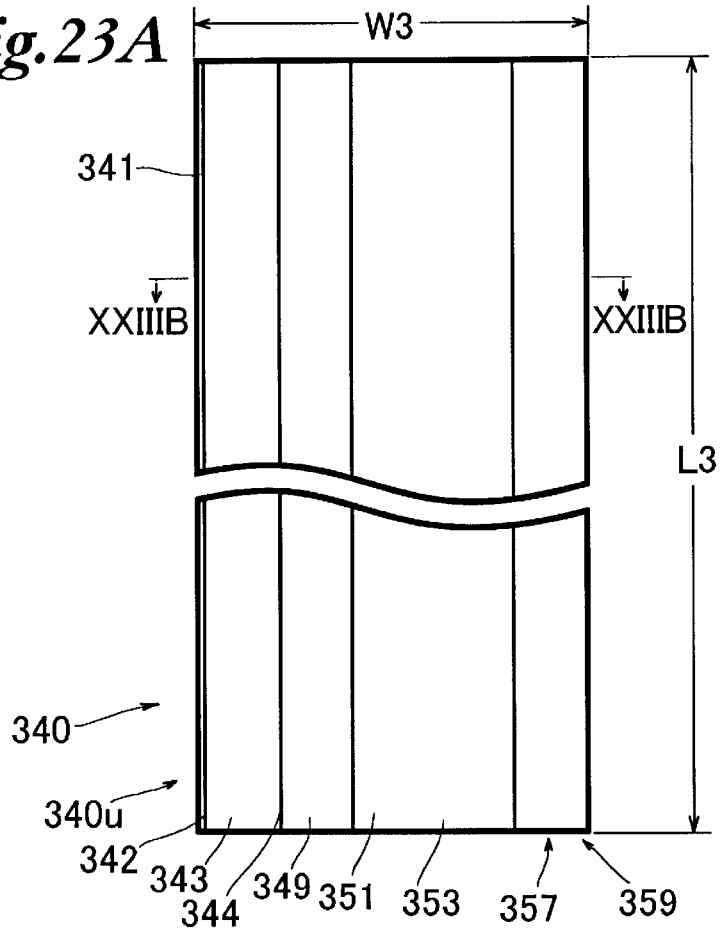
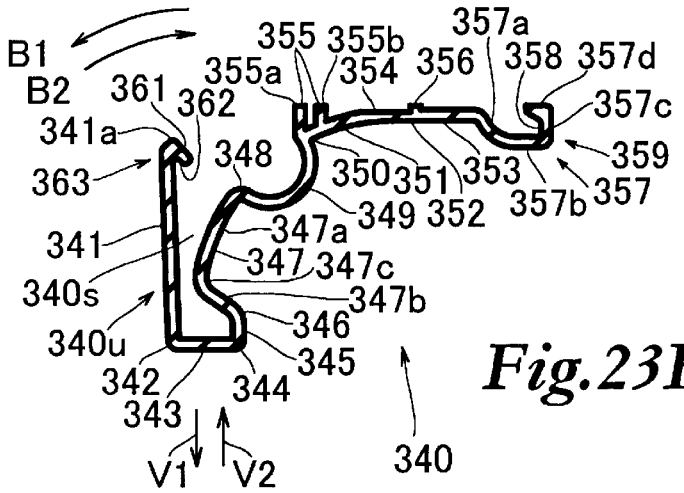
Fig.23B
Fig.23C
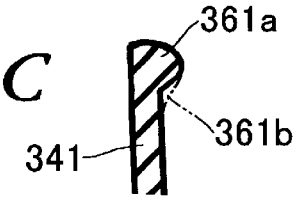

*Fig.24A*
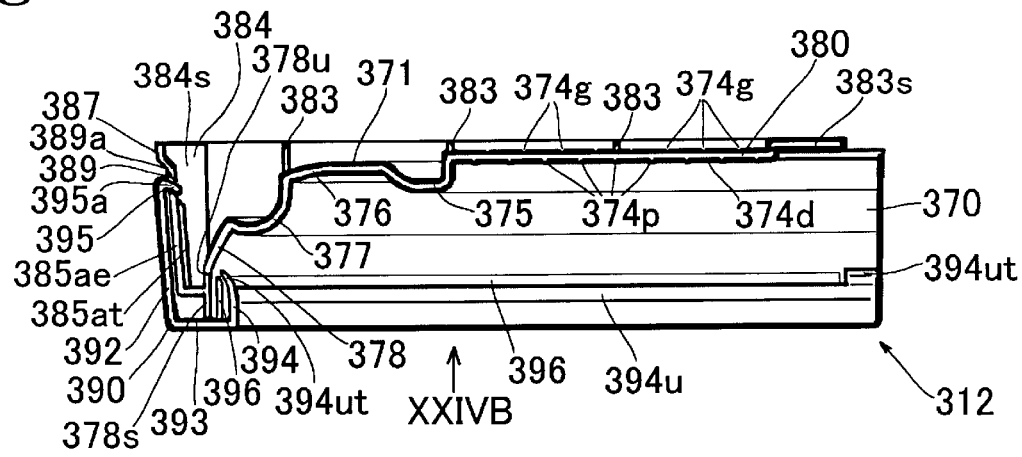
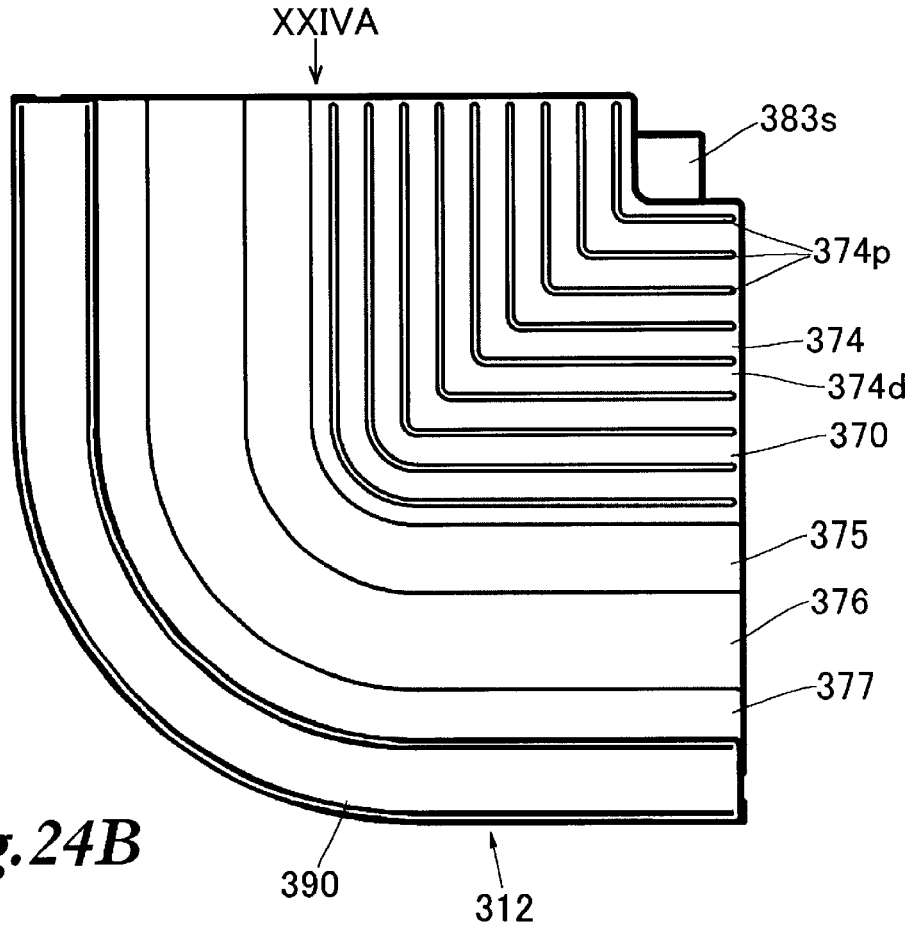
*Fig.24B*

*Fig.25A*
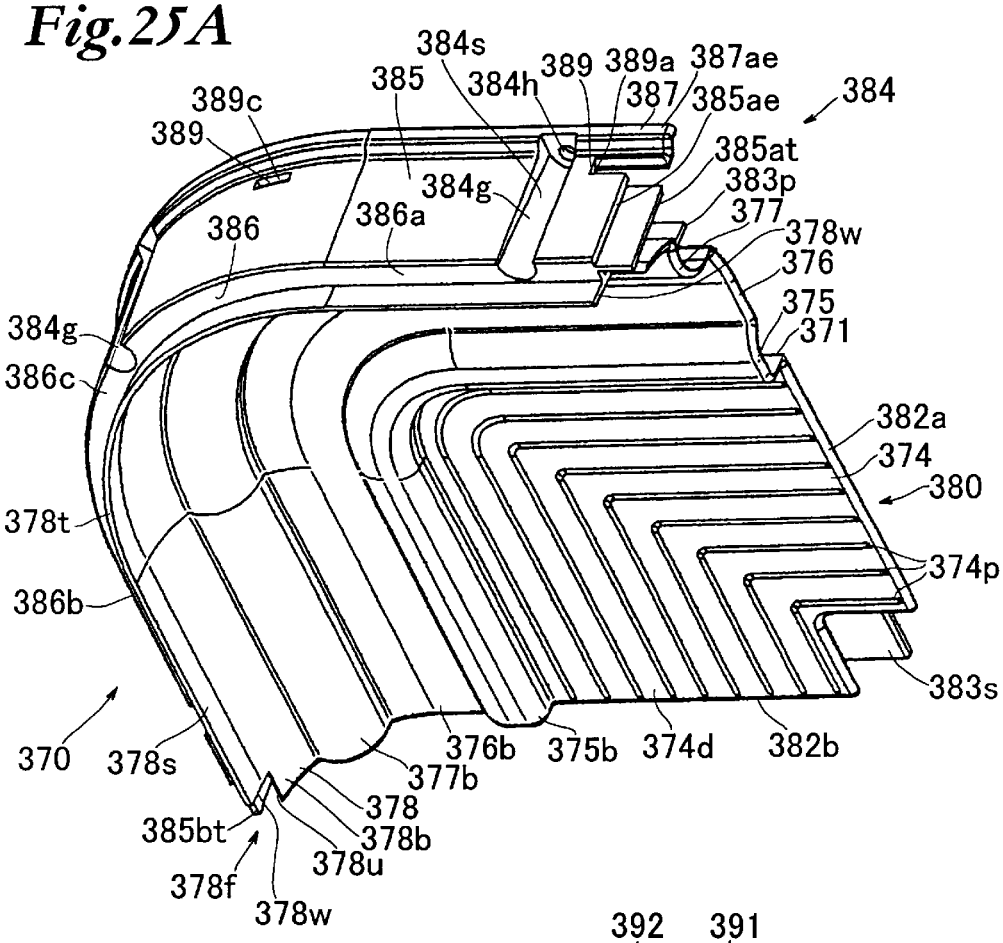
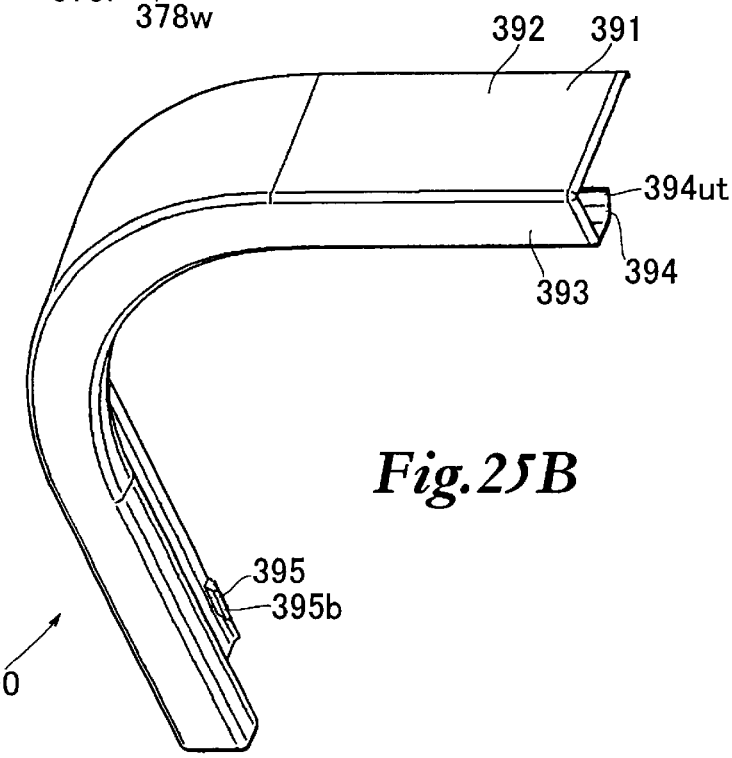
*Fig.25B*

*Fig.28A*
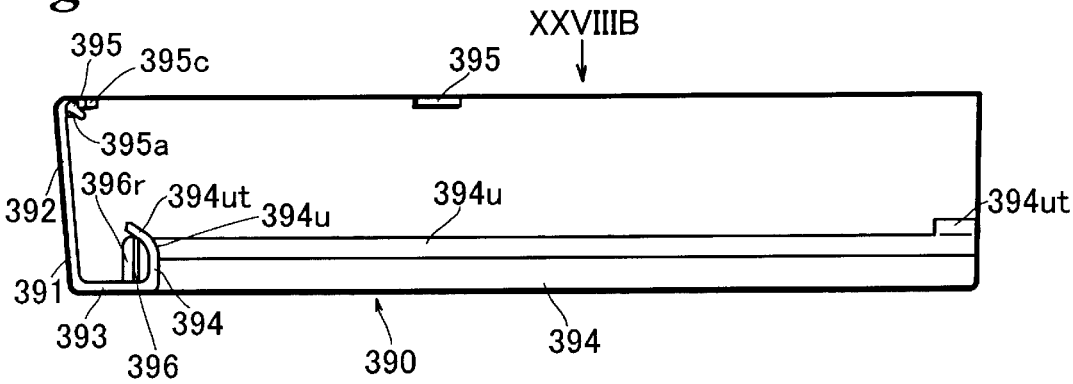
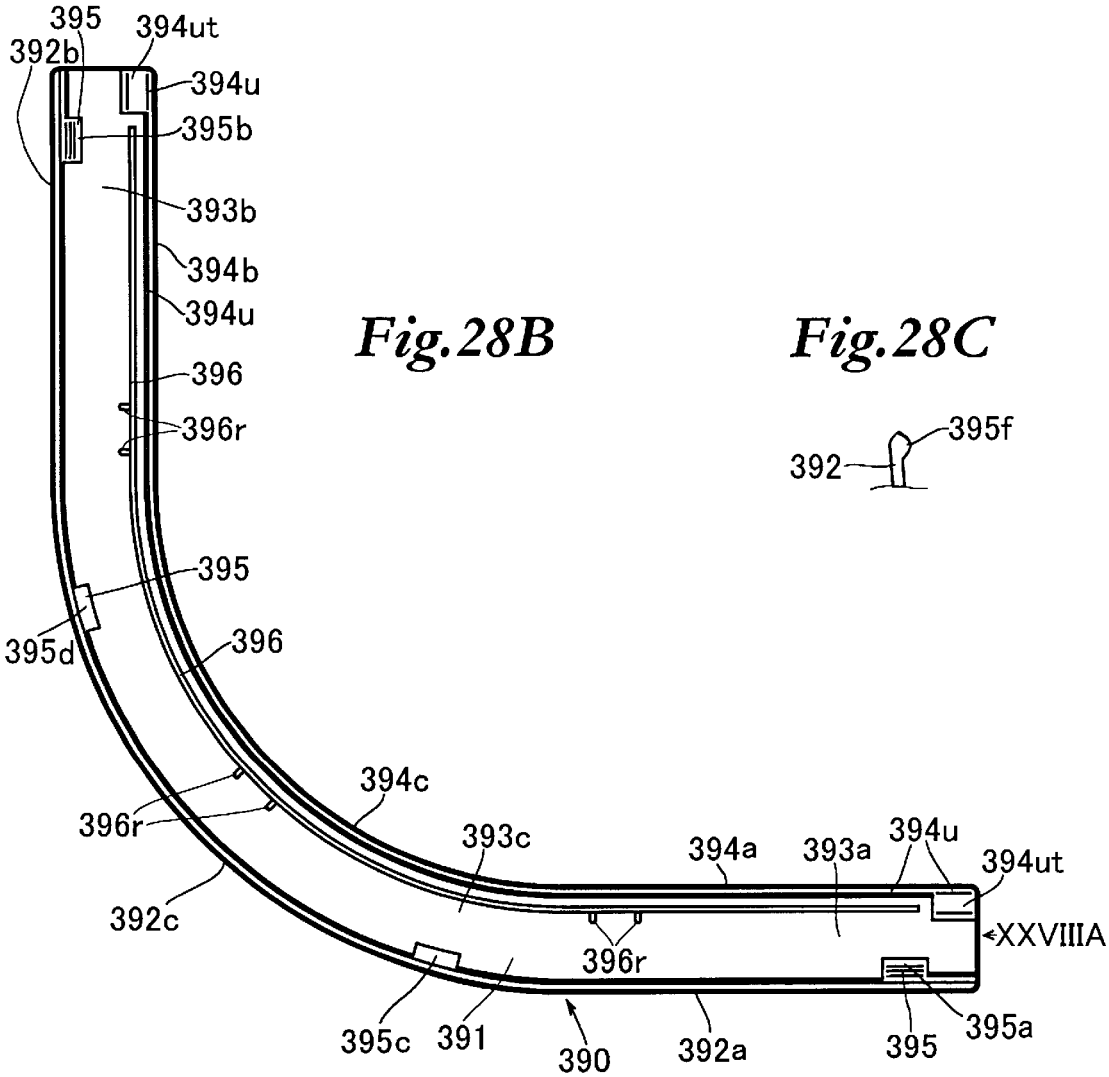
*Fig.28B*
*Fig.28C*

450
451
451a
451g
452
453
454
455
456
457
458
458a
459
460
461
462
463
470

CEILING PANEL STRUCTURE FOR A CEILING-MOUNTED AIR-CONDITIONING APPARATUS OR THE LIKE

BACKGROUND OF THE INVENTION

1. Field of the Invention

The invention relates to an apparatus for reducing smudging of a ceiling by blowing conditioned air out through an outlet of a ceiling-mounted air-conditioning apparatus (referred to hereinafter also as "ceiling-mounted air-conditioner") or the like.

2. Description of the Related Arts

An air-conditioning system essentially includes a pair of heat exchangers through which a heating/cooling medium is circulated. The air is warmed or heated/cooled when passing through a first one of the heat exchangers, while the medium having been cooled/heated upon warming/cooling the air in the first heat exchanger is heated/cooled at the second heat exchanger. In the air-conditioning system where the pair of heat exchangers are made of separate units, the unit including the first heat exchanger is usually called an "indoor unit" or a "package type air-conditioner", while the other is called an "outdoor unit". The ceiling-mounted air-conditioning apparatus, in which the apparatus is mounted or installed or almost embedded in the ceiling, corresponds to the indoor unit (see for example U.S. Pat. No. 5,595,068). More specifically, the ceiling-mounted air-conditioner has a room air-inlet at a central portion of a bottom thereof, and has a conditioning air-outlet at a peripheral portion of the bottom thereof. Therefore, the air-conditioner sucks or introduces the room air from the room air-inlet at the central portion of the bottom portion of the room and, after having warmed or cooled the introduced room air by the heat exchanger, discharges or blows out the conditioned air from the air-outlet at the peripheral portion of the bottom portion.

The conditioned air is blown out in a direction generally along a ceiling surface so that the conditioned air can spread over a wide region in the room. Therefore, the air inherently tends to flow along the ceiling surface. Accordingly, the conditioned air smudges an area of the ceiling surface near the air-outlet due to the contamination of the conditioned air itself or the contamination of the room air which is entangled in a rapid flow of air blown out through the air-outlet. When the air-conditioning apparatus has been used for a long period of time, the smudged ceiling surface becomes too unsightly to be neglected.

In order to solve the above-mentioned problems, it has been proposed to adjust an inclination of a wind direction plate, which is disposed near the air-outlet within an air discharge passage, in response to a degree of contamination of the room air and a selected air-conditioning state, i.e., cooling or warming, so as to change a direction of conditioning airflow from the air-outlet (refer for example to Japanese Patent Application Publication (i.e., Laid-Open) No. 8-100942 (100942/96). Alternatively, it has been proposed to change an air discharge direction and/or the size of an opening near each of the longitudinal ends of an air-outlet, where the discharged air tends to flow along the ceiling surface (refer for example to Japanese Patent Application Publication Nos. 7-324802 (324802/95), 8-313042 (313042/96) and 9-222237 (222237/97).

These proposals are intended to regulate or control the conditioning airflow directly at the air-outlet formed or defined as a part of an outer casing or frame of the air-conditioning apparatus, sizes or dimensions of which are practically limited. However, such direct control of the overall airflow at the air-outlet where the flow speed or flow rate is high encounters various disadvantages. For example, when the airflow is controlled so as not to be directed to the ceiling surface, there is a possibility that intended effects cannot be obtained because of the possibility that the conditioned air cannot be spread fully in the room, and there is also a possibility that the adjustment conditions should be changed when the flow rate changes.

Japanese Patent Application Publication No. 8-94160 (94160/96) discloses forming a step or projection on a cover plate constituting an outer frame of the air-conditioning apparatus, which acts to deflect the conditioned air having been blown out through the air-outlet of the air-conditioning apparatus, and deflects the air away from the ceiling surface. A Microfilm of Japanese Utility Model Application No. 61-8595 (8595/86) corresponding to Japanese Utility Model Application Publication No. 62-120151 (120151/87) discloses a blow-out guide having an "L"-shaped cross-section which provides a similar function. However, there is a possibility that these devices will also encounter similar problems.

In addition, the above-mentioned prior art directed to modification of a body of the air-conditioning apparatus cannot solve the problem of contamination or smudging of the ceiling surface where the ceiling-mounted air-conditioning apparatus has been already mounted or installed.

Another attempt at a solution has been made domestically inside of Japan. In other words, the embodiment described now in this paragraph is not prior art except in a country where novelty- and/or obviousness-related provisions define that publicly accessible use of a structure even in another country or countries may also constitute prior art. In this attempt, a transparent plastic film or sheet having been bent in an obtuse angle is attached to an area of the ceiling surface where smudging is likely to be produced. However, when the flow rate of the blown-out air is low, there is a possibility that the air flows over the obtusely bent wall of the plastic film to smudge an area of the ceiling surface outside of the attached plastic film. On the other hand, when the flow rate of the blown-out air is high, an obtusely inclined and dependent deflection portion having an "L"-shaped cross-section is pressed by the airflow to be deformed away from the airflow.

In the meantime, it has also been proposed to form a peripheral portion of an air-conditioning duct opened in the ceiling with an arcuately curved portion so as to reduce contamination or smudging of the ceiling surface (Japanese Utility Model Application Publication No. 7-12847 (12847/95)). However, this proposal also involves similar problems as in the above-mentioned proposed ceiling-mounted air-conditioning apparatuses. In addition, behavior of conditioned airflow having been blown out through the air-outlet in the air-conditioning duct is somewhat different from that of the air-conditioning apparatus having the air-inlet at the central portion and the air-outlet at the peripheral portion, because the air-conditioning duct does not have the air-inlet in the opening but the whole opening serves as the air-outlet.

SUMMARY OF THE INVENTION

The present invention has been made in view of the foregoing, and one object of the invention is to provide a ceiling panel structure capable of also being applied to an existing, i.e., pre-installed, ceiling-mounted air-conditioning apparatus which has already been installed or mounted to the ceiling so as to minimize smudging or contamination of the ceiling surface around the air-conditioning apparatus.

Another object of the invention is to provide a ceiling panel structure facilitating mountability thereof even in a case where the ceiling surface is not flat but undulated.

Still another object of the invention is to provide a ceiling panel structure including a base member or structure and a cover member or structure, in which engagement/disengagement of the cover member or structure with/from the base member or structure can be facilitated, i.e., carried out easily.

According to the invention, the above-mentioned first object can be accomplished by a ceiling panel structure adapted to be mounted to a ceiling downstream of a conditioning air-outlet of a ceiling-mounted air-conditioning apparatus. The structure has a room air-inlet at a central portion thereof, and has the air-outlet at a peripheral portion thereof. The ceiling panel structure is adapted to be mounted to the ceiling outside of the air-conditioning apparatus, and includes a deflection induction portion which is substantially rigid against an airflow to deflect a part of the conditioned air blown out through the outlet of the air-conditioning apparatus, back to the room air-inlet.

As explained above, the ceiling panel structure of the invention comprises a deflection induction portion which is substantially rigid against an airflow to deflect a part of the conditioned air blown out through the outlet of the air-conditioning apparatus back to the room air-inlet. Therefore, by merely mounting the ceiling panel structure to a predetermined position of the ceiling, the ceiling panel structure can deflect, by means of the deflection induction portion thereof, the airflow having been blown out through the air-outlet of the air-conditioning apparatus back to the room air-inlet. Thus, the conditioned airflow that blows against or impinges on the ceiling surface is minimized and spread therealong so as to minimize the ceiling surface smudged by fine solid and/or liquid particles contained in the conditioning air. In addition, because the deflection induction portion is substantially rigid against the airflow, the deflection induction portion can deflect the airflow (i.e., change the direction of airflow into predetermined directions) even in a case where the air flows relatively rapidly. Further, the ceiling panel structure is situated in a spatial region, near the ceiling surface and more or less remote from the air-outlet of the air-conditioning apparatus, which is open to a room or indoor space. Therefore, the airflow can spread more or less before impinging on the deflection induction portion and can be directed to spread downwards upon impinging on the deflection induction portion, so that the conditioned airflow can be deflected appropriately upon impinging on the deflection induction portion. Although the deflection induction portion is typically constituted by a deflection guide part having a concavely curved guide surface to deflect the airflow therealong, the detailed or concrete configuration or shape thereof may be of any form so long as the direction of airflow can be changed significantly. Meanwhile, it is typically preferred to reduce beforehand the flow rate and the wind pressure or dynamic pressure thereof to be described later so as to change significantly the direction of airflow by the deflection induction portion. Furthermore, because the ceiling panel structure is mounted to the ceiling, at the downstream of the air-outlet, around or outside the air-conditioning apparatus, the air-conditioning apparatus may have been already installed in the ceiling. When mounted around the air-conditioning apparatus having been already installed in the ceiling, the ceiling panel structure of the invention will not only prevent the further progress of the smudging of the ceiling, but will also hide the smudge of the ceiling by covering a part of the smudged ceiling.

The ceiling panel structure and/or element(s) thereof is mounted or attached to the "lower" face of the ceiling, which may be expressed hereinafter as being mounted "on" the ceiling surface or "on" the ceiling, although, strictly speaking, the ceiling panel structure or the like is mounted "beneath" the ceiling surface or ceiling.

In order to facilitate the mounting work of the ceiling panel structure on the ceiling surface, the ceiling panel structure according to a preferred embodiment of the invention typically comprises at least one base member adapted to be mounted to a ceiling downstream of the air-conditioning apparatus and having an engaging portion at a side thereof opposite to a side faced to the ceiling. At least one cover member is engaged at an engaged portion thereof with the engaging portion of the at least one base member to be fixed thereto, and the at least one cover member has the deflection induction portion.

In the ceiling panel structure of the preferred embodiment, the cover member has a deflection induction portion which is substantially rigid against an airflow to deflect a part of the conditioned air having been blown out through the air-outlet of the air-conditioning apparatus back to the room air-inlet. Therefore, by merely engaging the cover member with the base member, having been attached to the predetermined position of the ceiling, to be fixed thereto, the ceiling panel structure can deflect, by means of the deflection induction portion of the cover member, a part of the airflow having been blown out through the outlet of the air-conditioning apparatus back to the room air-inlet. Therefore, the conditioning airflow impinging on the ceiling surface can be minimized, and the spread of the airflow along the ceiling surface can be minimized. In addition, because the deflection induction portion of the cover member is substantially rigid against the airflow, the deflection induction portion can deflect the airflow (i.e., change the direction of airflow) into predetermined directions even in a case where the air flows relatively rapidly. Further, the cover member is situated in the spatial region, near the ceiling surface and more or less remote from the air-outlet of the air-conditioning apparatus, which is opened to a room or indoor space. Therefore, the airflow tends to be deflected appropriately upon impinging on the deflection induction portion.

In addition, the ceiling panel structure of the embodiment comprises at least one base member to be mounted to the ceiling downstream of the air-conditioning apparatus and having an engaging portion at a side opposite to the ceiling, and at least one cover member engaged at an engaged portion thereof with the engaging portion of the at least one base member to be fixed thereto. As a result, the cover member can be easily fixed to the ceiling surface at the predetermined position.

More specifically, the ceiling panel structure having a configuration for adjusting the conditioning airflow necessarily has a considerable thickness. If such a thick ceiling panel structure is intended to be fixed directly to the ceiling surface without affecting an appearance thereof, it will become necessary to have a configuration for preventing heads of fastening screws or the like from being exposed. This arrangement would, in turn, make it difficult or hard to carry out the mounting work thereof so that the structure is facing upward toward the ceiling surface from a lower position, or would require plural persons or workmen to carry out even a simple mounting process. In contrast to these situations, in the above-mentioned embodiment of ceiling panel structure, the engaged portion of the cover member can be essentially formed at a side faced to the base member to be engaged with the engaging portion thereof. Thus, the mounting of the cover member can be carried out with ease even by a minimum number of person(s), such as a single workman.

Further, because the base member is provided separately from the cover member in the ceiling panel structure of the embodiment, the base member can be configured to facilitate the mounting work thereof by screws etc. on the ceiling surface without consideration of appearance thereof, and to have the engaging portion for facilitating the engagement thereof with the cover member. As a result, the mounting of the base member on the ceiling is facilitated and can be performed even by a minimum number of person(s), such as one person. Moreover, the engaging portion of the base member can be covered (hidden) by the cover member, and the engaged portion of the cover member can be designed to have a configuration or structure as desired in view of ease of mounting and strength of engagement and fixation. Therefore, the engagement/fixation of the cover member with/to the base member can be carried out easily. Accordingly, both mounting work of the base member to the ceiling surface and engagement/fixation of the cover member with/to the base member can be performed by a minimum number of person(s), e.g., by one person, which enables the entire mounting process of the ceiling panel structure on the ceiling surface to be performed by the minimum number of person(s), e.g., by one person. Each of the cover and base members may be formed by a single or integral member or by a combination of plural members or parts.

The ceiling-mounted air-conditioning apparatus may have any outer shape or any two dimensional shape, such as a rectangular (square or quadrilateral) or circular shape or other shape, in which a lower end of the apparatus extends or spreads along the ceiling surface in a state where almost all of the apparatus is embedded in the ceiling, so long as the apparatus has the room air-inlet at the central portion thereof and the conditioning air-outlet at the peripheral portion thereof. As a matter of course, although the air-conditioning apparatus has more or less three dimensional shapes protruding downward from the ceiling surface, the three dimensional shape may be of any form so long as the apparatus has the room air-inlet at the exposed central bottom part thereof and the conditioning air-outlet at the exposed peripheral bottom part thereof.

The conditioning air-outlet may be provided at only a part of the peripheral portion or part of the apparatus or over substantially the whole periphery thereof, so long as the air-outlet is provided at the periphery and is configured or adapted to blow out the conditioned air more or less outwards. For example, in a case where the two dimensional shape or configuration of the air-conditioning apparatus on the ceiling surface, i.e., shape in plan view (strictly, bottom view), is rectangular, the air-outlet may be formed along only one side of the four sides of the rectangle or along two parallel sides thereof or along all of the four sides thereof. The air-outlet may be formed at the corner.

The ceiling panel structure according to an embodiment of the invention typically comprises cover member(s), each having a deflection induction portion to deflect the flow of the conditioned air blowing out of the associated one of the air-outlet(s). Therefore, if there is one linearly extending air-outlet, each cover member typically comprises a single linear cover member (as a matter of course, the single cover member may be formed by combination of plural parts). However, if desired, each cover member may further comprise, at the longitudinal end of the linear cover member, a corner cover member curved at the corner. The cover member may also be configured like a picture frame in the form of a rectangular or four-sided closed loop to surround the entire periphery of the air-conditioning apparatus.

The base member typically has a two-dimensional shape or configuration similar to that of the cover member to be engaged by the cover member to be fixed thereto. Thus, when the cover member is a linear cover member, the base member is typically a linear base member, while the base member is typically a corner base member curved at the corner when the cover member is a corner cover member curved at the corner. However, the base member may have a two dimensional shape different from that of the cover member, so long as the base member can engage the cover member to be fixed thereto. For example, when the cover member is a linear cover member, the base member must engage at least a part of the cover member near either longitudinal end thereof to support it. Thus, both ends of the linear cover member may be supported by the associated corner base members situated at the associated corners.

Typically, the surface of the cover member is configured to adjust the conditioning airflow, to deflect the airflow (i.e., to change the direction of airflow), to provide a resistance against the airflow (i.e., to serve as flow-resistance against the airflow thereby reducing the wind pressure and flow rate of the air) and/or to guide the airflow (i.e., to regulate the direction of airflow without substantially preventing the flow of air, while changing or not changing the direction of the airflow). If the cover member covers the base member substantially completely, only the surface of the cover member performs these functions. However, a part of the base member may be exposed at the ceiling surface without being covered by the cover member. Such being the case, the surface configuration for the deflection, flow-resistance (reduction in flow rate), and/or flow-guide to adjust the conditioning airflow may be partially provided by the base member. Even in these circumstances, the cover member serves not only to adjust the conditioning airflow at the deflection induction portion thereof and to cover a mounting structure portion of the base member to the ceiling surface, but also to cover the engagement portions of the base member and cover member. The induction or guide portion having a flow-deflection function has more or less the flow-resistant function also.

Thus, in a typical ceiling panel structure according to an embodiment of the invention, the at least one base member comprises a linear base member capable of being mounted at one principal face thereof to a surface of the ceiling to extend along at least one linear side edge of the air-conditioning apparatus, the linear base member having an adjustable length and/or width, and the at least one cover member comprises a linear cover member engaged with the linear base member and having an adjustable length. In addition, the linear base member comprises a conditioning airflow guide surface at one widthwise end portion of a principal face opposite to the one principal face generally parallel to the one principal face. The one widthwise end portion is closer than another widthwise end to the side edge of the air-conditioning apparatus where the air-outlet is provided. The engaging portion is located at a position more remote than the guide surface in the widthwise direction from the side edge of the air-conditioning apparatus. Moreover, the linear cover member comprises the deflection induction portion for deflecting a part of the conditioning air, flowing along the guide surface of the linear base member, back to the room air-inlet.

In addition, in one typical ceiling panel structure according to an embodiment of the invention, the linear base member further comprises a flow-resistant projection portion, at a widthwise outer end of the guide surface, engaged with a widthwise inner end of the linear cover member. The projection portion serves as a resistance against the airflow for reducing a flow rate of the conditioning air having spread along the guide surface.

Further, in one typical ceiling panel structure according to an embodiment of the invention, the cover member comprises a flow-resistant projection portion, at an upstream of the deflection induction portion, which serves as a resistance against the airflow for reducing a flow rate of the conditioning air flowing along the surface of the cover member. There may be a plurality of such flow-resistant projections. Typically, the flow-resistant projection of the cover member is adapted to have a higher flow-resisting function than that of the base member. However, the relationship therebetween may be reversed.

In any case, the appropriate reduction in the wind pressure or flow rate of the conditioning air before flowing into the deflection induction portion allows the airflow impinging on the deflection induction portion to tend to flow along the guide face of the deflection induction portion.

The ceiling panel structure is formed to have a shape and sizes based on an outer shape and dimensions (sizes) of the air-conditioning apparatus mounted in the ceiling surface. Therefore, the base and cover members constituting the ceiling panel structure are formed to be length-adjustable. The length adjustment is typically carried out by cutting (using a saw or the like) the base and cover members, each having a constant shape in a cross-section perpendicular to the longitudinal direction thereof, at the mounting site by the workman. The base and cover members constituting the ceiling panel structure are typically made of plastic material and are produced by extrusion molding. The plastic material may be, for example, vinyl chloride resin. However, other plastic material may be used to minimize the environmental pollution. The material of the members may, however, be other materials such as metal, wood or a composite material of metal and plastics so long as the member can be cut with a saw at the mounting job site by the workman.

The ceiling panel structure is mounted around the air-conditioning apparatus in an unoccupied area of the ceiling surface where the apparatus is mounted, typically in a manner to avoid obstacle(s), such as a power-supply line or electric wiring output and various sensors like a smoke sensor, which may happen to be in or on the ceiling surface near the outer periphery of the air-conditioning apparatus. Therefore, in the ceiling panel structure, typically, the constituent base and cover members are also designed to be width-adjustable. In some cases, a longitudinal side of the air-conditioning apparatus may be as long as two meters. Therefore, in order to facilitate the width-adjustment over a length of about two meters along the longitudinal direction thereof, the ceiling panel structure has typically weakened parts extending in the longitudinal direction thereof to allow, if desired, a widthwise end part thereof to be removed by forming a cutting line therealong by means of a cutter knife or the like so that the width thereof can be adjusted. Typically, each of the weakened parts comprises a groove extending in the longitudinal direction. Such grooves are formed in a rear face, i.e. a side faced to the ceiling, in view of appearance.

Therefore, in a typical ceiling panel structure according to an embodiment of the invention, the at least one base member comprises a linear base member capable of being mounted at one principal face thereof to a surface of the ceiling to extend along at least one linear side edge of the air-conditioning apparatus. The linear base member has an adjustable length and/or width, and the at least one cover member comprises a linear cover member engaged with the linear base member and having an adjustable length.

In this case, it is possible to mount the linear base member so as to avoid the obstacle(s) near the air-conditioning apparatus by adjusting the width of the base member. In addition, it is possible to adjust the lengths of the linear base and cover members at the mounting job site, based on the length of the air-outlet of the air-conditioning apparatus or a size of a side extending parallel with the air-outlet of the apparatus, to mount or install the ceiling panel structure.

In a typical ceiling panel structure according to an embodiment of the invention, the base member includes a corner base member capable of being mounted at one principal face thereof to the ceiling surface adjacent to a longitudinal end of the linear base member at an outside of a corner portion of the air-conditioning apparatus. The cover member includes a corner cover member engaged with the corner base member adjacent to a longitudinal end of the linear cover member.

In this case, for example, the ceiling panel structure may have, in plan view, a generally rectangular shape or the like to typically surround the entire periphery of the air-conditioning apparatus or to be situated at least around two sides thereof.

In a typical ceiling panel structure according to an embodiment of the invention, the base member includes a corner base member capable of being mounted to a surface of the ceiling at an outside of a corner portion of the air-conditioning apparatus. The cover member includes a linear cover member engaged with the corner base member at either longitudinal end thereof and having an adjustable length and width. A corner cover member is engaged with the corner base member adjacent to the longitudinal end of the linear cover member. In this case, the base member is minimized while facilitating the mounting. However, in a case where the air-conditioning apparatus is of large dimension or size and the length of the linear base member is long, another or separate base member may be disposed at a rear side of an intermediate position of the linear cover member (i.e. between the ceiling surface and the cover member) to support the linear cover member firmly.

A typical ceiling panel structure according to an embodiment of the invention is adapted to be mounted to a ceiling downstream of a conditioning air-outlet of a ceiling-mounted air-conditioning apparatus, having a room air-inlet at a central portion thereof and the air-outlet at a peripheral portion thereof. The ceiling panel structure comprises linear panel structures and corner panel structures. Each of the linear panel structures comprises a base member capable of being mounted to a surface of the ceiling at one principal face thereof so as to extend along an associated linear side edge of the air-conditioning apparatus, a length and width of the base member in an extending direction thereof being adjustable. The base member has an engaging portion at a principal face thereof opposite to the one principal face, and a cover member having an adjustable length and width is adapted to be engaged with the engaging portion of the associated base member at an engaged portion thereof to be fixed thereto. The cover member has a deflection induction portion which is substantially rigid against an airflow to deflect a part of the conditioning air having been blown out through the outlet of the air-conditioning apparatus, back to the room air-inlet. Each corner panel structure is adapted to be positioned between adjacent ends of the associated linear panel structures to be engaged with the adjacent ends.

So long as the smudge on the ceiling surface near the air-outlet of the ceiling mounted air-conditioning apparatus having been already installed or mounted can be covered and hidden, at least a part of the base and/or cover members may be transparent or semi-transparent. However, in order to ensure to cover and hide the smudge on the ceiling surface near the air-outlet of the ceiling-mounted air-conditioning apparatus having been already installed, it is preferred that the base and cover members are typically made of substantially opaque material. However, at least a part of the members may be made of transparent or semi-transparent material in a case where the ceiling surface is not smudged yet or where the air-conditioning apparatus is mounted in the ceiling surface for the first time.

According to one aspect of the invention, the above-mentioned further object of the invention can be attained by a ceiling panel structure adapted to be mounted to a ceiling downstream of a conditioning air-outlet of a ceiling-mounted air-conditioning apparatus, in which the ceiling has a room air-inlet at a central portion thereof and an air-outlet at a peripheral portion thereof. The ceiling panel structure includes a deflection induction portion which is substantially rigid against an airflow so as to deflect the conditioning air blown out through the outlet of the air-conditioning apparatus away from the ceiling. The ceiling panel structure comprises a base structure adapted to be mounted to a ceiling outside of the air-conditioning apparatus, and has an engaging portion at a side opposite to a side facing the ceiling. The base structure includes a linear base member adapted to be mounted to a surface of the ceiling at one principal face thereof so as to extend along a side edge of the air-conditioning apparatus. A cover structure has an engaged portion that engages the engaging portion of the base structure to be fixed thereto. The cover structure includes a linear cover member adapted to be engaged with the linear base member, and has the deflection induction portion. The engaging portion of the linear base member comprises a pair of engaging recesses spaced from each other in a widthwise direction thereof and opened at opposite sides to face away from each other. One of the recesses has side walls, and one of the side walls is situated closer to the surface of the ceiling than another one of the side walls having an inclined face inclined to be closer to the surface of the ceiling as departing more remote from another of the recesses. The engaged portion of the linear cover member comprises a pair of engaged projections for engaging the pair of engaging recesses of the linear base member, and the engaged projections are spaced from each other in a widthwise direction of the linear cover member. The pair of engaged projections are situated at sides facing each other, and are capable of being displaced resiliently toward/from each other. One of the projections has a guide part movable along the inclined face of the side wall, closer to the surface of the ceiling, of the one recess.

The ceiling panel structure according to the first aspect of the invention is adapted to be mounted or installed to the ceiling outside the air-conditioning apparatus and includes a deflection induction portion substantially rigid against the airflow for deflecting the airflow blown out through the air-outlet of the air-conditioning apparatus in a direction away from the ceiling surface. Therefore, by mounting the ceiling panel structure at a predetermined position of the ceiling outside the apparatus, it is possible to deflect by the deflection induction portion the conditioning airflow blown out through the air-outlet of the air-conditioning apparatus, in the direction away from the ceiling, to minimize the conditioning airflow out of the air-outlet blowing against or impinging on the ceiling and/or spreading along the ceiling surface, thereby minimizing the smudging of the ceiling surface by fine particles or the like such as solid or liquid particles contained in the conditioning airflow. In addition, because the deflection induction portion is substantially rigid against the airflow, the deflection induction portion can deflect the airflow (change the direction of the airflow) in a predetermined direction(s) even when the airflow is relatively strong or rapid. Further, because the ceiling panel structure is situated in a spatial region, near the ceiling surface and more or less remote from the air-outlet of the air-conditioning apparatus, which is opened to a room or indoor space, the airflow more or less spreads before impinging on the deflection induction portion and can be directed to spread downwards upon impinging on the deflection induction portion. Therefore, the conditioning airflow having impinged on the deflection induction portion can be deflected appropriately.

Further, the ceiling panel structure of the above-mentioned aspect comprises a base structure adapted to be mounted to a ceiling at an outside of the air-conditioning apparatus and having an engaging portion at a side opposite to the ceiling. The base structure includes a linear base member adapted to be mounted on the ceiling surface at one principal face thereof so as to extend along a side edge of the air-conditioning apparatus. A cover structure has an engaged portion engaged with the engaging portion of the base structure to be fixed thereto, and the cover structure includes a linear cover member adapted to be engaged with the linear base member. Therefore, the mounting or installation of the ceiling panel structure can be carried out with ease by mounting the base structure on the ceiling surface with a fixing means such as screws, by laying the cover structure on (beneath) the base structure to cover the mounting part(s) of the fixing or mounting means, and by engaging the engaged portion of the cover structure with the engaging portion of the base structure. The base structure typically comprises the linear base member and a corner base member, while the cover structure typically comprises the linear cover member and a corner cover member. However, the base structure may constitute one linear base member, and the cover structure may constitute one linear cover member.

Because the linear base member is provided separately from the linear cover member also in the ceiling panel structure of the embodiment according to the first aspect, the linear base member can be configured to facilitate the mounting work thereof by screws etc. on the ceiling surface without consideration of appearance because a part thereof is to be covered by the linear cover member, and is to have the engaging portion for engaging the linear cover member. As a result, the mounting work of the linear base member on the ceiling is facilitated and can be performed even by a minimum number of persons, such as one person. Moreover, the engaging portion of the linear base member can be covered to be hidden substantially by the linear cover member, and the engaging portion of the linear base member and the engaged portion of the linear cover member can be designed to have configurations or structures as desired in view of easy and firm engagement and fixation/easy disengagement. Therefore, the engagement and disengagement of the linear cover member with and from the linear base member can be carried out easily. Accordingly, both the mounting of the linear base member to the ceiling surface and the engagement of the linear cover member with the linear base member can be performed by a minimum number of persons, such as one person, so that the entire mounting process of the ceiling panel structure on the ceiling surface can be performed by the minimum number of person(s), e.g., by one person. Each of the linear cover and base members may be formed by a single or integral member or by a combination of plural members or parts.

In addition, in the ceiling panel structure of the first aspect according to the invention, the linear cover member comprises the deflection induction portion which is substantially rigid against an air flow to deflect the conditioning air blown out through the outlet of the air-conditioning apparatus in a direction away from the ceiling. Therefore, the engaging portion of the linear base member and the engaged portion of the linear cover member can be arranged with ease within a region defined by a thickness and width of the linear cover member required for providing an airflow-adjustment structure such as the deflection induction portion for adjusting the conditioning airflow. Thus, the engaging portion and engaged portion are provided in a form appropriate for the mounting work.

In the specification, with respect to the linear cover member, "adapted to be mounted on the ceiling surface at one principal face" typically means that the member is mounted on the ceiling surface so that one principal face directly contacts the ceiling surface. However, if desired, the linear base member may be mounted on the ceiling surface so that a projection (leg) or projections (legs) projecting from the one principal face toward the ceiling surface abuts against the ceiling surface. In addition, with respect to the linear base member, "to extend along the side edge of the air-conditioning apparatus" typically means that the air-conditioning apparatus has a linear side edge and the linear base member extends parallel with the linear side edge of the apparatus. However, if desired, the linear base member may not be parallel. Further, in a case where the side edge of the air-conditioning apparatus is not linear, it is sufficient that the linear base member extends in a direction generally identical or parallel to an average extending direction of the side edge. Moreover, with respect to the engaging portion of the linear base member, "a side opposite to a side facing to the ceiling" or "a side opposite to the ceiling" is intended to include a portion or part protruding in a desired direction from the side opposite to (the side facing) the ceiling. In other words, the side is not limited to a face parallel to the ceiling surface, but also includes a face not parallel to the ceiling surface.

Typically, the surface of the linear cover member has a configuration, for the purpose of adjusting the conditioning airflow, to deflect the airflow (i.e., to change the direction of airflow), to provide a resistance against the airflow (i.e., to serve as flow-resistance against the airflow thereby reducing the wind pressure and flow rate of the air), and/or to guide the airflow (i.e., to regulate the direction of airflow without substantially preventing the flow of air, while changing or not changing the direction of the airflow). In a case where the linear cover member covers the linear base member substantially completely, only the surface of the linear cover member performs these functions. However, a part of the linear base member may be exposed at the ceiling surface without being covered by the linear cover member. Such being the case, the surface configuration for the deflection, flow-resistance (reduction in flow rate), and/or flow-guide to adjust the conditioning airflow may be partially provided by the base member. Even in these circumstances, the linear cover member serves not only for adjusting the conditioning airflow at the deflection induction portion thereof and for covering a mounting structure portion of the base member on the ceiling surface, but also for covering the engagement portions of the linear base member and linear cover member. The induction or guide portion having a flow-deflection function has more or less the flow-resistant function also.

In addition, in the ceiling panel structure according to the first aspect of the invention, the engaging portion of the linear base member comprises a pair of engaging recesses spaced from each other in a widthwise direction thereof and opened at opposite sides to face away from each other. The engaged portion of the linear cover member comprises a pair of engaged projections to be engaged with the pair of engaging recesses of the linear base member. The engaging projections are spaced from each other in a widthwise direction of the linear cover member, and the pair of engaged projections are situated at sides facing each other. Thus, the pair of engaging portions of the linear base member as well as the pair of engaged portions of the linear cover member to be engaged therewith can be covered behind the linear cover member, and the engagement/disengagement of the engaged portions of the linear cover member with/from the engaging portions of the linear base member can be performed respectively by engaging/disengaging, with/from one of the pairs of engaging recesses, the associated one of the pairs of engaged projections of the linear cover member when another of the pairs of engaging recesses of the linear base member engages the associated one of the engaged projections of the linear cover member. In addition, because the pair of engaging recesses of the linear base member are opened to sides or directions widthwise opposite to each other, both of the side walls or wall portions defining each recess can extend along the longitudinal direction of the linear base member generally parallel to the ceiling surface, and the side walls can be deformed to be undulated in the longitudinal direction according to an undulation of the ceiling surface. Further, because the pair of engaged projections of the linear cover member protrude in widthwise opposite directions to each other, each projecting rib defined by the engaged projection also extends along the longitudinal direction of the linear cover member generally parallel to the ceiling surface, so that the ribs can be deformed with ease to be undulated relatively following the undulation of the ceiling surface. Therefore, the undulation of the ceiling surface can be absorbed or compensated for relatively easily by the deformation of the linear base and cover members corresponding to the undulation of the ceiling. That is, even if the linear base member is undulated to some extent according to the undulation of the ceiling surface upon mounting thereof on the ceiling, the associated engaged projection of the linear cover member can be fit into another of the pair of engaging recesses of the linear base member at a side opposite to the engaging recesses. In this case, in order that the insertion of the corresponding engaged projection into engaging recess can be induced or guided, it is preferred that one of the side walls of the engaging recess has a guide face for guiding the insertion of the corresponding engaged projection, that the engaged projection is tapered like a wedge, or that the engaging recess is opened to be wider closer to an open end thereof.

In this case, preferably, the linear cover member has, near the engaged portion, a plate portion expanding generally parallel to the ceiling surface, which facilitates the bending deformation of the linear cover member in the longitudinal direction according to the undulation of the ceiling surface. The plate portion can serve as a guide face for the conditioning airflow.

In addition, in the ceiling panel structure of the first aspect, one of the recesses has side walls, and one of the side walls is situated closer to the surface of the ceiling than another of the side walls having an inclined face inclined to be closer to the surface of the ceiling as departing more remote from another of the recesses. One of the engaged projections of the linear cover member corresponding to the one engaging recess has a guide part movable along the inclined face of the side wall, closer to the ceiling surface, of the one recess. Therefore, even when the linear cover member is undulated in the longitudinal direction thereof according to the undulation of the ceiling surface in case of an undulated ceiling surface, the undulation can be absorbed or compensated for by displacement of the guide part of the engaged projection of the linear cover member, in a direction approaching or away from the ceiling surface, with respect to the inclined face of the side wall, of the one engaging recess of the linear base member, closer to the ceiling. Therefore, even when the ceiling surface is undulated, it is possible to prevent engagement/disengagement of the linear cover member with/from the linear base member from becoming too hard to perform smoothly.

A side wall of the pair of side walls defining the one recess portion of the linear base member that is situated more remote from the ceiling may be generally parallel with the ceiling surface. However, it is preferred that the side wall have an inclined face at a side opposite to the ceiling surface which approaches the ceiling as departing more remote from the other recess so as to facilitate the engagement of the engaged portion of the linear cover member with the engaging portion of the linear base member.

Due to the above arrangement, by only pressing the linear cover member against the linear base member while engaging the corresponding engaged projection of the linear cover member with the other engaging recess of the engaging portions of the linear base member, it is possible to move or displace the guide part of the engaged projection portion along the inclined face (opposite to the ceiling surface) of the side wall (situated more remote from the ceiling surface) of the engaging projection of the linear base member until the engaged projection is displaced over the end of the inclined face, and to engage the guide part thereof with the inclined face of the one side wall of the linear cover member. Thereafter, only by releasing the exertion of pressing force on the linear cover member as desired, the engagement of the linear cover member with the linear base member can be accomplished. In the explanation above, it is assumed that a side wall (of the one engaging recess portion) closest to the ceiling surface extends and terminates at a position more remote from another engaging recess portion than that of the side wall situated more remote from the ceiling surface.

Further, by pressing the linear cover member against the linear base member while the pair of engaged projections of the linear cover member are engaged with the corresponding pair of engaging recesses of the linear base member, it is possible to displace the guide part of one of the engaged projections along the inclined face of one of the engaging recesses away from another of the engaging recesses to increase a distance between the pair of engaging projections of the linear cover member. Thus, as desired, the engagement of the linear cover member with the linear base member can be released by utilizing a tool or the like.

Each of the pair of engaging recesses of the linear base member may extend intermittently in the form of a line over substantially the whole length of the extending direction of the linear base member. However, in order to release the engagement of the engaged projection with the engaging recess as if peeling off the engagement from one longitudinal end, it is preferred that at least the one engaging recess of the pair of recesses (and, therefore, the side walls thereof) extends continuously in the longitudinal direction of the linear base member, that is, the recess is in the form of a groove extending along the longitudinal direction of the linear base member. A similar requirement or argument also applies to the corresponding engaged projection. For the disengagement or release of engagement, a distal end of an elongated tool such as a screw driver may be utilized. Instead, a tool, such as a thick walled spatula, shaped in the form of an "L" to avoid interference with the ceiling surface may be used. One of the pair of arms or legs of the "L" serves as a handle, and a wall part connecting the arms or legs is curved smoothly.

The linear cover member typically has a generally U-shaped cross-section, one engaged projection of the one pair of engaged projections, engaged with the one recess of the linear base member is formed at one of two legs of the "U", and the deflection induction portion is formed at another of the two legs. In this case, by pressing the bottom of the "U" of the linear cover member while another recess of the linear base member engages the engaged projection of the linear cover member, the engaged projection at the distal end of the one leg of the "U" is displaced along the inclined face of either side wall of the one engaging recess of the linear base member away from the distal end of another leg of the "U" to separate the distal ends of the two legs of the "U". Thus, the "U-shaped" cross-sectional portion of the linear cover member facilitates the deformation of the linear cover member for engagement/disengagement thereof with/from the linear base member. A certain magnitude or length is required in the legs of the "U" for the deflection induction portion to perform the deflection action. Therefore, the "U-shaped" cross-sectional portion ensures the height for the deflection induction portion on one hand and facilitates the engagement/disengagement of the linear cover member on the other hand.

In the description above, the one recess is typically situated more remote from the air-outlet of the air-conditioning apparatus than another of the pair of recesses. However, when the downward protruding length from the ceiling surface is relatively long, the one recess may be situated closer than another to the air-outlet of the air-conditioning apparatus.

In a ceiling panel structure according to an embodiment of the first aspect of the invention, typically, the linear base member comprises a conditioning airflow guide face at a widthwise end portion, adjacent to the side edge of the air-conditioning apparatus where the air-outlet is provided, of a principal face opposite to the one principal face generally parallel to the one principal face. Another engaging portion is provided at a position more remote in the widthwise direction than the guide face from the edge of the air-conditioning apparatus. The linear cover member comprises the other engaged portion, engaged with the other engaging portion of the linear base member, at a widthwise inner end thereof. A part of the other engaged portion facing the air-outlet of the air-conditioning apparatus serves as a flow-resistant projection acting as resistance against the airflow for reducing a flow rate of the conditioning airflow having flown along the guide face of the linear base member.

Such being the case, a surface part of the engaged projection of the linear cover member at an opposite side to a surface part for the engagement serves, as it is, as the flow-resistant projection portion. The linear cover member may also have, at a region downstream of the opposite surface of the engaged projection and upstream of the deflection induction portion, another flow-resistant projection. This projection serves as resistance against the conditioning airflow flowing along the surface of the cover member to reduce the wind pressure and flow rate thereof. In this case, typically, the downstream flow-resistant projection is designed to have a higher flow-resistance than the upstream flow-resistant projection. However, the relationship therebetween may be reversed. In any case, an appropriate reduction in the flow rate of the conditioning air flowing into the deflection induction portion facilitates the airflow impinging on or blowing against the deflection induction portion to be directed to flow along the guide face of the deflection induction portion.

The ceiling panel structure typically comprises the cover member(s), each having a deflection induction portion to deflect the flow of conditioning air blowing out of the associated one of the air-outlet(s). Therefore, in the case of one linearly extending air-outlet, the cover member(s) typically comprises a single linear cover member (as a matter of course, the single cover member may be formed by a combination of plural parts). Such being the case, it is preferred that an end cap is fitted to cover an end thereof. More specifically, such being the case, the ceiling panel structure preferably further comprises at least one end cap to cover at least one longitudinal end of each of the linear base structure (typically corresponding to the linear base member) and the linear cover structure (typically corresponding to the linear cover member) when the engaging portion of the linear base member engages the engaged portion of the linear cover member. However, if desired, each cover member may further comprise, at the longitudinal end of the linear cover member, a corner cover member curved at the corner. The cover member may alternatively be configured like a picture frame in the form of a rectangular or four-sided closed loop to surround the entire periphery of the air-conditioning apparatus.

Therefore, in a typical ceiling panel structure according to an embodiment of this aspect of the invention, the base structure comprises a linear base member capable of being mounted at one principal face thereof on the lower face of the ceiling so as to extend along at least one linear side edge of the air-conditioning apparatus and having an adjustable length and width. The cover structure comprises a linear cover member engaged with the linear base member and has an adjustable length.

In a typical ceiling panel structure according to an embodiment of this aspect of the invention, the base structure includes a corner base member capable of being mounted at one principal face thereof to the ceiling surface adjacent to a longitudinal end of the linear base member at an outside of a corner portion of the air-conditioning apparatus. The cover structure includes a corner cover member engaged with the corner base member adjacent to a longitudinal end of the linear cover member.

The corner base member is adapted or configured typically to cover (or is laid on) the ends of the linear base and cover members to be engaged therewith. In this regard, the terms "cover" or "laid on" refer to a state in which the component is arranged on (beneath) the ceiling surface from the lower side. However, the corner base member may have a side edge situated closer to the ceiling surface than at least one of the adjacent ends of the linear base and cover members or as high as the linear base member.

In a ceiling panel structure according to an embodiment of one aspect of the invention, when the corner base member covers the ends of the linear base and cover members, typically, the corner cover member comprises a part of the deflection induction portion which is substantially rigid against the airflow to deflect a part of the conditioning air blown out through the air-outlet of the air-conditioning apparatus in a direction away from the ceiling surface. The corner cover member has a generally U-shaped cross-section, and the corner cover member is engaged with an outwardly engaging portion of an outer side wall of the corner base member at an inwardly engaged portion of one of two leg parts of the "U", and makes contact at an inner face of a bottom part of the "U" with an extending end of the deflection induction portion of the corner base member. Such being the case, the corner base member typically comprises a flow-resistant projection, serving as resistance to reduce the flow rate of the conditioning air flowing along the surface of the corner base member, upstream of the deflection induction portion. In this case, the disengagement of the corner cover member from the corner base member can be made relatively easily.

A ceiling panel structure according to a typical embodiment of this aspect of the invention is adapted to be mounted to a ceiling at a downstream of a conditioning air-outlet of a ceiling-mounted air-conditioning apparatus, having a room air-inlet at a central portion thereof and the air-outlet at a peripheral portion thereof. The ceiling panel structure includes a deflection induction portion which is substantially rigid against an airflow to deflect the conditioning air blown out through the outlet of the air-conditioning apparatus in a direction away from the ceiling. The ceiling panel structure comprises linear panel structures. Corner panel structures are positioned between adjacent ends of the linear panel structures and engaged thereto, and each linear panel structure comprises a base member capable of being mounted to a surface of the ceiling at one principal face thereof so as to extend along an associated linear side edge of the air-conditioning apparatus and having an adjustable length and width in the extending direction. The base member has an engaging portion at a principal face opposite to the principal face, and a cover member of an adjustable length and width is adapted to be engaged with the engaging portion of the associated base member at an engaged portion thereof to be fixed thereto. The cover member has a deflection induction portion which is substantially rigid against an airflow to deflect a part of the conditioning air blown out through the air-outlet of the air-conditioning apparatus in a direction away from the ceiling. The engaging portion of the linear base member comprises a pair of engaging recesses spaced apart and facing away from each other in a widthwise direction of the linear base member. The pair of engaging recess portions extend in an extending direction of the linear base member, and one of a pair of engaging recesses has side walls. One of the side walls closer to a surface of the ceiling than the other one of the side walls has an inclined face inclined to be closer to the ceiling surface as departing more remote from another of the pair of recesses. The engaged portion of the linear cover member comprises a pair of engaged projections, engaged with the pair of engaging recesses of the linear base member, spaced apart from and facing each other in a widthwise direction of the linear cover member. One of the projections has a guide part movable along the inclined face of the side wall, closer to the ceiling surface, of the one recess.

Heretofore, a description has been made on the basis that the ceiling panel structure is mounted on the ceiling downstream of the air-outlet of the ceiling-mounted air-conditioning apparatus having the room air-inlet at the central portion and the conditioning air-outlet at the peripheral portion. However, the features of the ceiling panel structure thus described are also more or less effective if the ceiling panel structure is mounted on the ceiling, instead of the outer periphery of the ceiling-mounted air-conditioning apparatus, downstream of a conditioning air-outlet of a ceiling-mounted conditioning-air-discharge or blow-out apparatus, which has only the conditioning air-outlet(s) (i.e., the conditioning-air discharge duct has no air-inlet) and the whole aperture of the duct serves as the air-outlet. Therefore, the ceiling panel structure of the invention can also be applied even to the ceiling-mounted conditioning-air-discharge apparatus.

That is, the ceiling panel structure of the invention may have the following structures.

(1) A ceiling panel structure can be adapted to be mounted to a ceiling downstream of a periphery of a conditioning air-outlet of a ceiling-mounted conditioning-air-discharge apparatus, having the air-outlet at a surface of the ceiling. The ceiling panel structure comprises at least one base member adapted to be mounted to the ceiling downstream of the air-discharge apparatus and having an engaging portion at a side opposite to a side facing the ceiling; and at least one cover member engaged at an engaged portion thereof with the engaging portion of the at least one base member to be fixed thereto. The at least one cover member has a deflection induction portion which is substantially rigid against an airflow to deflect a part of the conditioning air blown out through the outlet of the air-discharge apparatus, in a direction away from the ceiling.

(2) A ceiling panel structure can be adapted to be mounted to a ceiling downstream of a periphery of a conditioning air-outlet of a ceiling-mounted conditioning-air-discharge apparatus, having the air-outlet at a surface of the ceiling. The ceiling panel structure comprises linear panel structures and corner panel structures, wherein each of the linear panel structures comprises a base member capable of being mounted to a surface of the ceiling at one principal face thereof to extend along an associated linear side edge of the air-discharge apparatus. A length and width of the base member in an extending direction thereof is adjustable, and the base member has an engaging portion at a principal face thereof opposite to the one principal face. A cover member having an adjustable length and width is adapted to be engaged with the engaging portion of the associated base member at an engaged portion thereof to be fixed thereto. The cover member has a deflection induction portion which is substantially rigid against an airflow to deflect a part of the conditioning air blown out through the outlet of the air-discharge apparatus, in a direction away from the ceiling. Each of the corner panels is adapted to be positioned between adjacent ends of the associated linear panel structures to be engaged with the adjacent ends.

(3) A ceiling panel structure can be adapted to be mounted to a ceiling downstream of a periphery of a conditioning air-outlet of a ceiling-mounted conditioning-air-discharge apparatus, having the air-outlet at a surface of the ceiling. The ceiling panel structure includes a deflection induction portion which is substantially rigid against an airflow to deflect the conditioning air blown out through the outlet of the conditioning-air-discharge apparatus, in a direction away from the ceiling. The ceiling panel structure comprises a base structure adapted to be mounted to a ceiling at an outside of the air-discharge apparatus and having an engaging portion at a side opposite to a side facing the ceiling. The base structure includes a linear base member adapted to be mounted to a surface of the ceiling at one principal face thereof so as to extend along a side edge of the air-discharge apparatus. A cover structure is engaged at an engaged portion thereof with the engaging portion of the base structure so as to be fixed thereto, and the cover structure includes a linear cover member adapted to be engaged with the linear base member and having the deflection induction portion. The engaging portion of the linear base member comprises a pair of engaging recesses spaced apart from each other in a widthwise direction thereof and opened at opposite sides to face away from each other. One of the recesses has side walls, and one of the side walls situated closer to the surface of the ceiling than the other one of the side walls has an inclined face inclined to be closer to the surface of the ceiling as departing more remote from another of the recesses. The engaged portion of the linear cover member comprises a pair of engaged projections, to be engaged with the pair of engaging recesses.of the linear base member, at regions spaced apart from each other in a widthwise direction of the linear cover member. The pair of engaged projections are situated at sides facing each other, and are capable of being displaced resiliently toward/from each other. One of the projections has a guide part movable along the inclined face of the side wall, closer to the surface of the ceiling, of the one recess.

(4) A ceiling panel structure can be. adapted to be mounted to a ceiling downstream of a periphery of a conditioning air-outlet of a ceiling-mounted conditioning-air-discharge apparatus, having the air-outlet at a surface of the ceiling. The ceiling panel structure includes a deflection induction portion which is substantially rigid against an airflow to deflect the conditioning air blown out through the outlet of the conditioning air-discharge apparatus, in a direction away from the ceiling. The ceiling panel structure comprises linear panel structures and corner panel structures positioned between adjacent ends of the linear panel structures and engaged thereto. Each linear panel structure comprises a base member capable of being mounted to a surface of the ceiling at one principal face thereof so as to extend along an associated linear side edge of the air-discharge apparatus and having an adjustable length and width in the extending direction. The base member has an engaging portion at a principal face opposite to the one principal face, and a cover member of an adjustable length and width adapted to be engaged with the engaging portion of the associated base member at an engaged portion thereof to be fixed thereto. The cover member has a deflection induction portion which is substantially rigid against an airflow to deflect a part of the conditioning air blown out through the air-outlet of the air-conditioning apparatus, in a direction away from the ceiling. The engaging portion of the linear base member comprises a pair of engaging recesses spaced apart and facing away from each other in a widthwise direction of the linear base member. The pair of engaging recess portions extend in an extending direction of the linear base member. One of a pair of engaging recesses has side walls, and one of the side walls closer to a surface of the ceiling than another one of the side walls has an inclined face inclined to be closer to the ceiling surface as departing more remote from another one of the pair of recesses. The engaged portion of the linear cover member comprises a pair of engaged projections, engaged with the pair of engaging recesses of the linear base member, spaced apart from and facing each other in a widthwise direction of the linear cover member. One of the projections has a guide part movable along the inclined face of the side wall, closer to the ceiling surface, of the one recess.

BRIEF DESCRIPTION OF THE DRAWINGS

The foregoing and other objects and features of the invention will be made clearer from the description of the preferred embodiments of the invention hereafter, with reference to accompanying drawings in which:

FIGS. 1A to 1F are explanatory views for illustrating that a ceiling panel structure is mounted according to a shape of a ceiling-mounted air-conditioning apparatus, in which FIG. 1A is an explanatory bottom view of an example of a square-shaped air-conditioning apparatus mounted in the ceiling as viewed from a lower position, FIG. 1B is an explanatory bottom view of a ceiling panel structure, according to one preferred embodiment of the invention, for the air-conditioning apparatus of FIG. 1A, FIG. 1C is an explanatory view showing how to adjust, according to a planner (bottom) shape of the ceiling-mounted air-conditioning apparatus, a shape or configuration of the ceiling panel structure, FIGS. 1D, 1E and 1F are explanatory bottom views of examples of various shapes or types of a ceiling-mounted air-conditioning apparatus to which the ceiling panel structure is applied, and FIG. 1G is an explanatory bottom view of an anemometer type of air-discharge apparatus to which the ceiling panel structure is applied;

FIGS. 4A and 4B are illustrations of a ceiling panel structure according to one preferred embodiment of the invention, in which FIG. 4A is a partially broken explanatory bottom view thereof, and FIG. 4B is an explanatory side view thereof as viewed in a direction of an arrow IVB in FIG. 4A;

FIGS. 5A and 5B are illustrations of a linear panel structure for the ceiling panel structure of FIG. 4A, in which FIG. 5A is an explanatory bottom view, and FIG. 5B is an explanatory sectional view along a line VB—VB of FIG. 5A;

FIGS. 6A and 6B are illustrations of a linear base member for the linear panel structure of FIG. 5A, in which FIG. 6A is an explanatory bottom view and FIG. 6B is an explanatory sectional view along a line VIB—VIB of FIG. 6A;

FIGS. 7A and 7B are illustrations of a linear cover member for the linear panel structure of FIG. 5A, in which FIG. 7A is an explanatory bottom view, and FIG. 7B is an explanatory sectional view along a line VIIB—VIIB of FIG. 7A;

FIGS. 8A and 8B are illustrations of a corner panel structure for the ceiling panel structure of FIG. 4A, in which FIG. 8A is an explanatory side view as viewed in a direction of an arrow VIIIA of FIG. 8B, and FIG. 8B is an explanatory bottom view;

FIGS. 9A to 9D are illustrations of a corner base member for the corner panel structure of FIG. 8A, in which FIG. 9A is an explanatory side view, FIG. 9B is an explanatory sectional view along a line IXB—IXB of FIG. 9C, FIG. 9C is an explanatory bottom view as view in a direction of an allow IXC of FIG. 9A, and FIG. 9D is an explanatory sectional view along a line IXD—IXD of FIG. 9C;

FIGS. 10A and 10B are illustrations of a corner cover member for the corner panel structure of FIG. 8A, in which FIG. 10A is an explanatory side view, and FIG. 10B is an explanatory bottom view as viewed in a direction of an arrow XB of FIG. 10A;

FIGS. 15A to 15C are illustrations of a modification of the corner panel structure, in which FIG. 15A is an explanatory oblique view of a corner base member thereof serving also as a base for a linear cover member, as viewed from an obliquely lower position, FIG. 15B is an explanatory oblique view illustrating a mounting process of the linear cover member, and FIG. 15C is an explanatory oblique view illustrating a mounting process of the corner cover member;

FIGS. 16A to 16B are illustrations of a modification of the corner base member, in which FIG. 16A is an explanatory oblique view illustrating an intermediate state for mounting the corner base member as viewed from an obliquely lower position, and FIG. 16B is an oblique view of the corner base member after mounting or assembly of corner base member;

FIGS. 17A to 17D are illustrations relating to a modified ceiling panel structure, in which FIG. 17A is a bottom (plan) view illustrating a mounting process of a corner base member which also serves as a base of the linear cover member, FIG. 17B is a bottom view illustrating a state where two corner base members have been assembled, FIG. 17C is a bottom view illustrating a state where two corner base members have been connected with each other through a linear cover member (a state where a linear cover member has been mounted between two corner base members), and FIG. 17D is an explanatory bottom view illustrating a state just before completing assembly of the ceiling panel structure;

FIGS. 18A and 18B show a ceiling panel structure according to a preferred embodiment of an aspect of the invention, in which FIG. 18A is a partially broken explanatory bottom view, and FIG. 18B is an explanatory side view in a direction of an arrow of XVIIIB of FIG. 18A, FIGS. 19A and 19B show a linear panel structure for the ceiling panel structure of FIG. 18A, in which FIG. 19A is an explanatory bottom view, and FIG. 19B is an explanatory sectional view along a line XIXB—XIXB of FIG. 19A;

FIGS. 21A to 21D are illustrations of the linear base member of FIG. 20A, in which FIG. 21A is an explanatory bottom view, FIG. 21B is an explanatory sectional view along a line XXIB—XXIB of FIG. 21A, FIG. 21C is an explanatory sectional view of a modification of an engaging recess situated at a widthwise outer end, and FIG. 21D is an explanatory sectional view of a modification of a part of an inclined face;

FIGS. 23A to 23C are illustrations of the linear cover member of FIG. 22, in which FIG. 23A is an explanatory bottom view, FIG. 23B is an explanatory sectional view along a line XXIIIB—XXIIIB of FIG. 23A, and FIG. 23C is an explanatory sectional view of a modification of an engaged projection situated at a widthwise outer side;

FIGS. 24A and 24B are illustrations of a corner panel structure for the ceiling panel structure of FIG. 18A, in which FIG. 24A is an explanatory side view as viewed in a direction of an arrow XXIVA of FIG. 24B, and FIG. 24B is an explanatory bottom view in a direction of an arrow XXIVB of FIG. 24A;

FIGS. 25A and 25B are illustrations of, respectively, a corner base member and corner cover member for the corner panel structure of FIG. 24A, in which FIG. 25A is an explanatory oblique view of the corner base member, and FIG. 25B is an explanatory oblique view of the corner cover member;

FIGS. 26A to 26C are illustrations of the corner base member of FIG. 25A, in which FIG. 26A is an explanatory side view as viewed in a direction of an arrow XXVIA of FIG. 26B, FIG. 26B is an explanatory bottom (surface) view as viewed in a direction of an arrow XXVIB of FIG. 26A, and FIG. 26C is an explanatory side view as viewed in a direction of an arrow XXVIC of FIG. 26B;

FIGS. 28A to 28C are illustrations of the corner cover member for the corner panel structure of FIG. 24A, in which FIG. 28A is an explanatory side view as viewed in a direction of an arrow XXVIIIA of FIG. 28B, FIG. 28B is an explanatory bottom view as viewed in a direction of an arrow XXVIIIB of FIG. 28A, and FIG. 28C is an explanatory view of a modification of the engaged projection;

FIGS. 31A and 31B are illustrations of superposed states of the linear panel structure and the corner panel structure, in which FIG. 31A is an explanatory sectional view of FIG. 30 along a line XXXIA—XXXIA (whereas the linear panel structure 311D is not shown), and FIG. 31B is an explanatory sectional view of a modification of FIG. 31A, illustrated similar to FIG. 31A;

FIGS. 33A to 33F are illustrations for an end cap structure to be fitted to either end of the linear panel structure to provide a linear panel structure apparatus in a case where the linear panel structure is used independently of the corner member, in which FIG. 33A is an explanatory plan (upper face) view, FIG. 33B is an explanatory front view, FIG. 33C is an explanatory bottom view, FIG. 33D is an explanatory right side view, FIG. 33E is an explanatory rear (back) view, and FIG. 33F is an explanatory left side view.

DETAILED DESCRIPTION OF THE INVENTION

Now, ceiling panel structures according to preferred embodiments of the invention will be described in detail referring to the accompanying drawings.

Figures 1A, 1B, 1C, 1D, 1E, 1F, 1G:
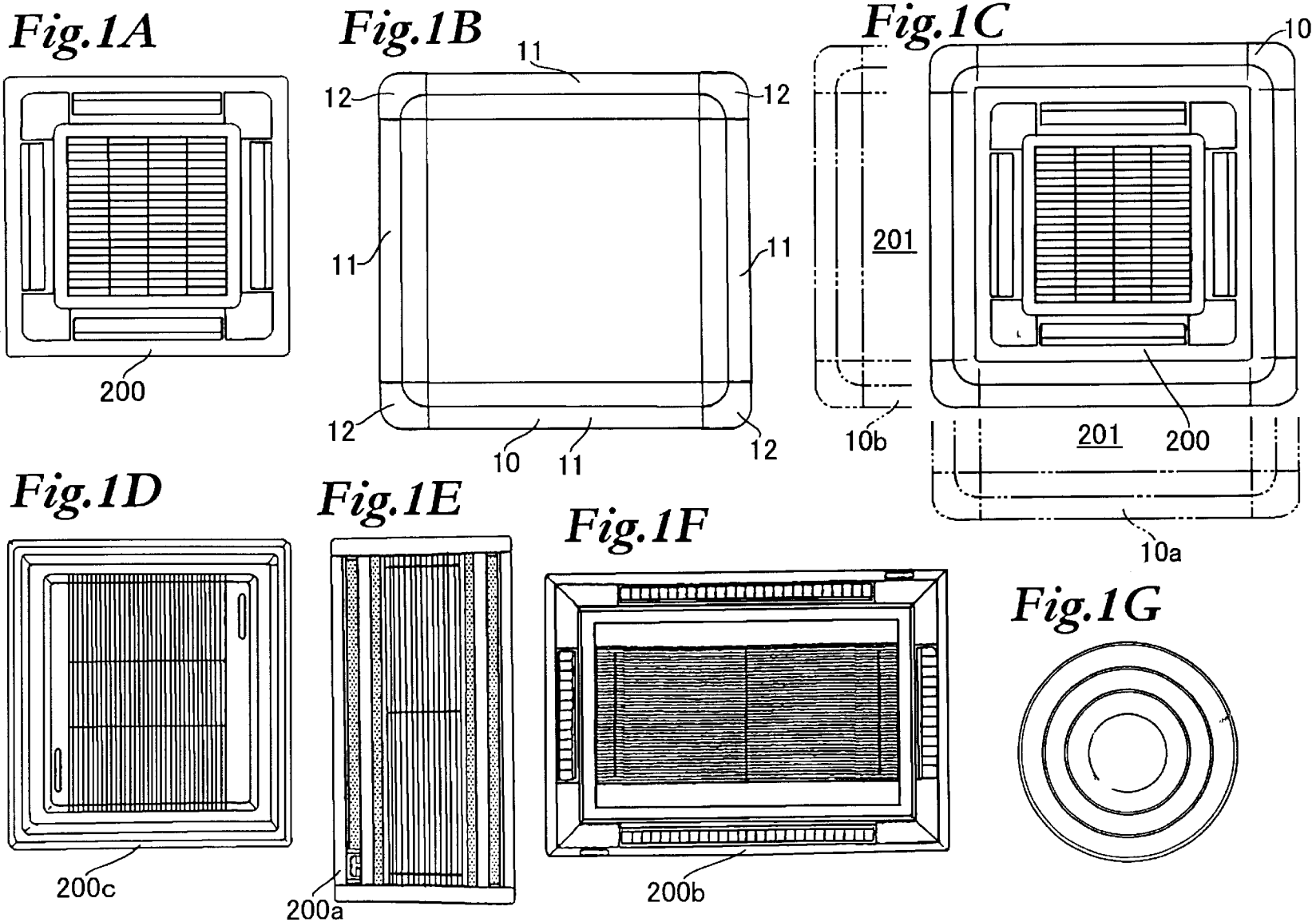

FIG. 1A shows a ceiling-mounted air-conditioning apparatus 200 mounted in a ceiling surface 201 as viewed from a lower face, i.e. bottom face thereof, FIG. 1B shows a ceiling panel structure 10 according to a preferred embodiment of the invention, and FIG. 1C shows a state where the ceiling panel structure of FIG. 1B is mounted around the air-conditioning apparatus of FIG. 1A.

The ceiling panel structure 10 comprises four linear panels 11, the lengths of which are adjustable, and four corner panels 12, each connecting to the adjacent linear panels 11,11 at respective adjacent ends of the linear panels.

In a case where the air-conditioning apparatus is of a type 200*a* having a longitudinally or vertically (in the face of the drawing) elongated rectangular outer shape as shown in FIG. 1E, the ceiling panel structure 10 is assembled to have a longitudinally or vertically (in the face of the drawing) elongated rectangular shape as shown by an imaginary line 10*a* in FIG. 1C. On the other hand, in a case where the air-conditioning apparatus is of a type 200*b* having a laterally or horizontally (in the face of the drawing) elongated rectangular outer shape as shown in FIG. 1F, the ceiling panel structure 10 is assembled to have a laterally or horizontally (in the face of the drawing) elongated rectangular shape as shown by an imaginary line 10*b* in FIG. 1C. Meanwhile, in a case where the air-conditioning apparatus is of a type 200*c* having a square shape as shown in FIG. 1D, the ceiling panel structure 10 is assembled to have the corresponding square shape as shown by solid lines in FIG. 1C, while a length of each side of the square may be increased or decreased as desired.

Each linear panel 11 of the ceiling panel structure 10 comprises, as shown in FIGS. 5A–5B, 6A–6B, and 7A–7B, a linear base member 20 made of plastic material (FIGS. 5A–5B and 6A–6B), and a linear cover member 40 made of plastic material and coupled to the linear base member 20 (FIGS. 5A–5B and 7A–7B). In the description of this embodiment hereafter, concrete sizes of various portions or parts are shown. However, these portions or parts are only desired examples, and the invention is not limited to the sizes, shapes, or the similar order of sizes or similar shapes.

As shown in FIGS. 6A and 6B, the linear base member 20 comprises a plate-like portion 21 having a width W1 of about 15 cm and a length L1 of about 200 cm. The plate portion 21 comprises a main plate portion 22 of about 3 mm in thickness D1, and a guide plate portion 26 of about 2 mm in thickness D2 and of about 9.5 cm in width W2. The guide plate portion 26 has a first principal face 24 which is coplanar with a first principal face 23 of the main plate portion 22, and extends integrally from a first end 25 of the main plate portion 22.

The guide plate portion 26 has, in the principal face 24, grooves 27 extending over the whole length in the longitudinal direction thereof at regular widthwise intervals of, for example, 1 cm. The interval or spacing may be greater or smaller than 1 cm, and may not be uniform or constant if desired. Therefore, a workman who mounts the ceiling panel structure 10 can adjust by himself at the mounting job site the width W2 of the guide plate portion 26 (and, accordingly, the width W1 of the base member 20) by producing, in and along a desired one of the grooves 27, a deeper cutting groove by a cutter knife or the like at the job site. A width, depth and cross-sectional shape are not limited so long as the guide plate portion 26 can be weakened for facilitating separation along the groove 27 as long as there is not a possibility that the guide plate portion 26 will not become separated or broken therealong during usual handling of the base member 20. In this embodiment, a groove 27*a* similar to the groove 27 is formed in a second principal face 28, of the plate portion 26 to facilitate separation. The edge part having groove 27*a* may be subjected to damages during transportation of the base member 20 before use or application of the member 20 onto the ceiling 200. The groove 27*a* may also be omitted.

The main plate portion 22 has a second principal face or surface 29 with an engagement projection 30 at the first end 25, and one end 57 (FIGS. 7A–7B) of the cover member 40 is fitted in projection 30. The engagement projection 30 comprises a resistive face part 31 rising (extending) from the principal face 28 serving as the guide face of the guide plate portion 26 so as to be substantially perpendicular thereto. A deflection guide face part 32 having a semi-cylindrical shape (semi-circular shape in cross-section) is connected continuously and smoothly with the resistive face portion 31. A recess 33 is formed in the projection 30 to receive therein the end 57 of the cover member 40 to be engaged therewith. An opening 33*a* of the recess 33 is narrowed for ensuring the engagement with the cover member 40. The resistive face part 31 and deflection guide face part 32 may have any other cross-sectional shape, such as a part of an ellipse, so long as the projection 30 in the form of a small protrusion can serve as a flow-resistant projection to act as a resistance against the conditioning airflow to decelerate the airflow. Similarly, a typical example of the vertically downward length (or height) of the resistive face part 31 from the principal face 28 may be about 5 mm–about 1 cm. However, the height may also be greater than 1 cm or smaller than 5 mm so long as the projection 30 can serve as the flow-resistant projection.

At the second widthwise end 34 of the main plate portion 22 (i.e. outer end 34 of the base member 20) the base member 20 has engaging projections 36,37 which protrude from the second principal face 28 to form a recess 35 therebetween extending in the longitudinal direction of the main plate portion 22, and the projections 36,37 serve as an engaging portion. The engaging projections 36,37 have, respectively, at inner faces of distal ends thereof (constituting respective parts of the inner face of the recess 35), engaging stops 36*a*,37*a* protruding within the recess 35 to allow an insertion (engagement) in a direction A1 while regulating an escape (disengagement) in a direction A2. The main plate portion 22 has a projection 38 at a widthwise central region of the second principal face 29 and projecting therefrom and extending along the longitudinal direction of portion 22. An engagement recess 39 is formed in the first (rear) face 23, and projections 87,88 of a corner base member 70 to be described later are engaged with the engagement recess. The projection 38 is produced upon formation of the recess 39, and may be omitted. As seen from FIG. 6B, the shape of the linear base member 20 in a cross-section perpendicular to the longitudinal direction thereof is all the same at any position along the length, which is also valid for the linear cover member 40 described later in detail.

Further, the main plate portion 22 has holes H for inserting therethrough screws for mounting. Although only one hole H is shown in FIG. 6A, the holes H may be formed at shorter intervals in the longitudinal direction of the main plate portion 22. The hole H may have a frusto-conically slanted circumferential wall to receive therein the head of the screw as illustrated in a modified panel structure of FIG. 14, or maybe formed in widthwise different positions of the main plate portion 22 unless engagement with the cover member 40 is adversely affected.

Figure 7A:
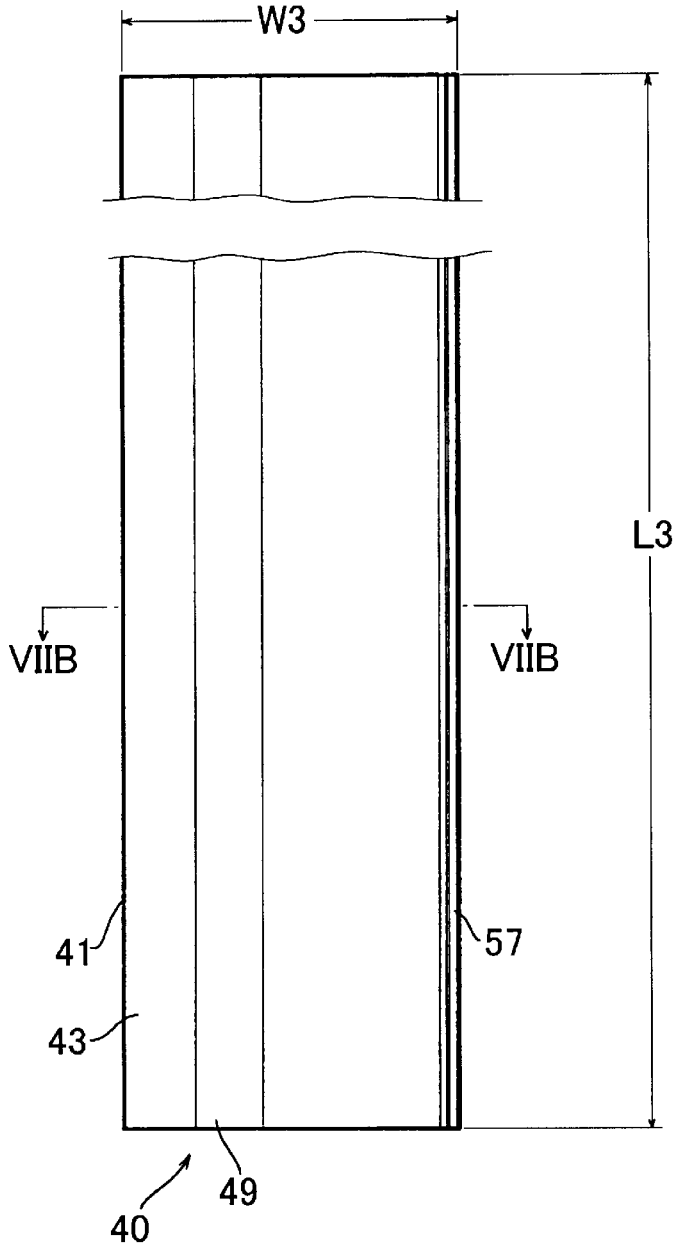
Figure 7B:
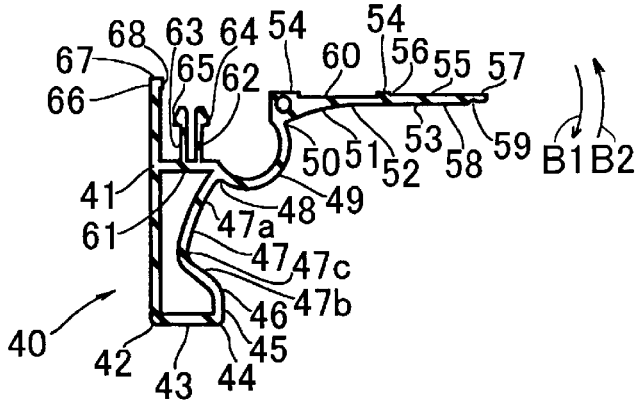
Figure 8A:
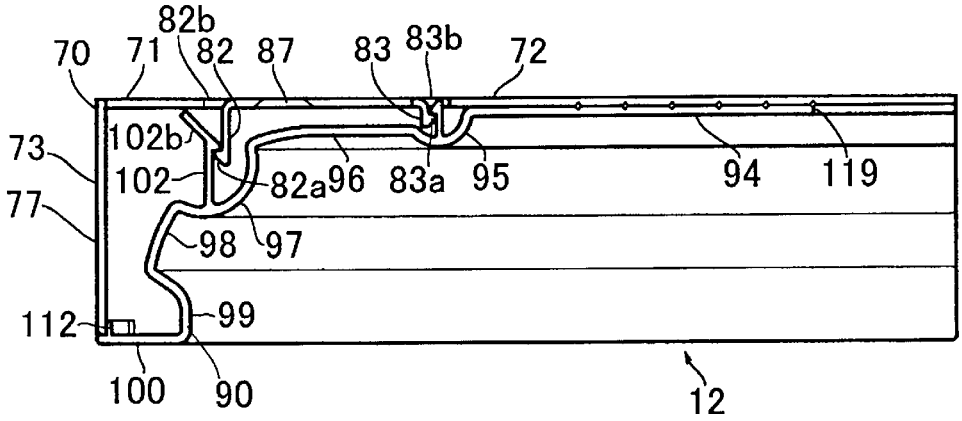
Figure 8B:
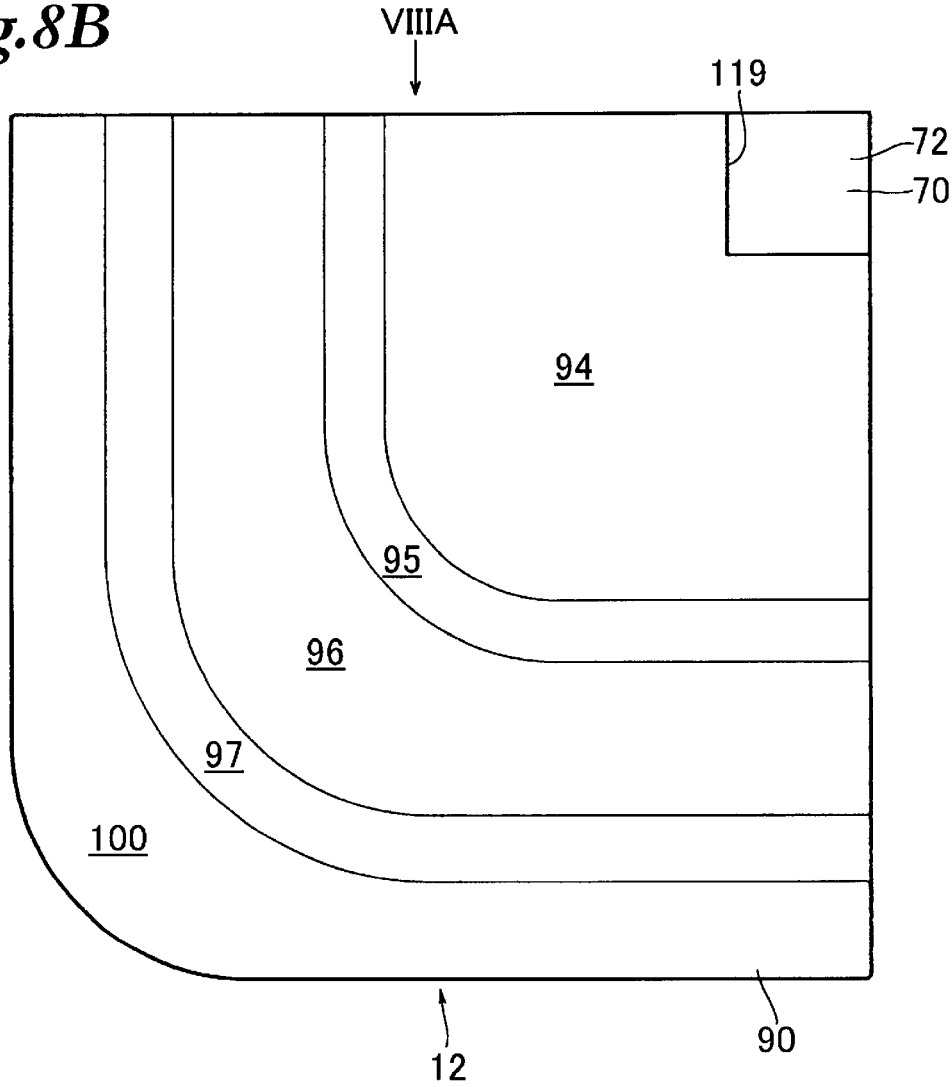

As shown in FIGS. 7A and 7B, the cover member 40 is made of an elongated plastic member having a width W3, which is about the same as the width of the main plate portion 22 of the base member 20, and having a length L3, which is about the same as that (L1) of the base member 20. The cover member 40 includes, as shown in FIG. 7B, a vertical end wall portion 41 extending vertically, a lower end guide portion 43 extending generally horizontally from a lower end 42 of the end wall portion 41, a short vertical wall portion 45 extending vertically from an inner end 44 of the lower guide portion 43 approximately perpendicularly thereto, a deflection guide portion 47 extending convexly downstream from an upper end 46 of the vertical wall portion 45 and serving as the deflection induction portion, a semi-cylindrical flow-resistant projection 49 extending integrally upstream from an upstream end 48 of the deflection guide portion 47 and being convex toward downward and upstream directions, an upstream-side arcuately curved guide portion 51 extending integrally upstream from an upstream end 50 of the flow-resistant projection 49 and being slightly upwardly convex, and an upstream-side horizontal guide portion 53 extending substantially horizontally from an upstream end 52 of the upstream-side arcuate guide portion 51. The deflection guide portion 47 comprises an upstream part 47*a* extending generally vertically to provide a flow-resistance, and a downstream part 47*b* for providing the flow-resistance and for changing the direction of the airflow to guide the airflow downwardly toward the center of the air-conditioning apparatus 200. The downstream part 47*b* is connected smoothly at an upper end 47*c* thereof with a lower end of the upstream part 47*a* and extends almost horizontally. The downstream part 47*b* is connected smoothly at a lower end thereof 46 with the vertical wall portion 45. A vertical height from the end 52 of the guide portion 53 to the lower end of the horizontal wall portion 43 is, for example, about 4–5 cm. However, the height may be greater (e.g., 10 cm or greater) or smaller (e.g. about 2–3 cm or smaller).

Rear face parts of regions near the downstream end 50 of the upstream-side arcuate guide portion 51 and near a downstream end 52 of an upstream-side horizontal guide portion 53 (i.e., upper face parts 54 shown in FIG. 7B) form a coplanar plane to closely contact the lower principal face 29 of the main plate portion 22 of the base member 20. Most of an upper face 55 of the upstream-side horizontal guide portion 53 is connected with the upper face 54 through a small step 56. Therefore, a part of the upstream-side horizontal guide portion 53 situated closer than the step 56 to the distal end can be bent easily in directions B1 and B2. An edge of the step 56 may be angled or arcuately curved. The upstream-side horizontal guide portion 53 is thinned at the distal end part 57, and a shallow recess 59 is formed in a part of the surface or lower face between a main part 58 of the upstream-side horizontal guide portion 53 and the distal end part 57.

Therefore, the thinned distal end part 57 can be inserted by force into the recess 33 of the projection 30 of the linear base member 20 (FIG. 6B) while expanding a narrowed opening 33*a* of the recess 33 of the projection 30 the thinned distal end part 57 in a state in which the distal end part 57 is situated more close to the distal end than the step 56 is being bent. After the insertion, the wall part 30*a* (FIG. 5B) around the opening 33*a* of the recess 33 fits in the recess 59 at the proximal end of the distal end part 57 and can hold the horizontal guide portion 53 including the distal end part 57 in a slightly bent state. The semi-cylindrical wall portion forming the flow-resistant projection 49 also serves as the widthwise bending portion upon insertion.

The upper face 54 has therein a wide recess 60, which is wider than the projection 38 on the surface 29 of the base member 20 and which extends over the whole length in the longitudinal direction. The recess 60 receives the projection 38 upon assembling or mounting the cover member 40 to the base member 20.

A horizontal reinforcing wall 61 is integrally formed between the downstream end 48 of the flow-resistant projection 49 (i.e., the upstream end 48 of the downstream-side arcuate guide portion 47) and the vertical end wall portion 41. Engaging projections 62,63 serving as the engaged portion extends integrally and upwards from an upper face of the horizontal wall 61. The engaged projections 62,63 (i.e., projections to be engaged) have at respectively distal ends thereof small engaged stop projections 64,65 (i.e., projections to stop disengagement) protruding in opposite directions from each other (i.e., protruding outwards relative to each other). Upper ends of the engaged stops 64,65 of the engaged projections 62,63 are situated slightly below the face 54.

The vertical end wall portion 41 protrudes more upward than the plane of face 54 just by the thickness D1 of the main plate portion 22 of the base member 20. When the cover member 40 is mounted on the base member 20, an end face 67 of an upper end 66 of the vertical wall portion 41 is substantially flush with the upper faces 23,24 of the base member 20. The vertical wall portion 41 is slightly thickened at the upper distal end 66 thereof so that an inner face 68 of the end 66 is pressed against the end face 21*a* of the plate portion 21 of the base member 20.

Therefore, when the linear panel 11 is prepared and mounted, the base member 20 is first prepared to have a predetermined width W1*x* and a predetermined length L1 appropriated for the mounted site or position. The predetermined width is, herein, typically as wide as possible. The widest possible width enables the conditioning air having been blown out through the air-conditioning apparatus 200 and flowing along the ceiling surface 201 to be minimized.

Figure 2:
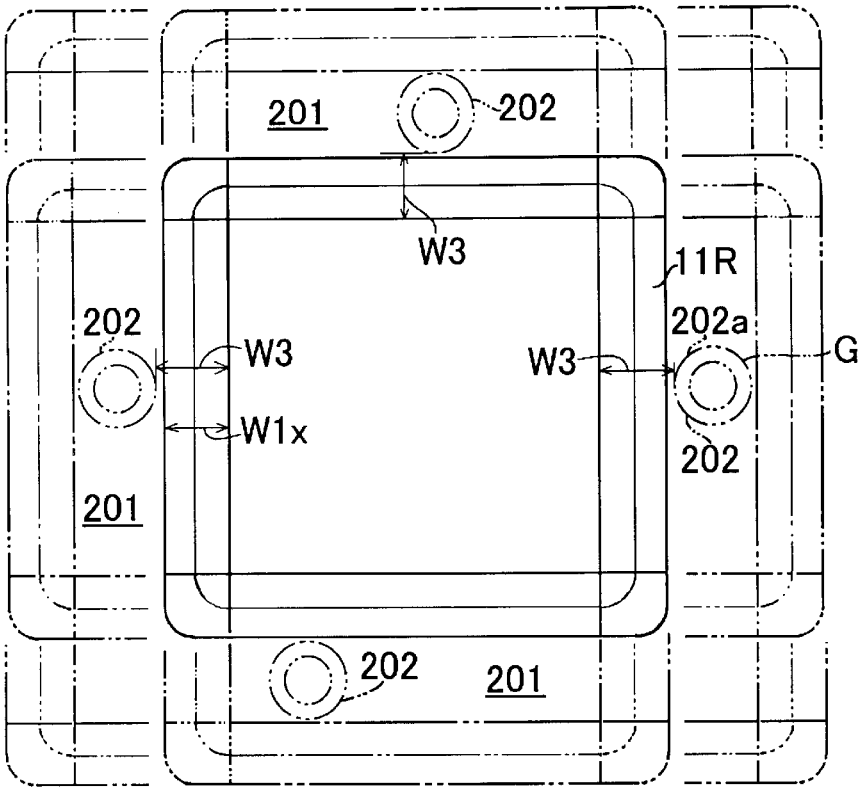
FIG. 2 is an explanatory bottom view of the ceiling panel structure, where the shape and/or the size thereof is changed according to the presence of an obstacle on the ceiling.

However, as shown by imaginary lines 202 in FIG. 2, there may be a pre-mounted obstacle 202 already mounted in the ceiling surface 201, such as a smoke sensor, an electric wiring connector and a downward illuminating light, at a region of the ceiling surface 202 relatively close to the site or area where the air-conditioning apparatus 200 is mounted. Such being the case, the width W1*x* of the base member 20 is adjusted to avoid the obstacle 202 or to fit to the width W3 between the obstacle 202 and the air-conditioning apparatus 200. Typically, the width W1*x* is approximately the same as the width W3 (W1*x* being nearly equal to W3) but is smaller than W3 (W1*x*<W3). As a matter of fact, there is substantially no possibility that the obstacle 202 is mounted in the ceiling surface 201 without a substantial amount of space to the air-conditioning apparatus 200 because of various requirements, such as the strength of the ceiling surface 201, the mounting structure and convenience of mounting each of the various obstacles 202, and the function and conveniences of maintenance work of each of the obstacles 202. Therefore, a width W10 (FIG. 6A) between the outer end face 21*a* of the main plate portion 22 of the base member 20 and the outermost groove 27*b* of the grooves 27 in the guide plate portion 26 is preset to a minimum possible length considering the above-mentioned situations. Four obstacles 202 are shown in FIG. 2, which is, however, exceptional. Normally, there will be at most one or two regions where obstacles are found.

When the width W1 of the base member 20 is decreased, a cut-in groove is formed in and along an appropriate one of the grooves 27 situated at a position providing the width W1 of not greater than a width W3 but as wide as possible, to be bent therealong for separation. When the widthwise inner edge of the guide plate portion 26 is inserted between the ceiling surface 201 and the outer frame or smoothly planed board portion of the air-conditioning apparatus 200, the width W1 of the base member 20 is selected to be wider by the inserted length.

Meanwhile, considering use of the corner panel structure 12 to be described later in detail, the base member 20 and the cover member 40 are cut to a predetermined length by means of saw or the like. When the dimensions or sizes of the air-conditioning apparatus 200 are relatively standardized, plural kinds of members 20,40 of plural lengths may be prepared, and may be cut only when exceptional.

Upon mounting the linear panel 11, the linear base member 20 is first supported at a desired position to be attached to the ceiling 201 by the screws inserted in the screw holes H. The linear base member 20 is thin and light in weight, and can be temporarily fixed to the ceiling surface 201 by only at least two screws. Therefore, the linear base member 20 need not be supported or held by a workman during the screwing operation of the third or further screw, which can be accomplished easily by the workman even when the workman is forced to have an unnatural posture toward the ceiling surface 201. In particular, when the widthwise inner edge of the guide plate portion 26 of the linear base member 20 is inserted between the ceiling surface 201 and the outer frame of the air-conditioning apparatus 200, the member 20 can be provisionally fixed even by a single screw.

Then, the thin walled distal end part 57 of the upstream-side horizontal guide portion 53 of the cover member 40 is inserted into the recess 33 of the projection 30 of the base member 20, and the engaging projections 62,63 of the cover member 40 are inserted, with the stop parts 64,65 at the distal end thereof, into the engaging recess 35 of the base member 20, while the thin walled distal end part 57 is further inserted into depth of the recess 33. Upon the first insertion of the horizontal distal end part 57, the upstream-side horizontal guide plate portion 53 and the flow-resistant projection 49 are bent to be upwardly convex. The downwardly convex curvature of the flow-resistant projection 49 of the cover member 40 facilitates the bending deformation in the direction B1. The engagement and insertion are completed when the distal end part 57 of the upstream-side horizontal guide portion 53 abuts the bottom of the recess 33, when the distal end of the wall portion 30*a* of the projection 30 is engaged in the recess 59 in the lower face of the distal end part 57 of the cover member 40, when the upper faces 54,54 at both sides of the upper end opening of the recess 60 abut against the second principal face 29 of the main plate portion 22 of the base member 20, when the engaging stop projections 64,65 at the distal ends of the engaging projections 62,63 are fitted into the engaging recess 35 through the engaging projections 36*a*,37*a* at the lower end opening of the recess 35, and finally when the inner face 68 of the upper end 66 of the vertical end wall portion 41 abuts against the end face 21*a* of the base member 20.

Each corner panel 12 of the ceiling panel structure 10 comprises, as shown in FIGS. 8A–8B, 9A–9D and 10A–10B, a corner base member 70 (FIGS. 8A–8B and 9A–9D) formed of plastic material, and a corner cover member 90 (FIGS. 8A–8B and 10A–10B) of plastic material coupled to the corner base member 70.

The corner base member 70 comprises a generally square and horizontal top plate-like portion or top plate portion 72 to closely contact the ceiling surface 201 at an outer principal face 71 upon mounting. A vertical side wall portion 73 extends downwards from the horizontal top plate portion 72 perpendicular thereto. The corner base member 70 has a mirror symmetrical shape about a virtual plane which includes the diagonal line D of the top plate portion 72 and extends perpendicularly thereto. The vertical side plate portion 73 has linear or plate-like side wall portions 77,78 extending along two sides 75,76 at both sides of an arcuately curved corner 74 of the horizontal top plate portion 72, and an arcuate corner side wall part 79 along the arcuate corner 74 between the plate-like side wall portions 77,78. Ends 77*c*,78*c* of the side wall portions 77,78 protrude from associated sides or edges 80,81 of the horizontal plate portion 72.

The top horizontal plate portion 72 has, as shown FIGS. 9A–9D, engaging wall portions 82,83 and 84,85 having a width W5 extending downwards from respective edges 80 and 81 and serving as the engaging portions. The wall portions 82,83 and 84,85 have, at respective outer sides thereof, projecting engaging stop parts, i.e., projections for stopping, 82*a*,83*a* and 84*a*,85*a*. The plate portion 72 also has slits or grooves 82*b*,83*b* and 84*b*,85*b* for facilitating bending of the wall portions 82,83 and 84,85 while avoiding concentration of the stresses to the proximal ends thereof, and for allowing the insertion of engaged portions (to be described later) of the cover member 90. Slits 82*c*,83*c* and 84*c*,85*c* are connected to the slits 82*b*,83*b* and 84*b*,85*b* so that the wall portions 82,83 and 84,85 can be bent uniformly over the whole width. Reference numeral 86 denotes an elongated hole for insertion of the screw.

In addition, the horizontal plate portion 72 has thin protrusion strip parts 87,88 of a width Wb protruding respectively from the edges 80,81. The protrusion strip parts 87,88 have a cross-sectional shape (a trapezoidal end face being shown in FIG. 9A) substantially identical to that of the recess 39 of the linear base member 20 to be inserted thereinto and engaged therewith to assist in firmly coupling the corner base member 70 and the associated linear base members 20 upon assembling the ceiling panel structure 10.

The horizontal plate portion 72 has grooves 89, similar to the grooves 27 of the linear base member 20 but in the form of a lattice, in a lower principal face (surface) 72*a* thereof near a corner portion where the edges 80,81 are crossed. Within the group of grooves 89, a group of grooves 89*a*, extending vertically in FIG. 9C, serve as the weakened parts where a width or size or mounting position in the lateral or horizontal direction in FIG. 9C is adjusted, while a group of grooves 89*b*, extending horizontally in FIG. 9C, serve as the weakened parts where a width or size or mounting position in the vertical direction in FIG. 9C is adjusted.

The corner cover member 90 is engaged with and fixed to the corner base member 70 to provide a surface configuration or shape having flow-guide, flow-resistant and deflection functions similar to the linear cover member 40 with respect to the conditioning airflow.

Figure 10A:
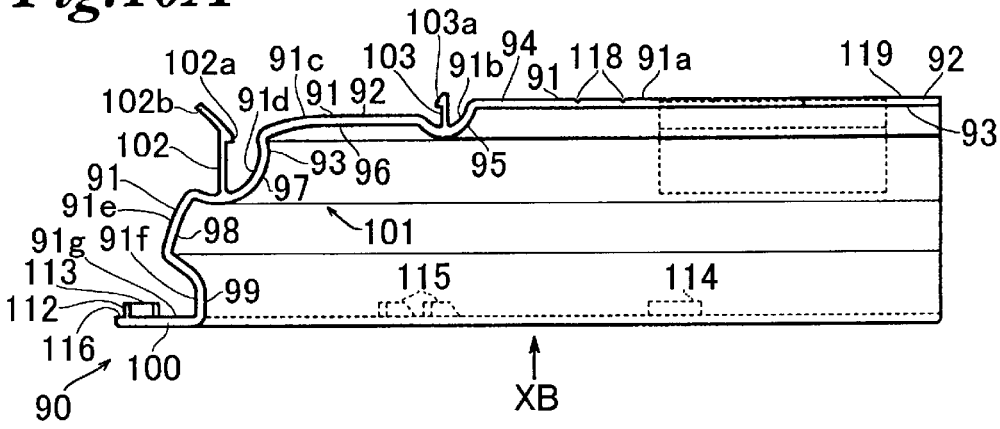
Figure 10B:
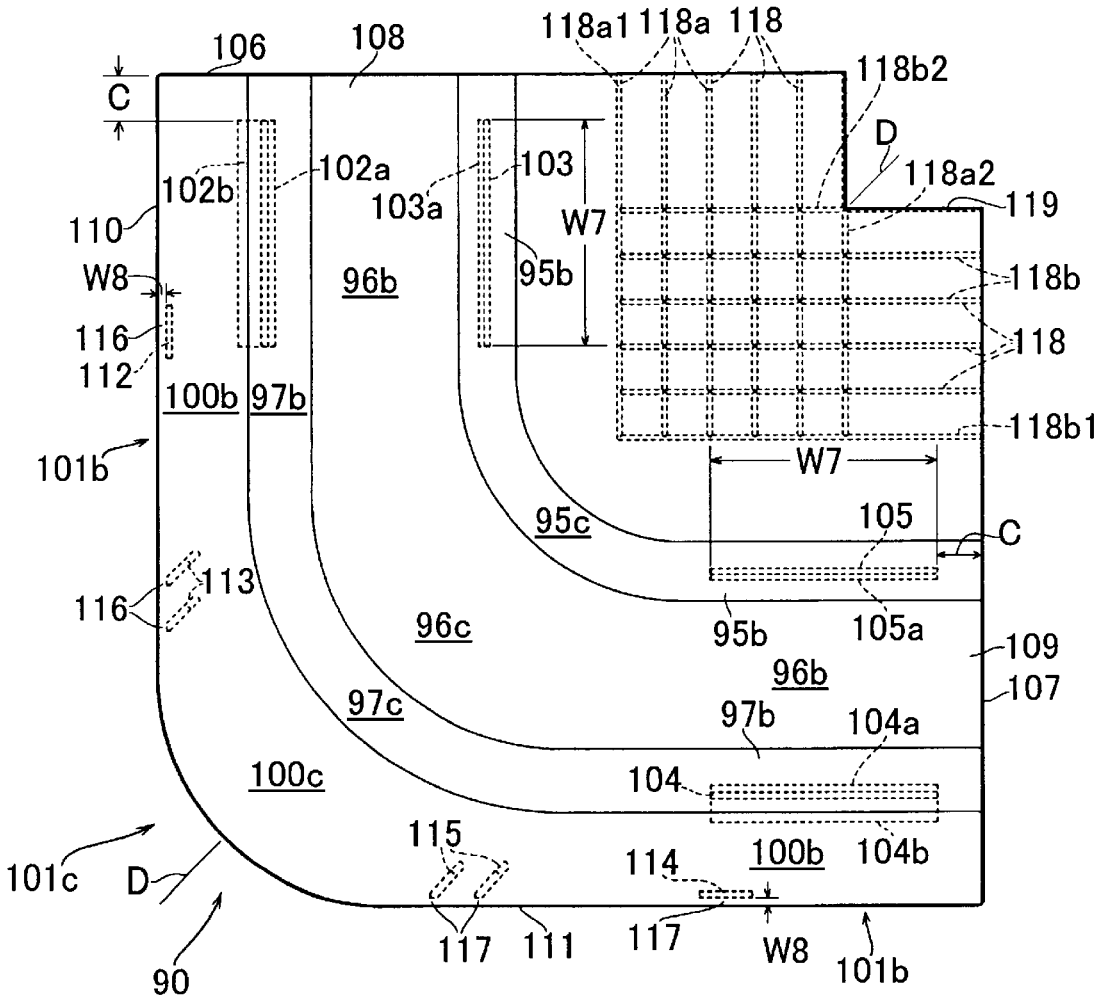

In addition, the corner cover member 90 of this embodiment has an upper surface 91 having a configuration substantially the same as or complementary with that of the lower surface of the linear panel 11 in the side view or side section as in FIG. 10A so that the corner cover member 90 can be laid on the end portion of the linear panel 11 from the lower side to cover the end portion thereof. A wall 92 of the corner cover member 90 typically has a substantially uniform thickness of, for example, about 2–3 mm. Therefore, a lower surface 93 of the wall has approximately the same configuration or shape as that of the surface of the linear panel 11 and has substantially similar flow-resistant, deflection and guide functions.

The corner cover member 90 comprises a flat plate portion 94 having a flat surface part 91*a* superposed on the lower surface 72*a* of the top plate portion 72 of the corner base member 70, a downwardly convex upstream flow-resistant projection 95 having a concave surface part 91*b* superposed on the surface of the flow-resistant projection 30 of the linear base member 20, an upstream arcuate guide portion 96 having an arcuate surface part 91*c* superposed closely on the surface of the upstream arcuate guide portion 51 of the linear cover member 40, a downwardly convex intermediate flow-resistant projection 97 having a concave surface part 91*d* superposed closely on the surface of the flow-resistant projection 49 of the linear cover member 40, a deflection induction portion 98 serving as the concave deflection induction portion and having convexly arcuate surface part 91*e* superposed closely on the surface of the deflection induction portion 47 of the linear cover member 40, a vertical wall portion 99 having a vertical face part 91*f* superposed closely on the vertical face of the vertical wall portion 45 of the linear cover member 40, and a lower end guide portion 100 having a horizontal face part 91*g* superposed closely on the lower horizontal surface of the horizontal lower end guide portion 43 of the linear cover member 40.

The corner cover member 90 has, similar to the corner base member 70, a mirror-symmetrical shape about a virtual vertical plane passing through the virtual diagonal line D. Therefore, a flow-resistant, deflection-guide and flow-guide portion 101 including the wall portions 95,96,97,98,99,100, as seen from plan view of FIG. 10B, comprises two linear flow-resistant, deflection-guide and flow-guide portions 101*b*,101*b* along two sides extending in directions 90 degrees offset from each other, each of the portions 101*b* being formed of linear portions 95*b*,96*b*,97*b*,98*b* (not shown), 99*b* (not shown) and 100*b*, and an arcuate flow-resistant, deflection-guide and flow-guide portion 101*c* constituted by circular arc portions 95*c*,96*c*,97*c*,98*c* (not shown), 99*c* (not shown) and 100*c* extending over 90 degrees to connect smoothly the two linear portions 101*b*, 101*b* at a corner portion. The arc may be a part of an ellipse or the like instead of a part of the circle.

The corner cover member 90 includes four engaging projections 102,103 and 104,105 having respectively engaging stop parts 102*a*,103*a* and 104*a*,105*a* to be engaged and stopped by the engaging stop parts 82*a*,83*a* and 84*a*,85*a* of the engaging projections 82,83 and 84,85 of the corner base member 70. The engaged stop parts 102*a* and 104*a* have respectively elongated opposite protrusions 102*b* and 104*b* for guiding positioning or registration of the corner cover member 90 upon engagement. The engaged projections 102,103 extend from a position inwardly away from the edge 106 by a distance C parallel to the linear flow-resistant guide part 101*b* over a region of a width W7 (=W5). Similarly, the engaged projections 104,105 extend from a position inwardly away from the edge 107 by the distance C parallel to another linear flow-resistant guide part 101*b* over a region of the width W7 (=W5). Parts 108,109 of the corner cover member 90 situated within the distance or width C respectively from the edges 106,107 is superposed on the surfaces near the adjacent longitudinal ends or edges of the linear panels 11 to hide the longitudinal edges thereof.

In addition, the corner cover member 90 has four engaged stop projections 112, 113 and 114,115 serving as the engaged portion at positions respectively inside of the edges 110 and 111 of the horizontal bottom wall portion 100 by a distance or width W8. In the illustrated embodiment, there are two projections 113,115. The engaged stop projections 112–115 abut against inner faces 77*b* and 78*b* of the side walls 77 and 78, when surface parts 116 and 117 of the horizontal bottom wall portions 100 outside the projections 112,113 and 114, 115 abut against lower end faces 77*a* and 78*a* of the side walls 77 and 78 of the corner base member 70, thereby positioning and fixing the corner cover member 90 to the corner base member 70 cooperatively with the above-mentioned engaged projections 102,103 and 104,105.

The corner cover member 90 has, in a rear face (upper face) 91*a* of the horizontal plate portion 94, grooves 118 in the form of a lattice similar to the grooves 89 of the corner base member 70 and at the same intervals (pitch) as that of the grooves 89. In the illustrated embodiment, a corner is cut out in the form of a square cut-out portion 119, defined by a vertically extending groove 118*a* and a laterally or horizontally extending groove 118*b* in FIG. 10B, in which the corner of the air-conditioning apparatus 200 can just fit.

Figure 11:
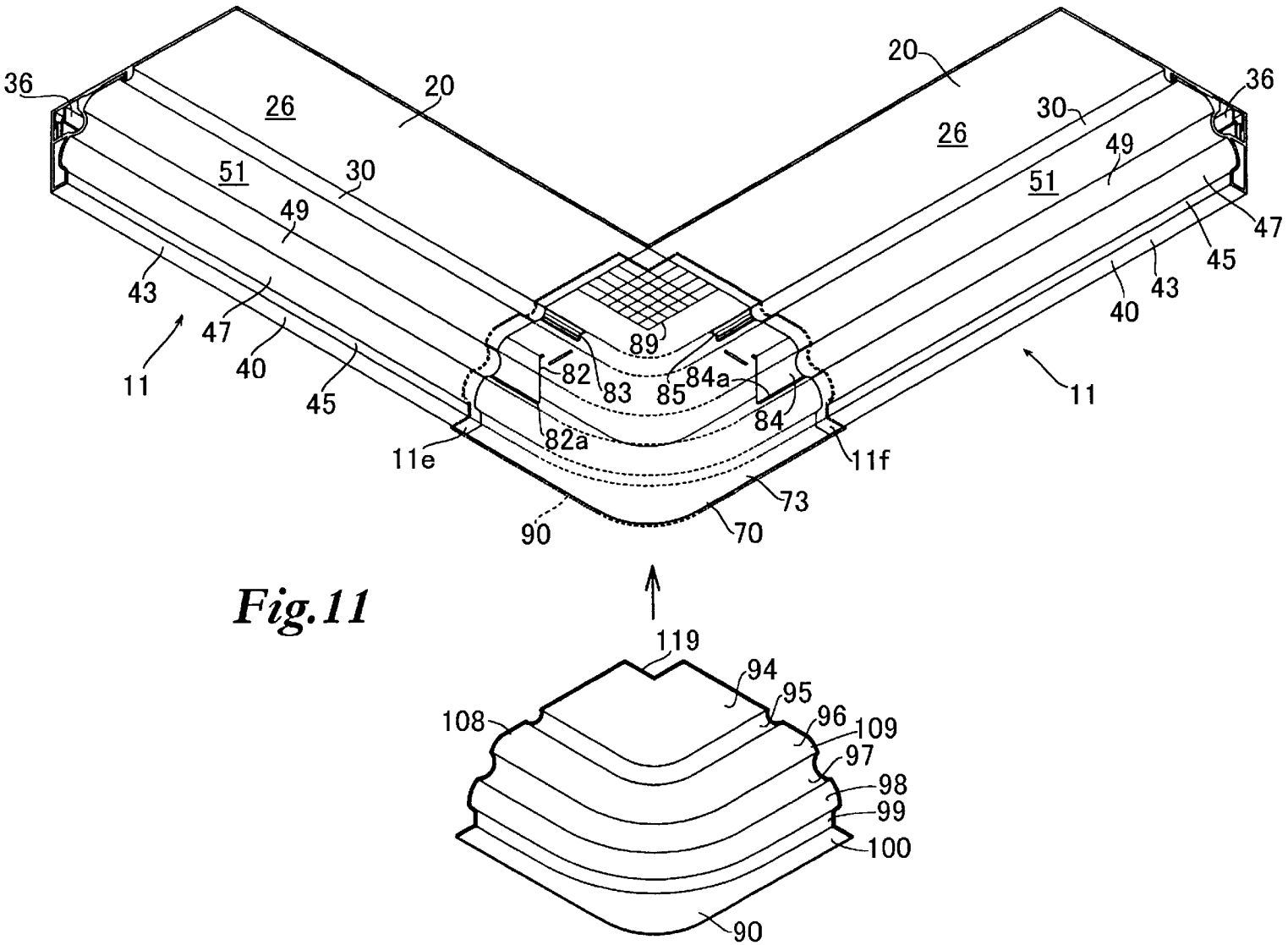
FIG. 11 is an explanatory oblique view, as viewed from an obliquely lower position, for illustrating a mounting process of the corner cover member to complete the ceiling panel structure of FIG. 4.

Before mounting the corner cover member 90, each of the corner base members 70 is mounted between the adjacent linear base members 20 and the ceiling surface 201 in a state where the adjacent projections 87, 88 of the corner base member 70 fit in the recesses 39 of the adjacent linear base members 20 (actually and typically, the corner base member 70 is mounted on the ceiling surface 201 prior to the mounting of the linear base member 20 to the ceiling surface 201), and the linear cover members 40 are mounted to the linear base members 20 to form the linear panels 11. Upon mounting the corner cover member 90, as shown in FIG. 11, the corner cover member 90 is mounted to the corner base member 70 so that the edge portions 108,109 cover the adjacent ends 11*e*,11*f* of the linear panel structures 11,11, whereupon the corner cover member 90 is directed, to be fitted, from an inside of the corner to an outside thereof. Thus, the elongated inclined protrusions 102*b*,104*b* of the engaged projections 102,104 of the corner cover member 90 slide along the inclined lower end faces of the engaging stop projections 82*a*,84*a* of the engaging projections 82,84 of the corner base member 70 to be fitted in the outsides thereof. As a result, the stop engagements between the engaged stop parts 102*a*–105*a* of the engaged portions 102–105 of the corner cover member 90 and the associated engaging stops 82*a*–85*a* of the engaging projections 82–85 of the corner base member 70 have been established. At the same time, the surface parts 116,117 near ends of the horizontal wall portion 100 of the corner cover member 90 and the engaged stop projections 112–115 thereof abut respectively against the lower end faces 77*a*,78*a* of the side wall portions 77,78 of the corner base member 40 and the inner faces 77*b*,78*b* thereof, thereby positioning and fixing the corner cover member 90 to the corner base member 70 to complete the mounting thereof.

Now, the overall mounting operation of the ceiling panel structure 10 thus constructed on the ceiling surface 10 is to be explained.

At first, the ceiling surface 201 is examined to determine whether or not any obstacles are present on the ceiling surface 201 around the air-conditioning apparatus 200.

We now assume a case where, as shown in FIG. 4A, there is an obstacle 202*a* at a position corresponding to the position G in FIG. 2. A width W1*x* of a linear base member 20R constituting a linear panel structure 11R to be positioned along the right side in FIG. 4A (hereafter, reference character "R" is attached at the end of reference numerals to denote that the associated member or element is positioned on the right side)is adjusted depending on the distance W3 between the obstacle 202*a* and the adjacent side edge of the air-conditioning apparatus 200 so that the width W1*x* is not greater than W3 (FIGS. 4A–B). After the adjustment, the linear base member 20R is cut along an appropriately positioned groove among the multiple grooves 27 in the plate portion 26R thereof. The cutting operation is carried out with ease by cutting in and along the appropriate groove 27 by means of a cutter, knife or the like, and by bending the member 20R along the cut-in line. In the illustrated embodiment, the obstacle 202*a* is situated at a position extremely close to the air-conditioning apparatus 200 as shown in FIGS. 4A–B, and therefore the linear base member 20R is cut along the innermost groove 27*b* (FIGS. 6A–B) so that the width thereof is minimized. We now assume that there is not any other obstacle on the ceiling surface 201 around the air-conditioning apparatus 200. Meanwhile, in a case where there are other obstacles on other sides, the widths of the linear panels 11 to be mounted on the associated sides should be adjusted depending on the positions of the obstacles.

Then, the workman adjusts the obstacle positions of the cut-outs in the inside corners of the corner panel structures 12RU,12RD (situated respectively upper and lower positions on the right side in FIG. 4A, where subscripts "U" and "L" are respectively added to the end of the associated reference numerals or characters thereof) adjacent to ends of the linear panel structure 11R. A corner base member 70RU (not shown) of the right and upper corner panel structure 12RU is cut along the innermost groove 89*a*1 among the grooves 89*a* and along the outermost groove 89*b*2 among the grooves 89*b* in FIG. 9C. A corner cover member 90RU of the upper right corner panel structure 12RU is also cut along the innermost groove 118*a*1 among the grooves 118*a* and along the outermost groove 118*b*2 among the grooves 118*b* in FIG. 10B. On the other hand, a corner base member 70RD (not shown) of the right and lower corner panel structure 12RD is cut along the outermost groove 89*a*2 among the grooves 89*a* and along the innermost groove 89*b*1 among the grooves 89*b* in FIG. 9C. A corner cover member 90RD of the lower right corner panel structure 12RD is similarly cut along the outermost groove 118*a*2 among the grooves 118*a* and along the innermost groove 118*b*1 among the grooves 118*b* in FIG. 10B. Thus, the width of the corner panel 12 at the cut-out portion thereof becomes equal to the associated width of the adjacent linear panel 11, and the freshly formed cut-out portion just fits around the corresponding corner of the air-conditioning apparatus 200.

Then, the lengths of the linear panel structures 11U,11D, 11L, 11R situated respectively on upper, lower, left and right sides of the air-conditioning apparatus 200 when viewed in FIG. 4A are adjusted or cut according to the lengths of the adjacent sides of the air-conditioning apparatus 200. After the cutting, the length of each linear panel 11 is adjusted to be shorter than the adjacent side of the air-conditioning apparatus 200 by a protrusion or superposition length of the corner base member 70 of the corner panel 12 adjacent to either associated end of the linear panel structure 11. Actually, the corner base members 70 are mounted in accordance with four corners of the air-conditioning apparatus 200 beforehand. And then, the linear base member 20 is positioned with respect to two adjacent corner members 70,70 so that one end thereof abuts against an associated end or edge of a first one of the two corner base members 70 and is marked at a longitudinal position thereof which corresponds to the position of an adjacent end of the adjacent second corner base member 70 so that the marked position should be the other end of the linear base member 20, thereby enabling a determination of the length of the linear base member 20 and linear panel 11 without measuring the lengths thereof. The length-adjustment of the linear panel 11 is carried out for example by provisionally assembling the linear base and cover members 20,40 of each side into the form of the linear panel 11 and then by cutting the assembly by using a saw or the like. As a matter of course, the linear base member 20 and the linear cover member 40 may be cut independently or separately if desired. The length-adjustment of the linear panel 11 may be carried out before the adjustment of cut-in positions of the corner panels 12 or two kinds of adjustment may be carried out in mixed order.

Then, each of the four corner base members 70 is fixed to the ceiling surface 201 by screws or the like through the elongated screw holes 86,86 at a position where the cut-out portion thereof just matches or fits around the associated corner of the air-conditioning apparatus 200. The screw holes 86 of the corner base member 70 are elongated, so that screwing positions can be selected, within the length of the elongated hole 86 for appropriate attachment while avoiding inappropriate regions of the ceiling surface 201, if any. In addition, because the holes 86,86 of each corner base member 70 are elongated holes extending perpendicular to each other, the direction of the corner base member 70 can be finely adjusted before tightly fastening the screws. As a matter of course, any other securing or fastening or fixing device can be used for fixing the corner base member 70, if desired.

Then, each of the four linear base members 20 is pressed against the ceiling surface 201 so that either end of the linear base member 20 generally abuts the associated side or end face 80 or 81 of each of the adjacent corner base members 70,70 and so that a part of the recess 39 near either end thereof fits around the protrusion 87 or 88 of the adjacent corner base member 70. Therefore, each linear base member 20 is provisionally fixed to the corner base member 70. The linear base members can then be fixed to the ceiling surface 201 by the screws through the screw holes H.

Figure 12:
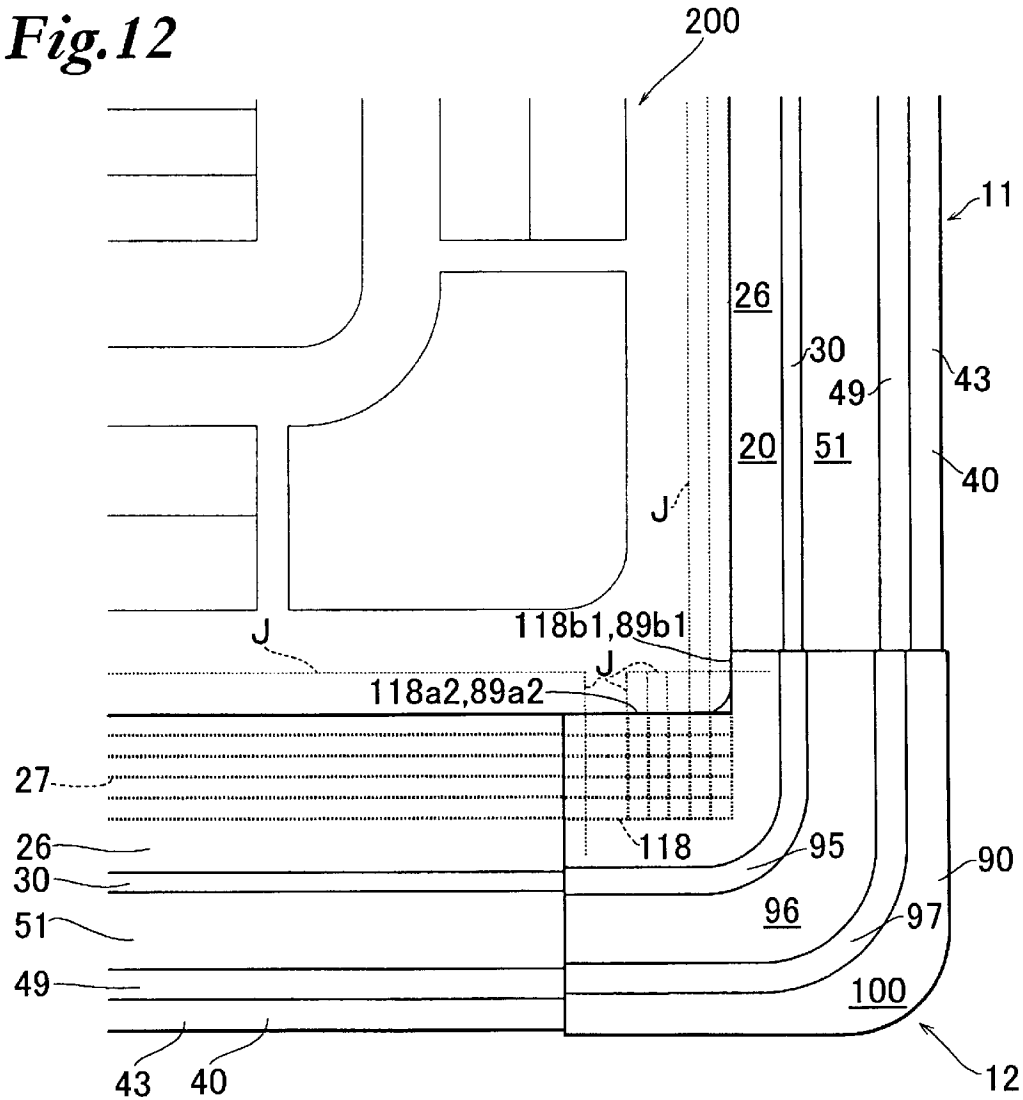
FIG. 12 is an explanatory bottom view illustrating a state where the corner cover member of FIG. 11 has been mounted.

The thin walled inner ends of the base members 70,20 may be inserted, if possible, between the outer frame of the air-conditioning apparatus 200 and the ceiling surface 201. This is exemplified by an illustration shown by dotted lines in FIG. 12. When the thin inner ends J of the base members 70,20 are thus inserted between the outer frame of the air-conditioning apparatus 200 and the ceiling surface 201, the air-conditioning apparatus 200 may be pulled down slightly from the ceiling surface 201, if necessary, to provide a gap between the outer frame of the air-conditioning apparatus 200 and the ceiling surface 201 so as to allow the insertion of the inner ends J thereinto. As a matter of course, the width W1*x* of the linear base member 20 is adjusted to be wider by a length or width of insertion of the inner ends J (in other words, the width of the space where the linear base member 20 is placed can be smaller than the width W1*x* of the linear base member 20 by the insertion length or width). The groove 118 of the corner base member 70 to be cut therealong is also selected considering insertion lengths at both sides of the corner portion according to the estimated insertion width of the linear base member 20.

Then, four linear cover members 40 are engaged respectively with the associated linear base members 20 to be fixed thereto in the above-mentioned procedures or steps.

Lastly, four corner cover members 90 are engaged respectively with the associated corner base members 70 to be fixed thereto in such a manner that they cover the associated corner base members 70 and the adjacent ends of the linear cover members 40,40, thereby completing the mounting or assembling of the ceiling panel structure 10 in accordance with the positions of any obstacles around the air-conditioning apparatus 200 as shown in FIGS. 4A–B. An example of the mounted state of the ceiling panel structure 10 is shown in an oblique view of FIG. 3, where the air-conditioning apparatus 200 is not shown.

As described above, the ceiling panel structure 10 can be mounted with ease only by adjusting, at the site of mounting, the widths and lengths of the linear panels 11 and the widths of the corner panels 12 at the cut-out portions thereof according to the sizes of the air-conditioning apparatus 200 and the distribution of the obstacle(s) on or in the ceiling surface 201. The relatively small size of corner base members 70 can be fixed with ease to the predetermined positions by screws or the like even by a single workman, because the associated corners of the air-conditioning apparatus 200 can be used as positioning guides for mounting the corner base members 70. The linear base members 20 can also be positioned and fixed by screws, for example, to the ceiling surface 201 with ease even by a single workman, because each of the linear base members 20 can be provisionally fixed substantially to the corner base members 70,70 at both ends thereof by the engagement of the recess 39 with the associated protrusion strips 87,88. If desired, a double-faced adhesive tape or the like may be put on the rear face of the linear base member 20 upon the provisional fixing of the linear base member 20 to ensure the provisional fixation thereof. In addition, the mounting of the linear cover members 40 can also be made with ease even by a single workman, because the mounting of the linear cover members 40 can actually be completed only by engaging them with the associated linear base members 20 to be fixed thereto. Furthermore, the mounting of the corner cover members 90 can also be made with ease even by a single workman, because the mounting of the corner cover members 90 can be completed only by engaging the corner cover members 90 with the associated corner base members 70 to be fixed thereto. In addition, the above-mentioned width- and/or length-adjustment can be also made with ease even with the saw and cutter knife and even by a single workman.

Figure 13:
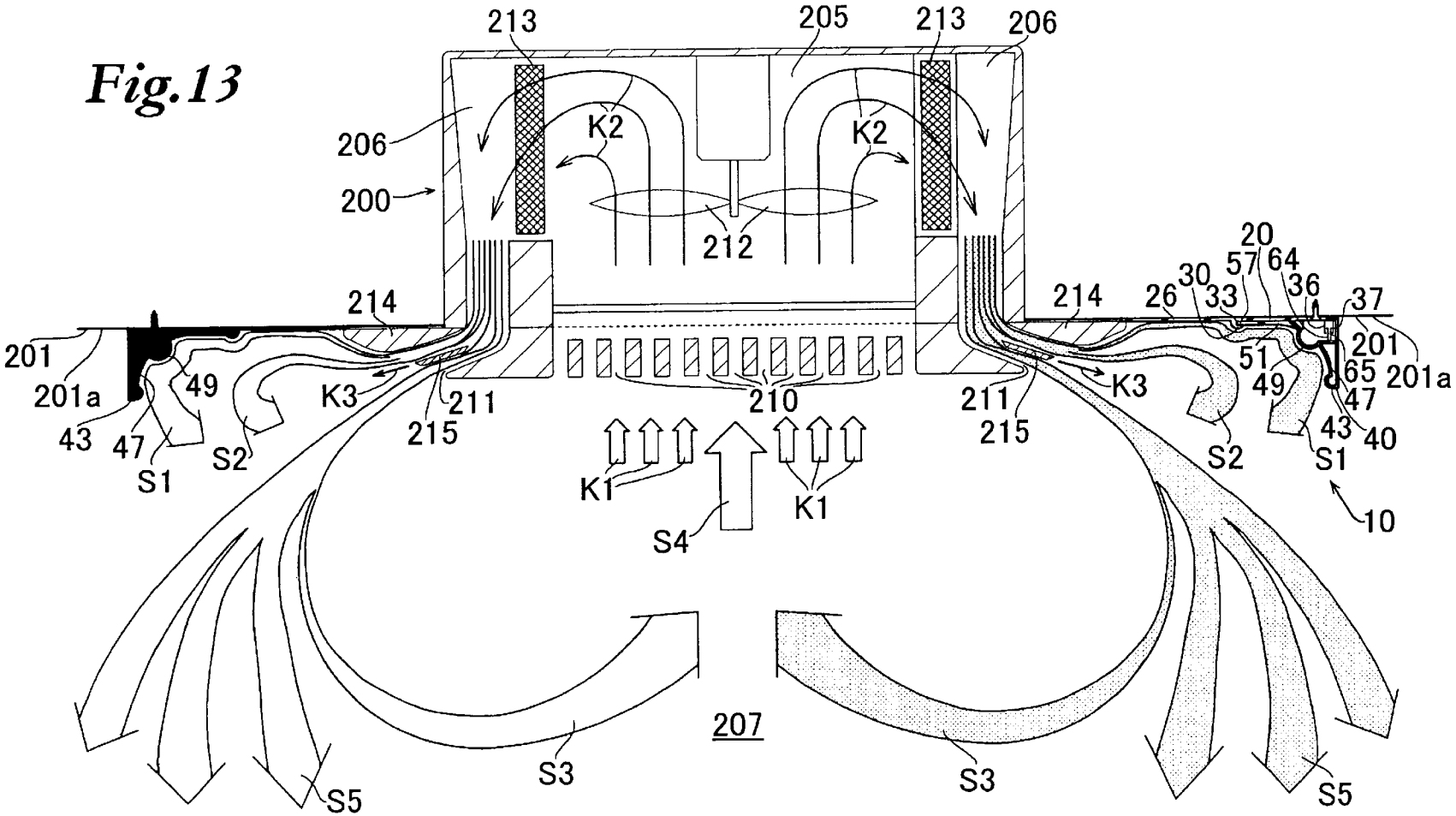
FIG. 13 is a diagrammatic sectional view illustrating a state of flow of conditioning air adjusted by a ceiling panel structure according to one preferred embodiment of the invention.

Now, the function of the ceiling panel structure 10 upon the operation of the air-conditioning apparatus is described referring to FIGS. 13 and 4A–B.

As shown in FIGS. 4A–B, the air-conditioning apparatus 200 having a generally rectangular (square) shape along the ceiling surface 201 has a room-air-inlet 210 at the center of the rectangle and conditioning-air-outlets 211 in the vicinity of four sides or four side edges thereof. Thus, as shown in FIG. 13, the air-conditioning apparatus 200 sucks or intakes the air in a room 207 in a direction K1 from the central room-air-inlet 210 by means of a motor-driven fan 212 disposed in a central conduit or passage 205, directs the air in a direction K2 toward a generally tubular indoor heat exchanger 213 disposed between the central conduit 205 and an outer blow-out passage or conduit 206, heats or warms (in case of a heating-adjustment) or cools (in case of a cooling-adjustment) the room air by a heat medium flowing through the heat transmission pipes of the heat exchanger 213 when the directed air passes through spaces between the heat transmission pipes and/or heat transmission fins of the heat exchanger 213. Thereafter, the air is blown out in a direction K3 generally parallel with the ceiling surface 201 and slightly downwards through the conditioning air-outlet 211 after having adjusted the direction of the airflow by desired shapes of smoothly planed board or circumferential or side wall 214 and a wind or airflow direction adjustment plate 215 at the conditioning air-outlet 211 at a downstream end of the blow-out passage 206. Filters are disposed at positions such as an inlet of the airflow flowing into the heat exchanger 213 to pass therethrough, for removing contaminants (such as very fine particles) in the room air considerably.

The uppermost layer of the conditioning airflow having been blown out through the conditioning air-outlet 211 in an outward and slightly downward direction K3 flows generally parallel to the ceiling surface 201 along the guide plate portion 26 of the linear base member 20 of the linear panels 11 of the ceiling panel structure 10. The airflow then blows against the flow-resistant projection 30 of the linear base member 20, and the wind pressure thereof is reduced to decrease the flow rate thereof, while spreading generally over the surface of the projection 30. The airflow that flows over the flow-resistant projection 30 then flows along the guide portion 51 (with the slightly downwardly curved guide surface) of the linear cover member 40 of each linear panel 11, and thereafter blows against the flow-resistant projection 49, so that the wind pressure thereof is significantly reduced to decrease the flow rate thereof. The conditioning airflow that flows over the flow-resistant projection 49 while spreading gradually due to the deceleration thereof is then significantly deflected by the deflection guide wall portion 47, which is curved to project abruptly downwards (i.e., depend downwards significantly) into the form of airflow S1, the flow direction of which has been changed relative to that of the original airflow out of air-outlet 211 by an angle of 90 degree or greater. A part of the airflow may flow further over the lower end portion 43, but the airflow is, however, directed substantially downwards.

The changes in the flow rate and flow direction of the conditioning airflow thus described are mainly typical phenomena applicable to the airflow near the surface of the linear panel 11. The airflow which flows along regions more remote from the surface of each linear panel 11 is less affected directly by the changes of the surface configuration of the linear panel 11. However, the above-described changes in the conditioning air flow near the panel 111 more or less affect the airflow of lower regions or layers to reduce the flow rate, to spread and to be deflected or directed downwards in the form of the airflow S2.

On the other hand, the room air is always drawn or sucked in the direction K1 from the air-inlet 210 at the central portion of the air-conditioning apparatus 200. Therefore, a part of the conditioning airflow having been deflected downwards provides a circulation flow as shown by S3 in FIG. 13. This circulation flow S3 (referred to as short-cut or short-circuit) significantly reduces the air-conditioning efficiency of the air-conditioning apparatus 200 if it becomes excessive. However, it will be acceptable if only a part of the conditioning air is mixed as the circulated flow S3 into the intake flow S4 of the room air.

Meanwhile, the formation of thus described circulation airflow S3 helps, together with the above-mentioned deflected airflow S1,S2, most of the conditioning airflow to spread as shown by the airflow S5 in FIG. 13 over the room in the desired manner.

As a result, the airflow that flows over the lowermost end 43 of the linear cover member 40 of the linear panel structure 11 and flows along the ceiling surface 201*a* in contact therewith outside of the panel structure 10 can be minimized. Therefore, the possibility of the ceiling surface 201 becoming smudged or contaminated by fine solid and/or liquid particles contained in the conditioning airflow is also minimized.

The role or function of the linear panel 11 thus described applies similarly to the corner panel 12 because the corner panel 12 has a substantially similar cross-sectional shape or external shape or contour to that of the linear panel 11. Particularly, in the illustrated embodiment where the air-outlets 211 are provided along four sides, if it is hypothetically assumed that the corner panels 12 are not provided and that there are gaps between the linear panels 11, 11 instead of the corner panels 12, there would be possibilities that a part of the conditioning air having spread over due to the resistance of the linear panels 11 would flow from ends of the linear panels 11 into the hypothetical gaps where the corner panels 12 are assumed to be omitted, and that such airflow into the gaps may tend to grow or to be accelerated once such airflow has been established. In the ceiling panel structure 10 in the form of closed quadrilateral loop, however, such hypothetical airflow into the gaps is eliminated by the corner panel 12 and the flow of the conditioning air toward the ceiling surface 201 can be minimized as a whole.

However, in a case where the air-outlet is provided, for example, along two parallel sides or only along one side of the quadrilateral air-conditioning apparatus, the linear panel structure may be mounted only along the side(s) adjacent and opposed to the air-outlet(s), preferably over a range longer than that of the air-outlet. If desired, however, the corner panel may be further provided on one or both end(s) of the linear panel for such an air-conditioning apparatus. Further, a closed quadrilateral ceiling panel may be employed to eliminate the above-mentioned gaps regardless of the number of air-outlets, if desired.

The structural or constructional features and/or the configurational features or shape features of the linear and corner panels thus described can be changed or modified into various forms in a case where the length and/or width of the panels can be adjusted with ease at the mounting job site, and especially in a case where the conditioning airflow towards the ceiling surface 201 can be substantially eliminated. Some of the examples of the modifications of the above-mentioned embodiment will now be described briefly.

Figure 14:
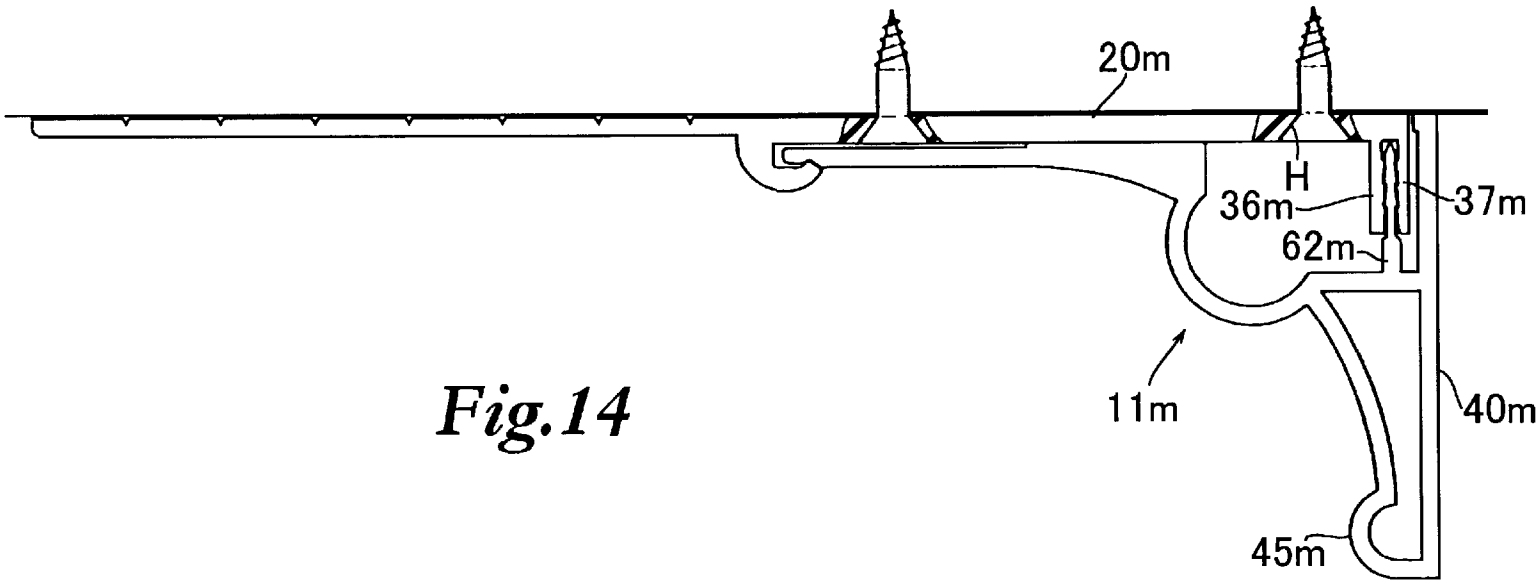
FIG. 14 is a partially broken explanatory sectional view of a modified linear panel structure.

In FIG. 14, a modified linear panel 11*m* is shown. In this modification, reference character "m" is added to the end of the reference numerals. The linear panel structure 11*m* comprises the single engaging projection 62*m* with a roughened surface instead of providing two engaging projections 62,63. In addition, inner surfaces of the engaging projections 36*m*,37*m* are roughened instead of providing two engaging projections 36,37 having the engaging stop protrusions 36*a*,37*a*. Thus, engagement/fixation of the base member with/to the cover member can be appropriately modified as desired. In addition, the linear cover member 40*m* has a semi-cylindrical deflection induction portion 45*m* instead of the vertical wall portion 45. Thus, faces for providing the flow-resistance, deflection (direction-change) and/or guide function(s) defined by the surface shape or configuration of the cover member 40 rigid against the conditioning airflow can also be modified as desired.

Figure 15A:
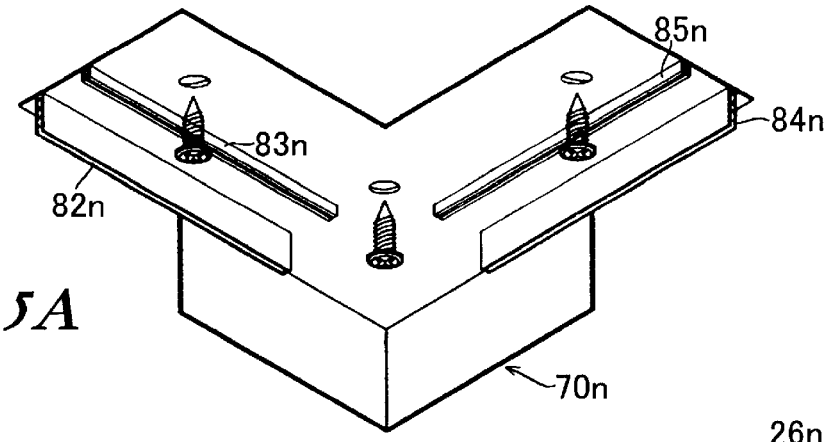
Figure 15B:
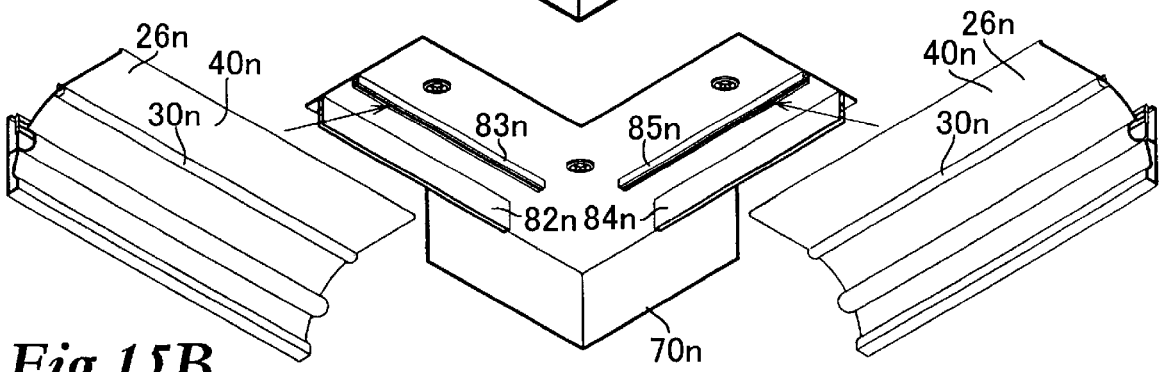
Figure 15C:
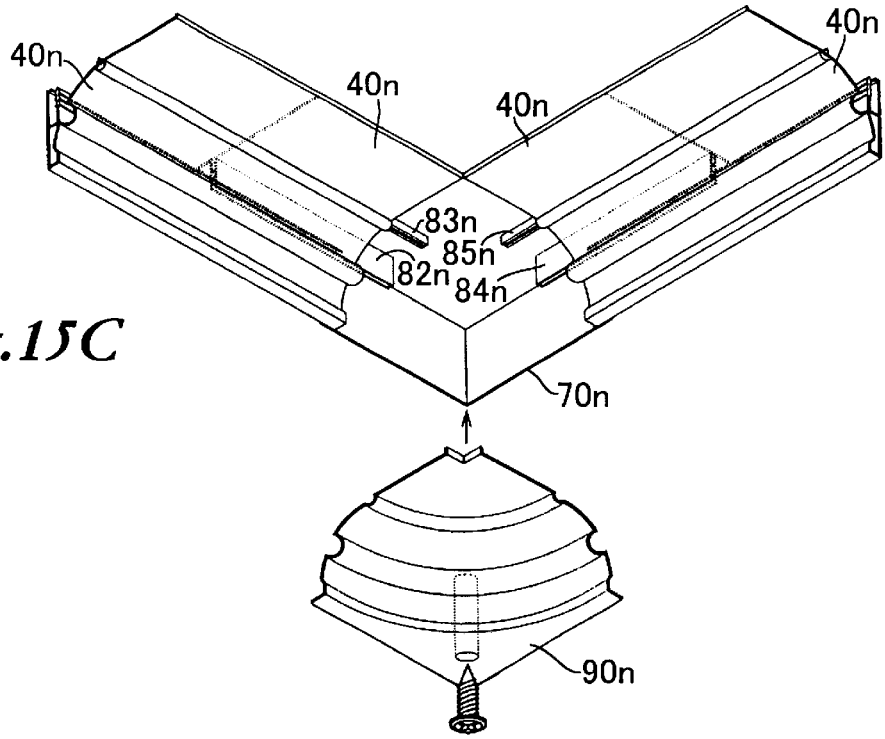
Figure 16A:
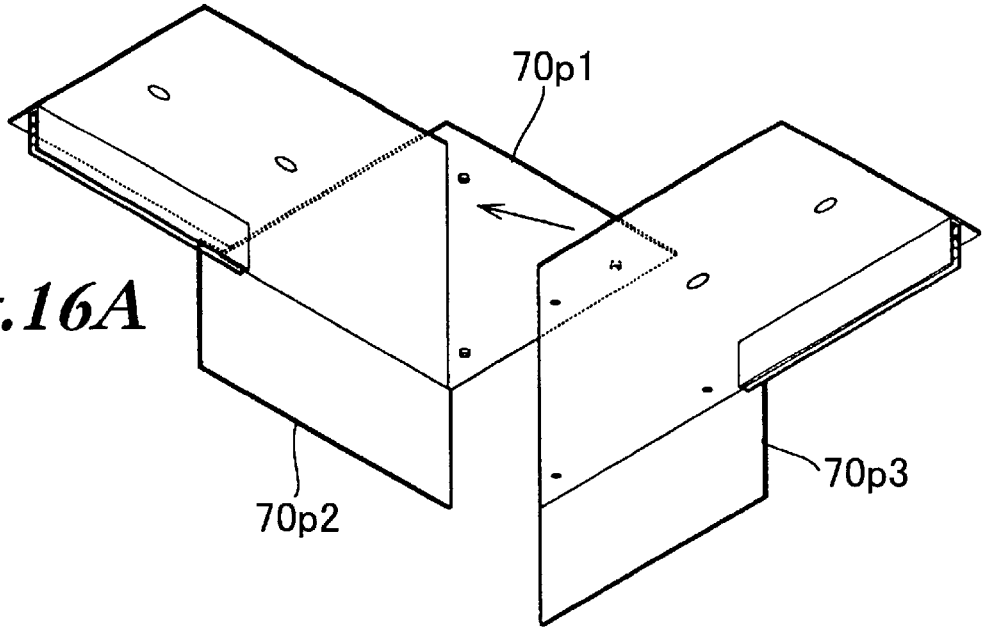
Figure 16B:
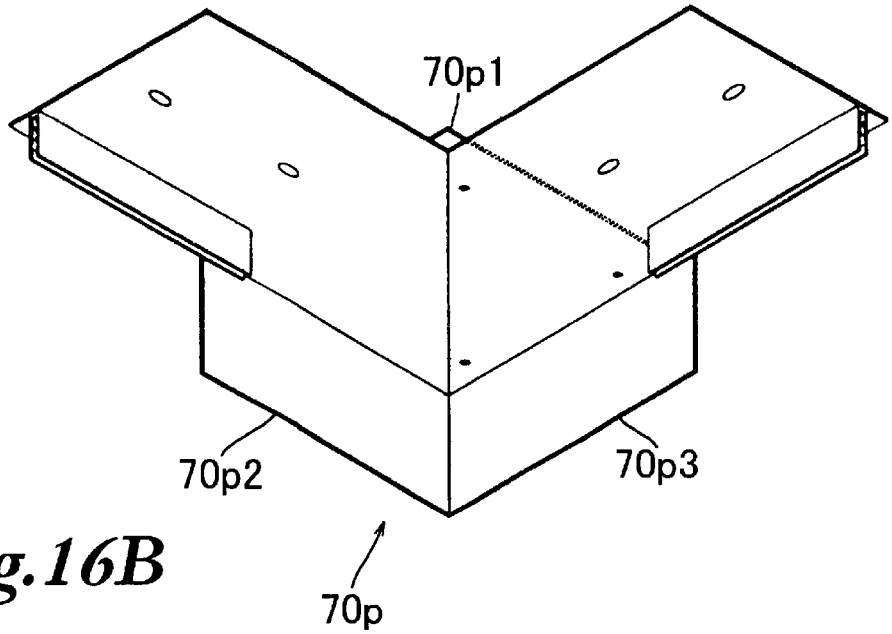
Figure 17A:
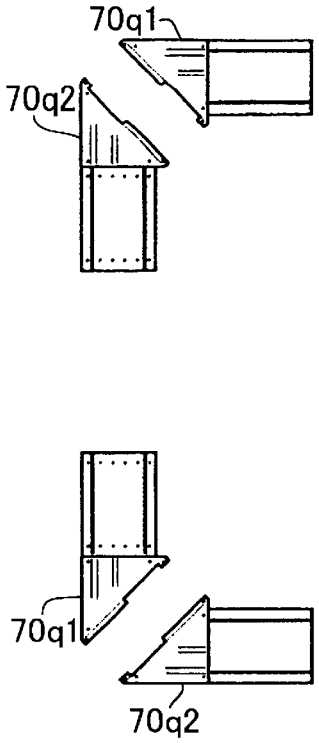
Figure 17B:
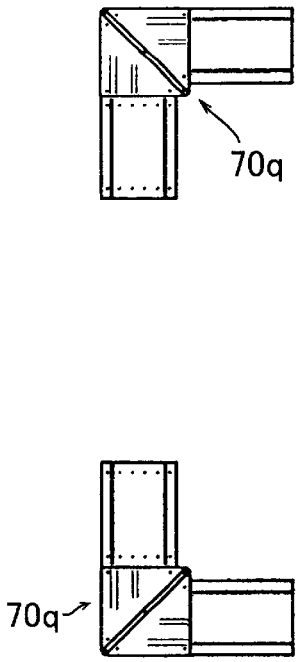
Figure 17C:
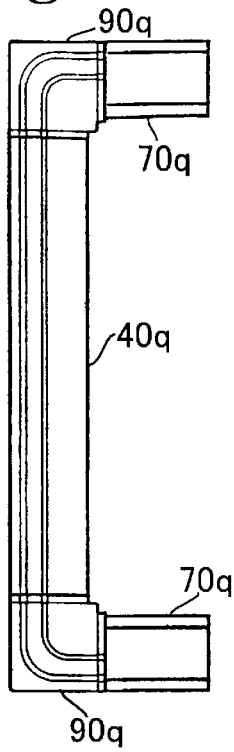
Figure 17D:
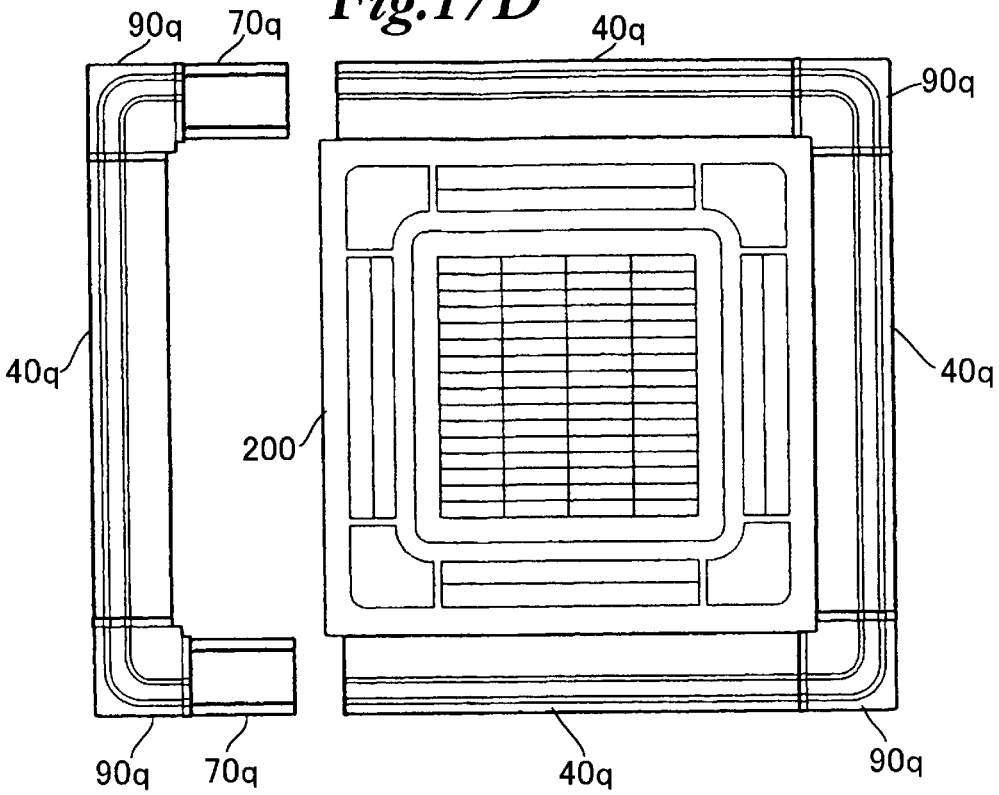

FIGS. 15A–C show an embodiment where the linear panel is formed only by the linear cover member 40*n* having a projection 30*n* and plate portion 26*n* as well, and where the linear cover member 40*n* is engaged with and fixed to, at either end, a corner base member 70*n*. In this illustrated embodiment, the linear cover member 40*n* comprises engaged projections extending substantially over the whole length thereof to be engaged with and fixed to engaging projections 82*n*,83*n*,84*n*,85*n* of the corner base member 70*n* (in this embodiment or modification, reference character "n"

is added to the end of each reference numeral). In this embodiment, the engagement of the engaging projections 82*n*–85*n* with the engaging portions of the linear cover member 40*n* is firm or strong enough to support the relatively long linear cover member 40*n* only at both ends thereof. Thus, instead of having separate linear panels and corner panels each having individual base and cover members, the base member of one (i.e., corner or linear) panel may be commonly used for a mounting cover member of the other (i.e., linear or corner respectively) panel. This embodiment may be further modified as shown in FIGS. 16A–B, where reference character "p" is added to the end of each reference numeral. In the modification of FIGS. 16A and 16B, the corner base member 70*p* is formed of a combination of plural members 70*p*1,70*p*2,70*p*3 instead of the single integral member. The corner cover member and the linear cover member may be similarly configured.

FIGS. 17A–D show a further modification, where a corner base member 70*q* for engagement and fixation of both the corner cover member and the linear cover member is formed of two parts 70*q*1,70*q*2 to be engaged with each other along a diagonal line, and are displaced in the longitudinal direction of the linear cover member 40*q* along an end thereof to be fitted thereto for fixation thereto (reference character "q" is added to the end of each reference numeral).

The ceiling panel structure 310 according to a preferred embodiment of this aspect of the invention will now be described in detail referring to FIGS. 18A–B to FIG. 32. In this embodiment, reference numeral "3" is added to the beginning of the reference numerals or characters of the members, elements or portions of the first described embodiment generally, although some exceptions excepted.

Figure 18A:
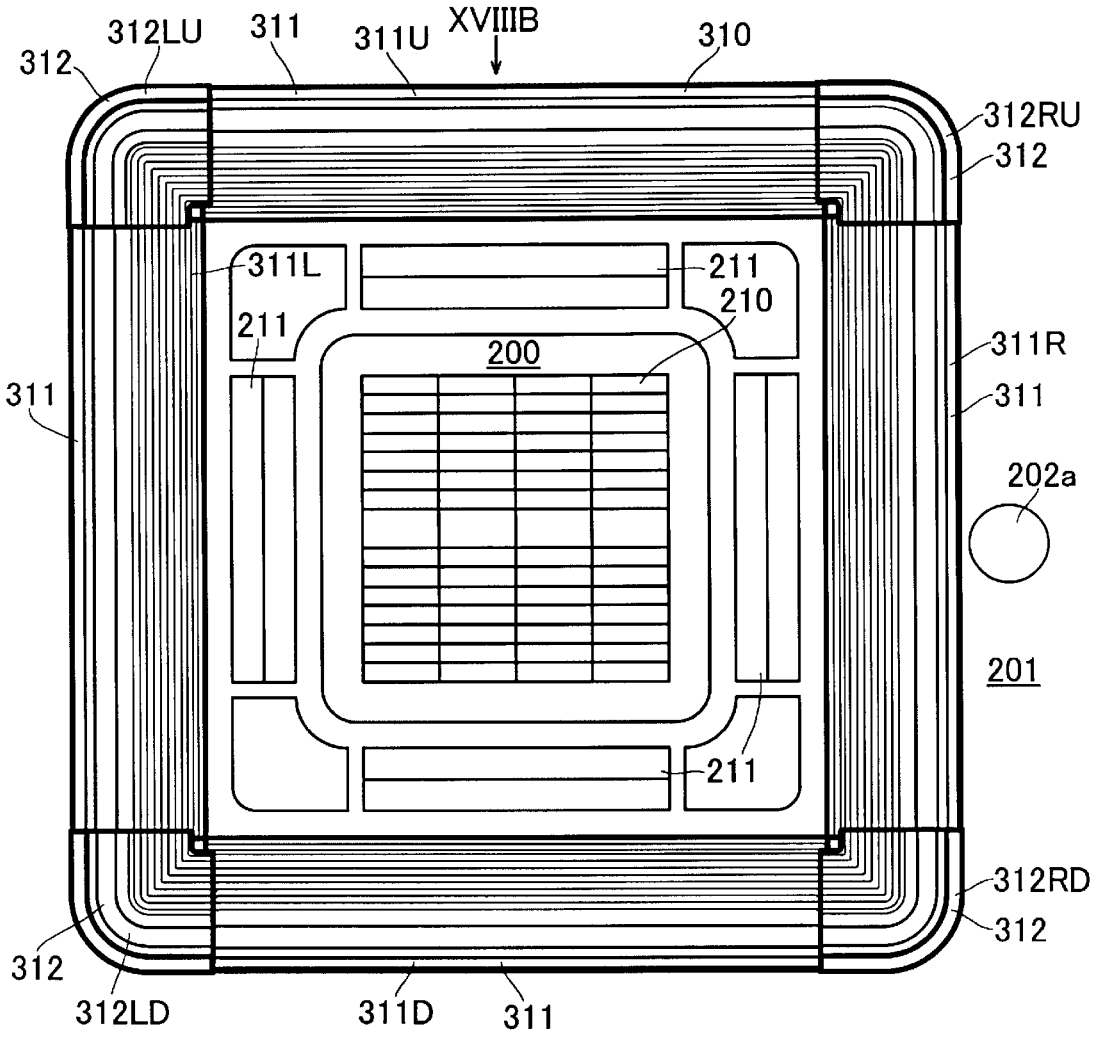
Figure 18B:
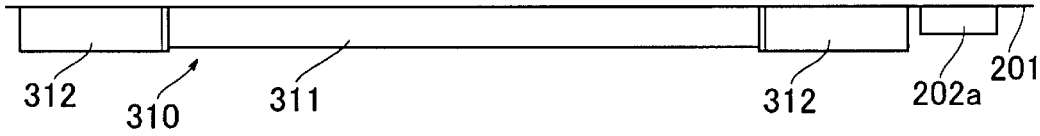

The ceiling panel structure 310 of FIGS. 18A–B comprises linear panels 311, each of which comprises, as shown in FIGS. 19A–B to 23A–C, a linear base member 320 of plastic material (FIGS. 19A–B to 21A–B) and a linear cover member 340 (FIGS. 19A–B,22 and 23A–B) of plastic material coupled to the linear base member 320. In the description of this embodiment hereafter, concrete sizes of various portions or parts are shown. However, these are only typical or desired examples, and the invention is not limited by any means to the sizes, shapes, or the same order of sizes or similar shapes, as described in the first mentioned embodiment.

Figure 20:
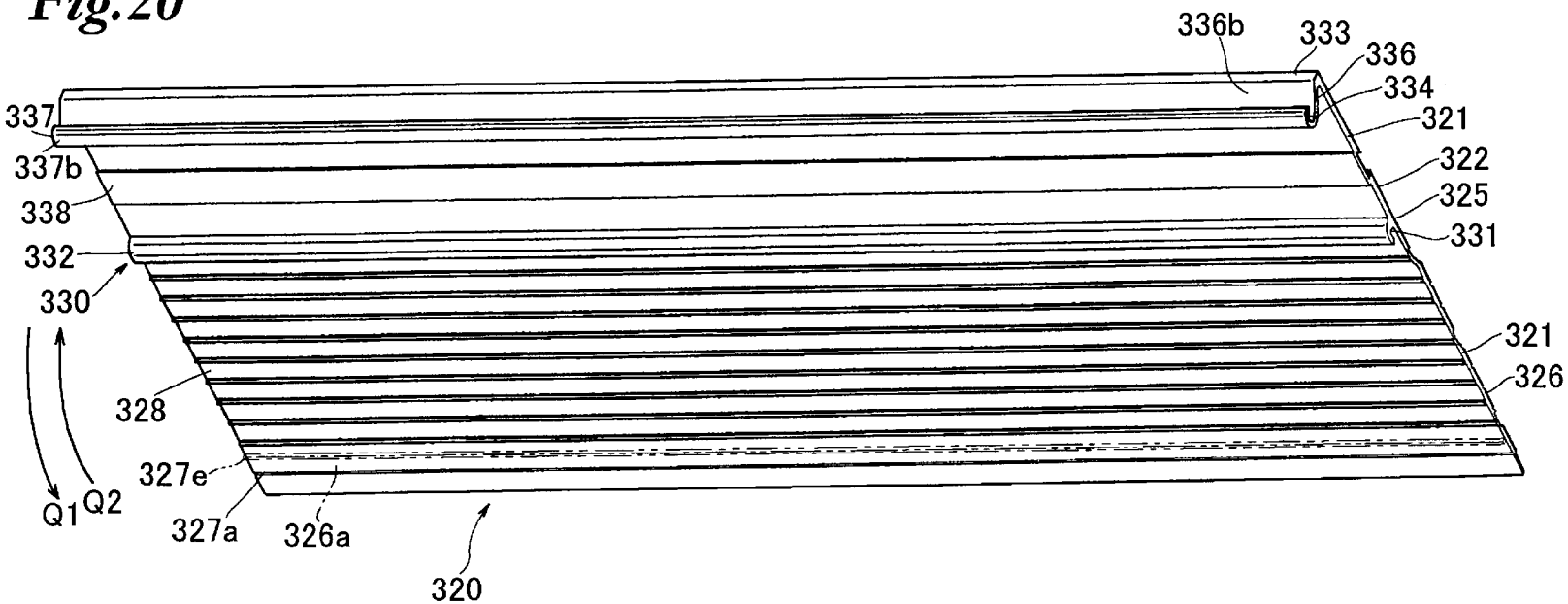
FIG. 20 is an oblique view of a linear base member for the linear panel structure of FIG. 19.
Figure 21A:
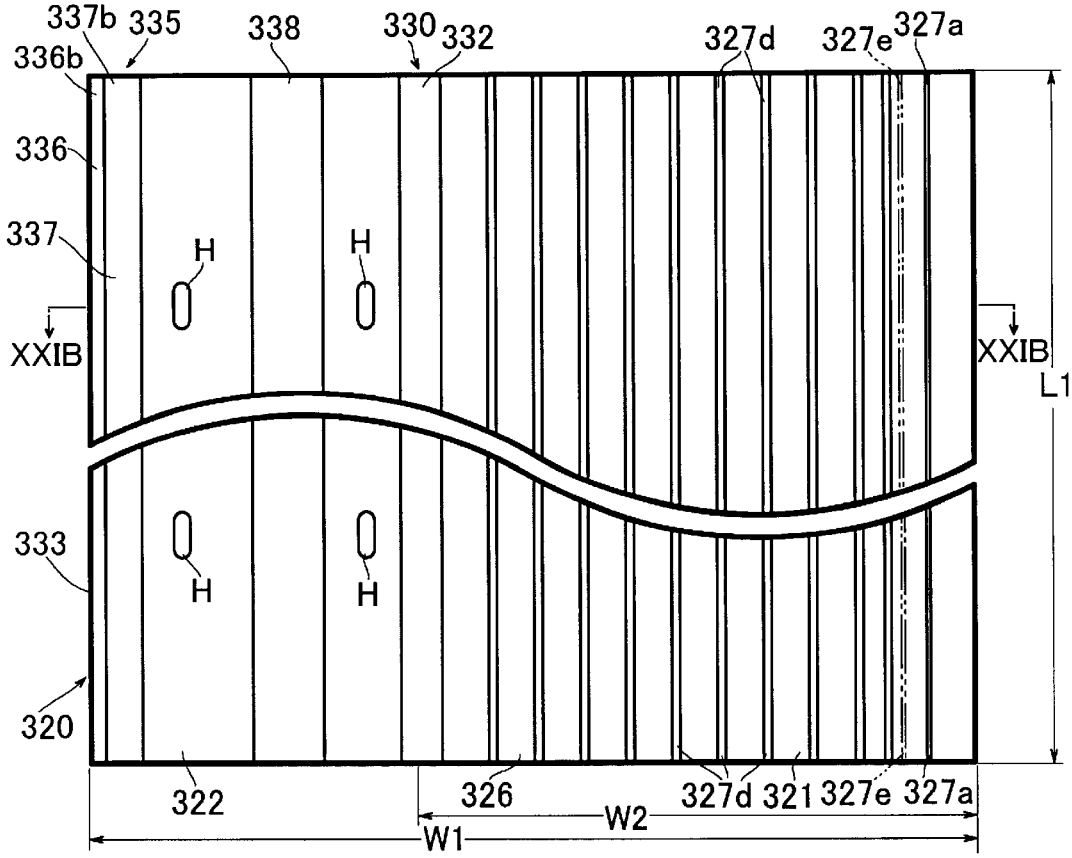
Figure 21B:
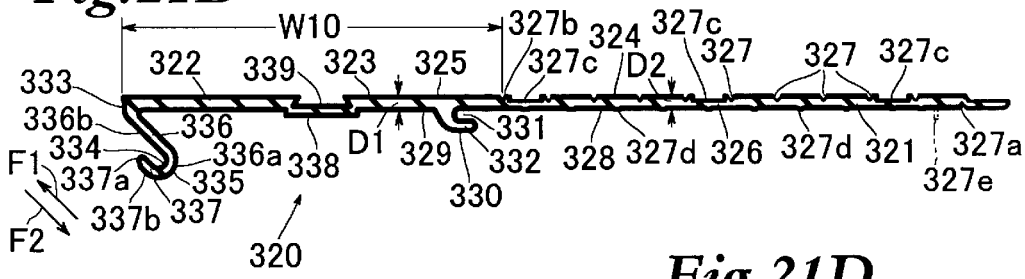

The linear base member 320 comprises, as shown in FIGS. 20 and 21A–B, a plate portion 321 having a width W1 of about 20 cm and a length L1 of about 200 cm at its maximum. The plate portion 321 includes a main plate portion 322 having a thickness D1 of about 3 mm (FIG. 21B), and a guide plate portion 326 having a thickness D2 of about 2 mm (more specifically 2.2–2.3 mm or thicker) and having a width W2 of about 10 cm and a principal face 324 substantially co-planar with one principal face 323 (face opposed to the ceiling surface 201, i.e., rear face) of the main plate portion 322 and extending integrally from one end 325 of the main plate portion 322. At least one of the main and guide plate portions 322,326 may be formed so that the thickness of a part thereof becomes thinner approaching closer to a widthwise inner end (right-hand side end in FIGS. 21A,21B), or both the main and guide plate portions 322,326 may have the same thickness.

The guide plate portion 326 has, in the principal face 324, grooves 327 extending over a whole length in the longitudinal direction thereof, for example, at regular intervals of 1 cm. The interval may be greater or smaller than 1 cm, and may not be uniform or constant if desired. Therefore, a workman performing the mounting work can adjust by himself at the mounting job site the width W2 of the guide plate portion 326 and, accordingly, the width W1 of the base member 320 by producing a cut-in groove in and a desired groove 327 among the grooves 327 by edges of a cutter knife or the like at the mounting job site. A width, depth and cross-sectional shape are not limited so long as the guide plate portion 326 can be weakened to facilitate separation along the groove 327 so that it is not a possibility that the guide plate portion 326 may be separated or broken during usual handling thereof. In this embodiment, a groove 327*a* similar to the groove 327 is formed in another principal face 328, i.e. the surface, of the plate portion 326 to facilitate separation, and the groove is in an edge part which may be subjected to damages during transportation etc., before use or application of the member 320 onto the ceiling 200. The groove 327*a* may also be omitted.

In addition, the guide plate portion 326 has, in the side of the ceiling (i.e., rear face 324 thereof) recesses 327*c* extending over the whole length thereof in regular intervals in the widthwise direction. Each recess 327*c* has about the same depth as that of the grooves 327 and a width wider than that of the grooves 327. The recess 327*c* is used for engagement with an end cap 450 (refer to FIGS. 33A–F) described later. The guide plate portion 326 has, on a surface 328 thereof, small projections 327*d* extending over the entire length in regular intervals in the widthwise direction thereof, and each projection 328 has a height on the order of 0.1 mm. The projections 327*d* mainly for design purpose also serve as resistance against the airflow to some extent. However, the projections 327*d* may also be omitted.

Figure 30:
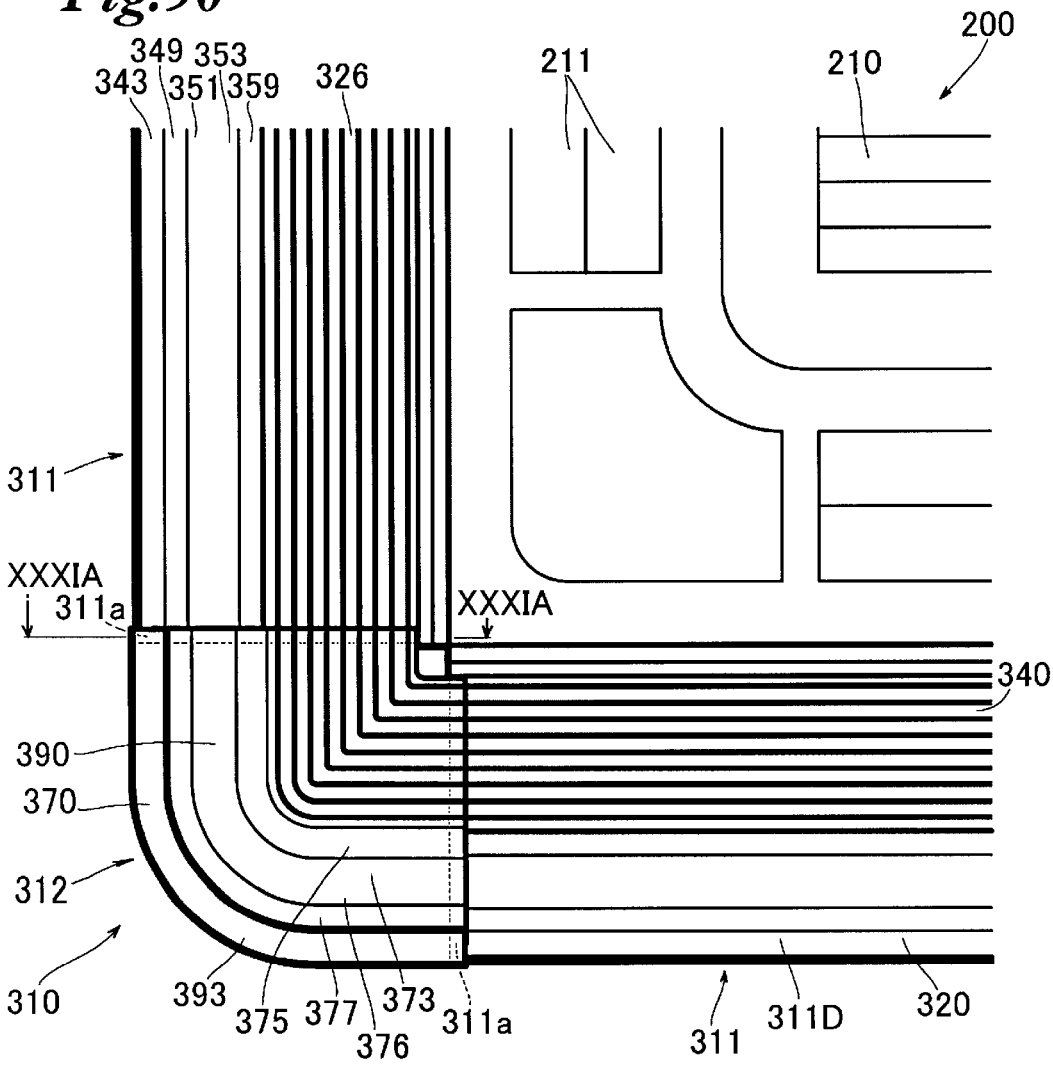
FIG. 30 is an explanatory bottom view illustrating a state where the corner cover member of FIG. 25B has been mounted.

The guide plate portion 326 may have in the surface 328 near the groove 327*a* a projected rib or projection 327*e* exaggeratedly shown by imaginary lines in FIGS. 20 and 21 A–B. The projection 327*e* is taller (e.g., 2 mm high and 1 mm wide) than the above-mentioned projections 327*d*, and serves for the standard positioning of the linear panel structure 311, when the standard width of the structure 311 is mounted on the ceiling surface 201. More specifically, in a case where the linear base member 320 is used, as it is or as cut along the groove 327*a*, in a state of standard width (substantially maximum width), a part of the guide plate portion 326 situated closer to the distal end than the projection 327*e* (i.e., distal end portion 326*a* between the groove 327*a* and the projection 327*e*) is inserted into a region between the outer frame or smoothly planed board part of the air-conditioning apparatus 200 and the ceiling surface 201 to abut the projection 327*e* against an outer edge of the smoothly planed board part of the air-conditioning apparatus 200 for the positioning of the linear base member 320, thereby enabling the positioning of the linear panel structure 311. However, the positioning projection 327*e* shown by the imaginary lines may be omitted. In addition, instead of inserting the distal end portion 326*a* between the outer frame or smoothly planed board part of the air-conditioning apparatus 200 and the ceiling surface 201, it may be simply abutted, as shown in FIG. 30, against the outer side face of the outer frame or smoothly planed board part of the air-conditioning apparatus 200.

The main plate portion 322 has at one end 325 on another principal face or surface 329 a projection 330 defining an engaging recess 331 serving as the engagement portion in which a hooked engaged portion 337 (FIGS. 22 and 23A–B) serving as an engaged portion at one end of the cover member 340 is fitted. As the engaging recess 331 is associated with the projection 330, the projection 330 is also called hereafter the "engaging projection". Further, in this specification, one of the members establishing the engagement relationship may be called as an "engaging portion", while another of the members may accordingly be called an "engaged portion". Therefore, we may call both members the engaging portion and the engaged portion without distinguishing "engaging portion" and "engaged portion" from each other. This way of naming may also apply to the engaging relationship of elements other than the engaging elements 331,357 in question. The projection 330 has an arcuate protrusion wall portion 332 protruding from the principal faces 328,329 to define the recess 331 opened widthwise inward co-operatively with the principal face 328 serving as the guide face of the guide plate portion. The engaging recess 331 and arcuate protrusion wall portion 332 of the projection 330 extend continuously over a whole length of the linear base member 320. However, the arcuate protrusion wall portions 332 may be formed by plural parts each having a desired length in the longitudinal direction and being aligned at regular intervals to define as a whole the engaging recess 331 which extends almost continuously over the entire length of the linear base member 320.

The main plate portion 322 has, at another end 333 thereof or at a widthwise outer end 333 of the linear base member 320, an engaging projection 335 protruding from the principal face 328 to define an engaging recess 334 opened to a widthwise outer end and to the ceiling surface 201. Each of the engaging recess 334 and engaging projection 334 also extend over the whole length of the linear base member 320 in the longitudinal direction thereof. Herein, widthwise "outside (or outward)" and "inside (or inward)" with respect to the linear panel structure 311 or linear base member 320 means respectively a side more remote from (or away from) the air-conditioning apparatus 200 and a side nearer to (or approaching) the air-conditioning apparatus 200 when the element such as the linear panel structure 311, linear base member 320 or linear cover member 340 is disposed in a predetermined orientation relative to the air-conditioning apparatus. The projection 335 comprises, when viewed in a cross-sectional view as shown in FIGS. 19B and 21B, a proximal inclined portion or inclined guide portion 336 protruding from the principal face 328 to be situated widthwise inward as departing more remote from the main plate portion 322, a semicircular arcuate portion 336*a* curved downwardly convex from a linear extended end of the proximal inclined portion 336 to define a recess 334 together with the proximal inclined portion 336, and a distal inclined portion 337 extending diagonally and generally parallel to the proximal inclined portion 336 from the arcuate end of the semicircular arcuate portion 336*a*. An inner face 336*b* of the proximal inclined portion 336 or ceiling-side wall portion 336 inclined to be closer to the ceiling surface 201 as departing more remote from the widthwise inner recess 331, serves as a guide face for engagement or disengagement in directions F2,F1 respectively upon the engagement with or disengagement from an engaged portion of the cover member 340 to be described later. A widthwise outer end portion or distal end portion 337*a* of the distal inclined portion 337 is situated widthwise more inside than a widthwise outer end 333 of the main plate portion 322 corresponding to the end of the proximal inclined portion 336. In addition, the outer surface 337*b* (a surface opposite to a side facing or opposed to the ceiling surface 201) of the distal inclined portion 337 is slanted so as to be closer to the ceiling surface 201 as departing more remote from the recess 33 1, thereby serving as a guide face in the direction F1 upon engagement of the cover member 340.

The main plate portion 322 has, on a widthwise central part of the surface 329, a projection 338 extending in the longitudinal direction thereof, and a recess 339 in the rear face 323. As seen from FIG. 21B, a shape of the base member 320 in a cross-section perpendicular to the longitudinal direction thereof is the same at any position in the longitudinal direction. This is also the case with respect to the below-described linear cover member 340.

The main plate portion 322 has further screw holes H for allowing a stem or shaft of a mounting screw to pass therethrough. Each hole H is elongated to enable selection of a preferred screwing position on the ceiling surface 201. The hole H may have a slanted peripheral recess to receive therein a head of the screw, or may be formed in a widthwise different part of the main plate portion 322 unless the engagement with the linear cover member 340 is prevented. The main plate portion 322 of the linear base member 320 is covered by the linear cover member 340 (to be described later) so that a surface thereof is hidden. Therefore, the heads of the screws mounted in the main plate portion 322 are hidden by the linear cover member 340.

Figure 22:
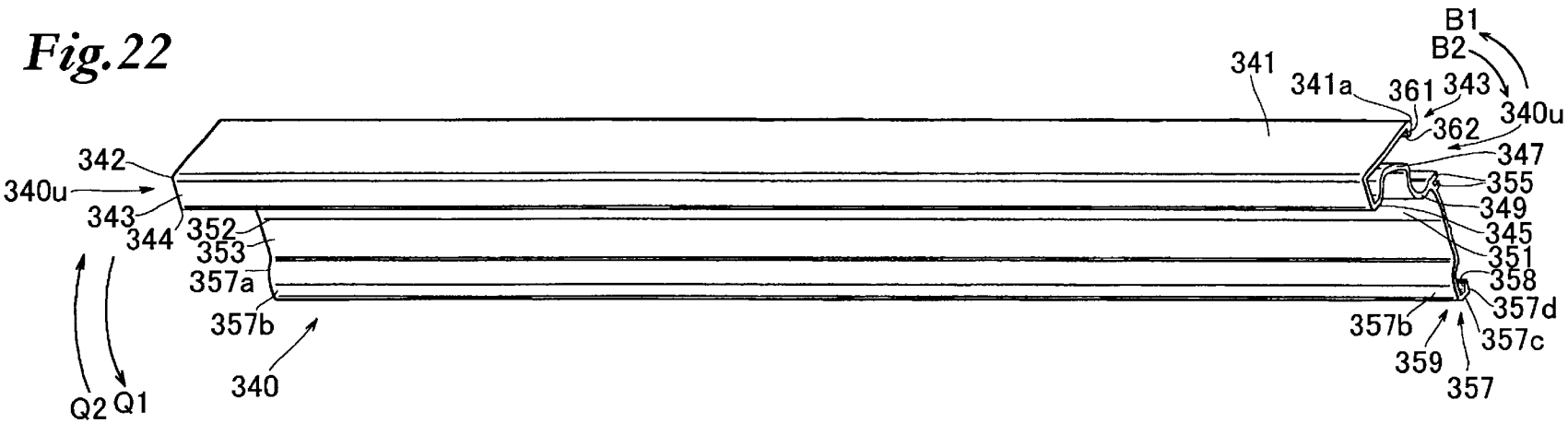
FIG. 22 is an explanatory oblique view of a linear cover member for the linear panel structure of FIG. 19.
Figure 26A:
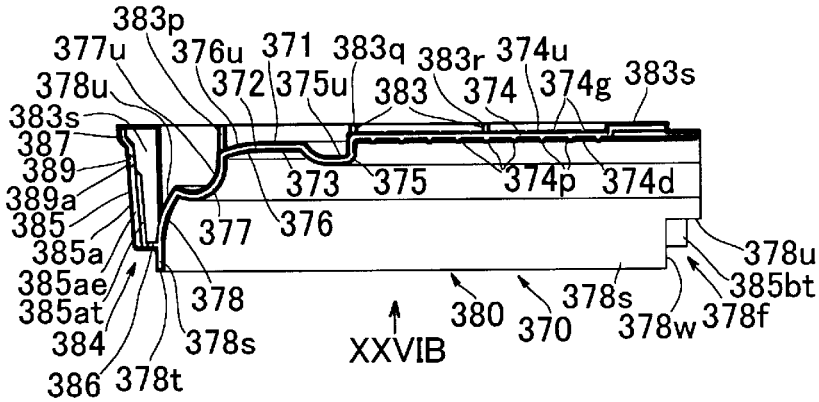
Figure 26B:
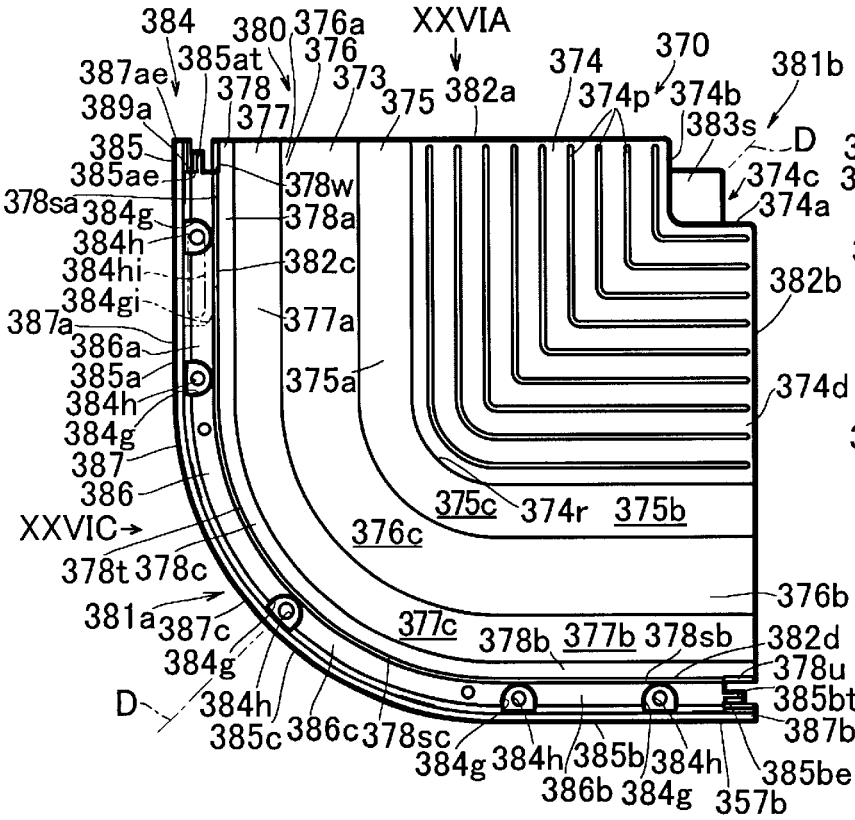
Figure 26C:
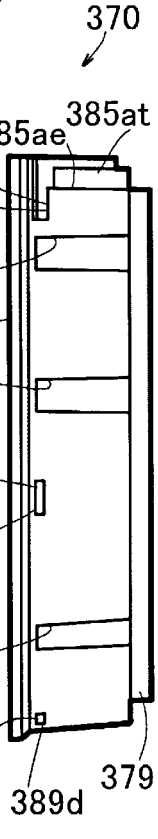
Figure 27:
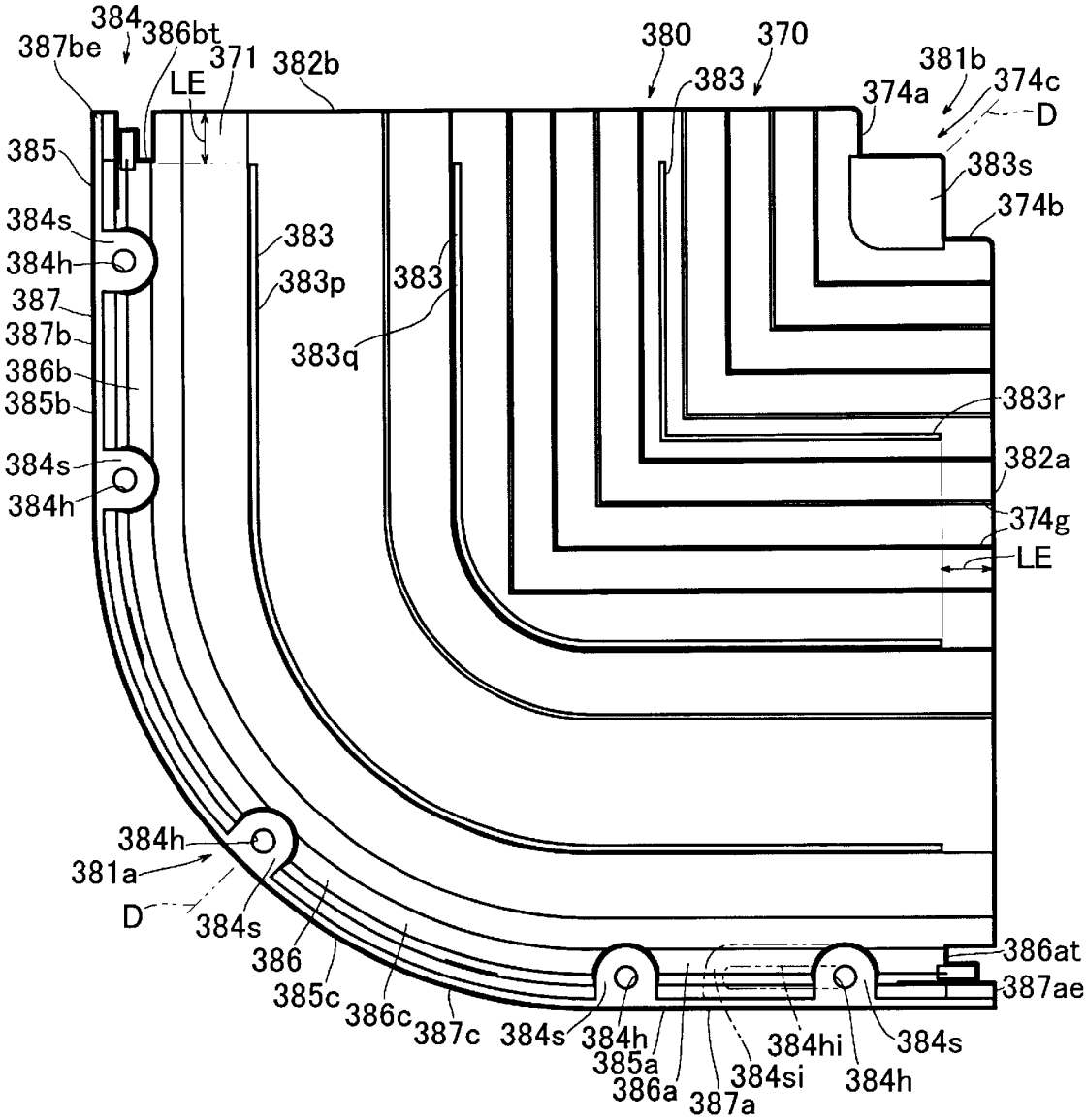
FIG. 27 is an explanatory view of an upper face (back) of the corner base member of FIG. 25A.
Figure 29:
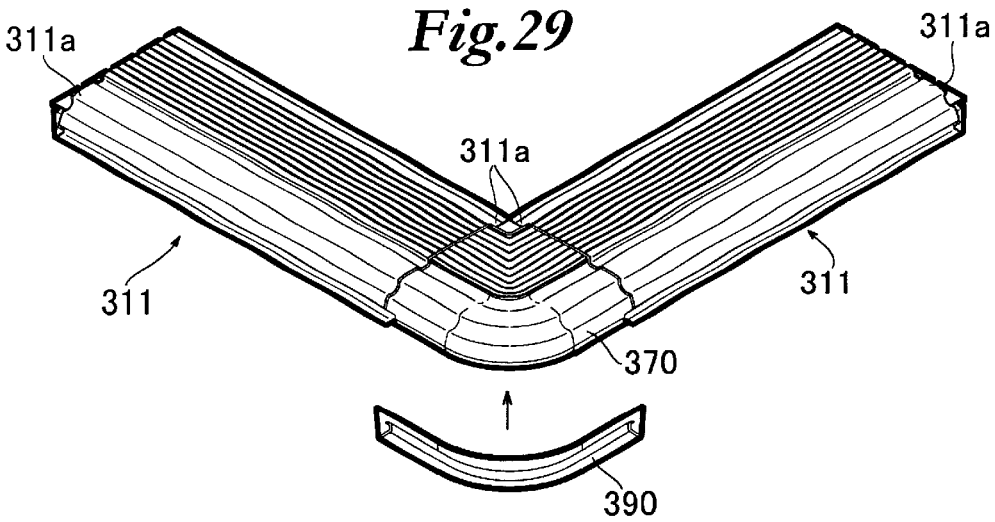
FIG. 29 is an explanatory oblique view, as viewed from an obliquely lower position, for illustrating a mounting process of the corner cover member to complete the ceiling panel structure of FIG. 18A.

The cover member 340 is, as shown in FIGS. 22 and 23A–B, made of an elongated plastic member having a width W3, which is about the same as that of the main plate portion 322 of the base member 320, and a length L3 which is substantially the same (L3=L1) as the length L1 of the base member 320. Herein, i.e., in the specification, unless mentioned otherwise, "up" and "down" respectively refer to a side closer or approaching to and a side more remote or departing from the ceiling surface in a condition or state where the ceiling panel structure 310 or element(s) thereof is mounted to the ceiling surface 201. As shown in FIG. 23B, the cover member 340 includes a vertical inclined end wall portion 341 extending generally vertically while being slightly slanted to be situated widthwise outwards as approaching the ceiling surface (upwards), a lower end guide portion 343 extending generally horizontally from a lower end 342 of the end wall portion or side wall portion 341, a short vertical wall portion 345 extending vertically from an inner end 344 of the lower end guide portion 343 substantially perpendicularly thereto, a deflection guide portion 347 extending from an upper end 346 of the vertical wall portion 345 to be downwardly convex and serving as the deflection induction portion, a downwardly and upstream convex semi-cylindrical flow-resistant projection portion 349 extending upstream from an upstream end 348 of the deflection induction portion 347 and integrally therewith to provide a resistance against flow of the conditioning air to decelerate it, a slightly upwardly convex upstream arcuate guide portion 351 extending upstream from an upstream end 350 of the flow-resistant projection portion 350 and being integral therewith, an upstream horizontal guide portion 353 extending substantially horizontally from an upstream end 352 of the upstream arcuate guide portion 351, and a hooked end portion 357 formed substantially continuously with an upstream (widthwise inner) end of the horizontal guide portion 353 and serving as the engaged portion to be engaged with the widthwise inner engaging recess 331 of the base member 320.

The hooked end portion 357 comprises an inclined wall portion 357*b*, a generally vertical inclined wall portion 357*c* and a generally horizontal and tapered small projection 357*d* having a wedge-like cross-sectional shape to be fitted in the widthwise inwardly opened engaging recess 331 of the engaging portion 330 of the base member 320. In other words, an arcuately projecting wall portion 332 of the engaging projection 330 of the base member 320 fits in a recess 358 defined by wall portions 357*a*–357*d* of the hooked end portion. In an assembled state as shown in FIG.

19B, the hooked end portion 357 serves as a flow-resistant small projection 359 defined by the wall portions 357*c* and 357*b*. The cross-section of the surfaces of the wall portions 357*c* and 357*b* may have any other shape, such as a part of an ellipse, so long as the small projection 359 acts as the flow-resistant projection serving as flow-resistance against the flow of conditioning air to decelerate it. Similarly, although the typical example of the downward length or height of the small projection 359 is about 5 mm–about 1 cm, the height may be greater than about 1 cm or smaller than about 5 mm so long as the small projection 359 serves as the flow-resistance projection.

The cover member 340 has legs 355,356 for abutting against the lower principal face 329 of the main plate portion 322 of the base member 320, on the rear face or upper face 354 in FIG. 23B, at regions near the downstream end 350 of the upstream arcuate guide portion 351, and near the downstream end 352 of the upstream horizontal guide portion 353. In the illustrated embodiment, the leg 355 comprises two leg parts 355*a*,355*b*, and a recess between the legs 355,356 receives the projection 338 of the base member 320. The leg 355 may be omitted.

The deflection induction portion 347 comprises an upstream part 347*a* extending generally vertically for providing a flow-resistance and significantly changing the direction of the airflow, and a downstream part 347*b* connected smoothly at an upper end 347*c* thereof with a lower end of the upstream part 347*a* and extending along directions approaching the horizontal direction for providing the flow-resistance and changing the direction of the airflow to guide the airflow downwards and toward the center of the air-conditioning apparatus 200. The downstream part 347*b* is connected smoothly at the downstream end 346 thereof with the vertical wall portion 345. A vertical height from the end 350 of the guide portion 351 to the lower end of the horizontal wall portion 343 is, for example, about 4–5 cm. However, the height may be much greater (e.g., 10 cm or greater) or much smaller (e.g., about 2–3 cm).

As seen from FIGS. 22 and 23B, the linear cover member 340 comprises, at a widthwise outer region thereof, a portion 340*u* of a generally "U"-shaped cross-section. That is, the U-shaped portion 340*u* is formed of the horizontal guide portion 343 forming the bottom part of the "U", a downstream vertically inclined end wall portion 341 forming one of the two legs of the "U", and the short vertical wall portion 345, deflection induction portion 347, and the semi-cylindrical flow-resistant projection portion 349 cooperatively forming as a whole another of the two legs of the "U". The U-shaped configuration or structure having a cavity 340*s* between the two legs 341 and 345,347,349, i.e., leg 341 and leg 345,347,349, enables the length of the upper ends of the two legs to be increased/decreased within an elastic limit of the material therefor, and the distal end 341*a* of the outer leg 341 can be elastically or resiliently displaced with respect to the upper end of the inner leg 345,347,349 to be departed therefrom or to approach thereto in the directions B1,B2.

The vertical inclined wall portion 341 at the widthwise outer end of the cover member 340 comprises, at the upper end (ceiling-side end) 341*a* thereof, a projection 361 projecting widthwise inwardly. The projection 361 serves as an engaged portion 363 to be engaged with the engaging recess 334 of the base member 320. Herein, a recess 362 defined by the projection 361 and wall portion 341 of the cover member 340 may be regarded as the engaged portion 363 to be engaged with the projection 337 of the base member 320, or both the recess 362 and the projection 361 may be regarded as the engaged portion 363.

A lower face or inner face of the projection 361 is inclined to be situated lower as moving widthwise inwardly in the embodiment illustrated in FIG. 23B. Instead, the projection 361 may have a lower face projecting widthwise inwardly and generally horizontally as shown in an enlarged form of the projection and denoted by reference characters 361*a* in FIG. 23C. Alternatively, the projection may have an upwardly inclined lower face (engaged face) extending higher (more upwards) as going widthwise inward, as shown by an imaginary line 361*b* in FIG. 23C, so that the disengagement can be facilitated. In addition, the projection 361 may be shorter so long as the engagement of the cover member 340 can be ensured. Thus, the length may be, for example, as short as about 1 mm or shorter.

During the mounting, the horizontal wall portion 343 of the cover member 340 is pressed upward V2 in a state where the hooked engaged portion 357 situated at the widthwise inner side of the linear cover member 340 and having the wedge-shaped engaged projection 357*d* is engaged with the engaging recess 331 of the widthwise inner engaging portion 330 of the linear base member 320, and where the upper end 341*a* of the vertical inclined wall portion 341 situated at the widthwise outer side of the cover member 340 (i.e., the upper face of the projection 361) abuts against the inclined face 337*b* of the inclined wall 337 of the engaging portion 335 of the base member 340 serving as the guide part. Thereby, the U-shaped portion 340*u* constituted by the wall portions 341,343,345,347,349 is deformed as a whole elastically or resiliently so that the wall portion 341 can be moved or expanded in the direction B1 to displace or move the guide part or slide-contact part 341*a* at the upper end of the widthwise outer and almost vertically inclined wall portion 341 of the cover member 340 in the direction F1 along the inclined face 337*b* of the inclined wall portion 337 of the engaging portion 335 of the base member 320. When the inwardly directed projection 361 is widthwise outward beyond the distal end 337*a* of the inclined wall portion 337, the projection 361 then abuts against the upper inclined wall 336 of the base member 320, whereupon the upwardly pressing force on the cover member 340 is weakened or removed to enable the wall portion 341 of the U-shaped portion 341*u* of the cover member 340 to restore its original shape or widthwise original position due to the elasticity or resiliency of the wall portions 341,343,345,347,349 of the U-shaped portion. Therefore, the cover member 340 is engaged with the engaging portion 335 of the base member 320 in such a manner that the projection 361 of the engaged portion 363 thereof fits into the engaging recess 334 of the base member 320, and the recess 362 fits around or receives therein the projection 337 of the base member 320. This engagement action or operation may be carried out all over the length of the linear base and cover members 320,340 substantially simultaneously or may proceed sequentially or gradually from one of the longitudinal ends thereof to the other longitudinal end.

On the other hand, upon disengagement or removal, operations reverse to the mounting or engaging operations are carried out. That is, the wall portion 343 etc. are pressed upward in the direction V2 to deform elastically or resiliently as a whole in the B1 direction the U-shaped portion 340*u* constituted by the wall portions 341,343,345,347,349 so that the wall portion 341 of the U-shaped portion 341*u* of the cover member 340 is expanded or displaced in the direction B1. This expansion or displacement releases the engagement of the engaged portion 363 with the engaging portion 335, and then the wall portion 341 of the cover member 340 is pulled down in the direction V1. Thus, the engagement of the engaged portion 363 of the cover member 340 with the engaging portion 335 of the base member 320 is completely released. Then, the engagement of the engaged portion 357 of the cover member 340 with the engaging portion 330 of the base member 320 is released.

Figure 21C:
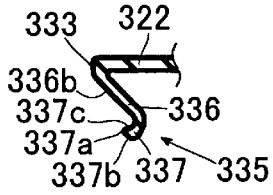

In a case where a relatively large force or pressure is required for expanding the U-shaped portion 340*u* of the linear cover member 340 in the direction B1, the wall portion 343 etc. are pressed upwards in the vicinity of one longitudinal end of the linear cover member 340 to expand the end 341*a* in the direction B1 or F1 along the inclined face 336*b* of the upper inclined wall portion 336. While keeping the expanded condition thereof, a distal end of an elongated rod-like part such as a screw driver or an other appropriate tool having a strip-like or thin and elongated plate part is inserted into a gap between the distal end 337*a* of the lower inclined wall portion 337 of the engaging portion 335 and the expanded engaged projection 361 of the engaged portion 363 and is then moved along the longitudinal direction of the linear base and cover members 320,340 toward the other longitudinal ends thereof. Thus, the engagement between the engagement portions 335,363 can be completely released as if the portions 335,363 are peeled off from each other. When the projection 361 is configured as shown in FIG. 23C, the engagement can be released easily. The lower wall portion 337 of the engaging recess 334 of the engaging portion 335 of the base member 320 may have an inner face extending generally horizontally or diagonally downwards widthwise outwardly as shown in FIG. 21C to facilitate the release of the engagement while ensuring secure engagement.

Figure 21D:
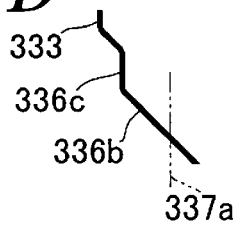

Further, as shown in an enlarged view in FIG. 21D, the base member 320 may have a step 336*c* at the inclined face 336*b* of the inclined wall portion 336 so that the distal end projection 361 of the wall portion 341 may be engaged once with the step 336*c* along the whole region in the longitudinal direction when the wall portion 341 of the U-shaped portion 340*u* of the cover member 340 is expanded in the direction F1 or B1, and so that the engaged portion 363 of the cover member 340 can be, thereafter, completely disengaged from the engaging portion 335 of the base member 320 by drawing or pulling down the end wall 341 of the cover member 340. In FIG. 21D, an imaginary line 337*a* denotes a widthwise position of the distal end 337*a* of the short inclined wall portion 337 which will be situated outside of the lower end of a region shown in the enlarged view of FIG. 21D.

In each of the illustrated embodiments, the short and long inclined wall portions 337,336 of the base member 320 guide the engaged portion 363 of the cover member 340 upon the engagement, while the long inclined wall portion 336 of the base member 320 guides the engaged portion 363 of the cover member 340 upon the release of the engagement. This arrangement makes the engagement/disengagement of the cover member 340 with/from the base member 320 easier, even in a case where only one workman has to carry out the engagement/disengagement while keeping an unnatural posture facing upward to the ceiling surface 201.

Thus, the downstream (widthwise outer) engaged portion 363 of the cover member 340 is engaged with the downstream (widthwise outer) engaging portion 335 of the base member 320 while the wedge-shaped engaged projection 357*d* of the upstream (widthwise inner) engaged portion 357 of the cover member 340 is kept to be engaged with the engaging recess 331 of the upstream (widthwise inner) engaging portion 330 of the base member 320.

Now, the corner panel 312 of the ceiling panel structure 310 will be described with reference to FIGS. 24A–28C. As shown in these drawings, the corner panel 312 comprises a corner base member 370 (refer to FIGS. 24A–27) of plastic material, and a corner cover member 390 (refer to FIGS. 24A–B,25B and 28A–C) of plastic material coupled to the corner base member 370.

In the corner panel 312 shown in FIGS. 24A–28C, the corner base member 370 is configured or adapted to be laid on the adjacent longitudinal ends of the linear panels 311 to be engaged therewith (refer to FIGS. 29–31A). The corner base member 370 itself has a surface configuration or contours providing flow-guide, flow-resistance and deflection (change of direction of flow) functions similar to the whole linear panel 311.

More specifically, the corner base member 370 of generally square shape in a plan view includes an upper surface 371 having two side edges 382*a*,382*b* extending at right angles relative to each other and being configured to be complementary in shape with that of the lower surface of the linear panel structure 311 (refer to FIGS. 31A–B and 26A–C) so that the corner base member 370 can be put, from the lower side, on the longitudinal ends 311*a*,311*a* (refer to FIGS. 19A,29 and 30) of the linear panel 311 to cover the longitudinal ends 311*a*,311*a*. As seen from FIG. 26A, a wall 372 of the corner base member 370 typically has a substantially uniform or constant thickness of, for example, about 2–3 mm except a part thereof. Therefore, a lower surface 373 of the wall 372 is configured generally similarly to the surface of the linear panel 311 and has substantially the same flow-guide, flow-resistance and deflection functions with respect to the conditioning airflow.

The corner base member 370 comprises a corner base body portion 380 and a corner base outer frame portion 384 integral with the corner base body portion 380. The corner base body portion 380 comprises a plate-like member having a typically generally uniform thickness and a square shape in a plan view, in which one corner part 381*a* of the square is curved in the form of circular arc.

The corner base body portion 380 is configured mirror-symmetrical about a virtual plane including a diagonal line D, passing through both the arcuately curved corner 381*a* and an opposite corner 381*b* cut out in the.form of small square, and extending perpendicular to a plane (plane of FIG. 26B) of the body portion 380. Sides or edges 382*a*, 382*b* including the corner 381*b* are superposed on the adjacent edges or ends 311*a*,311*a* of the adjacent linear panel structures 311, while sides or edges 382*c*,382*d* including the curved corner 381*a* are connected integrally with the corner base outer frame portion 384.

The corner base body portion 380 comprises a plate portion 374 having a plane surface part 374*u* superposed on the lower face 328 of the guide plate portion 326 of the linear base member 320 of the linear panel structure 311, a downwardly convex upstream flow-resistant projection portion 375 having a concave surface part 375*u* complementary in shape to the surface of the flow-resistant projection portion 359 of the linear cover member 340 of the linear panel structure 311 to be exactly superposed thereon, an upstream arcuately curved guide portion 376 having an arcuate surface part 376*u* complementary in shape to the surfaces of the plate portion 353 and upstream arcuate guide portion 351 of the linear cover member 340 to be exactly superposed thereon, a downwardly convex flow-resistant projection portion 377 of circular arc cross-sectional shape having a concave surface part 377*u* complementary in shape to the surface of the flow-resistant projection portion 349 of the linear cover member 340 to be exactly superposed thereon, and an upstream deflection induction portion 378 serving as a part of the concave deflection induction portion having a convexly arcuate surface part 378*u* complementary in shape to the deflection induction portion 347 of the linear cover member 340 to be exactly superposed thereon. Each portion 375,376,377,378 has, in a plan view (strictly, bottom view) of FIG. 26B linearly extending parts 375*a*,376*a*,377*a*, 378*a* and 375*b*,376*b*,377*b*,378*b*, and a circular arc part 375*c*,376*c*,377*c*,378*c* connecting the linearly extending parts smoothly with each other.

In addition, the corner base body portion 380 has legs 383 in the form of a rib extending from a rear face (upper face) thereof to support the plane of the body portion 380 parallel to the ceiling surface 201. In an embodiment illustrated in FIG. 27, the legs 383 comprises three leg parts 383*p*,383*q*, 383*r*. Each leg part 383*p*,383*q*,383*r* extends, in the plane of FIG. 27, in an "L" shaped-pattern, while leg parts 383*p*,383*q* are arcuately curved around regions crossing the virtual diagonal line D. The number of leg parts constituting legs 383 may be much more or much less than three, and may be intermittently distributed instead of being continuously extended.

A plate portion 374 providing the most upstream guide face of the corner base member 380 is generally square. At a side corresponding to the circular arcuate corner part 381*a* of the body portion 380, the plate portion 374 has a similar circular arcuate corner part 374*r* (of smaller radius) and a cut-out part 374*c* defined by cut-out lines 374*a*,374*b* at a corner corresponding to the cut-out corner 381*b* of the body portion 380. In addition, the plate portion 374 has a square leg part 383*s* protruding from the side of the upper face 374*u* at the cut-out part 374*c*. The square leg part 383*s* is connected integrally at two side edges thereof with the cut-out edges 374*a*,374*b* of the plate portion 374, and defines, cooperatively with the other leg parts 383*p*,383*q*,383*r*, a leg face or abutting plane of the corner base member 380 with respect to the ceiling surface 201.

Further, the plate portion 374 has, in the upper face 374*u* thereof, grooves 374*g* at regular intervals, serving as the weakened parts for facilitating cutting thereof for size-adjustment, similar to the grooves 327 of the guide plate portion 326 of the linear base member 320 of the linear panel 311. The plate portion 374 also has a rib-like projection 374*p* on the lower face 374*d*, similar to the projection 327*d* of the guide plate portion 326 of the linear base member 320.

The corner base member 370 includes a support wall 378*s*, extending continuously from the end of the upstream deflection induction portion 378 and having an extended end (lower end) 378*t* for supporting the corner cover member 390, at a region except for the regions near the edges 382*a*,382*b* superposed on the edge 311*a* of the linear panel 311. A cut-out portion 378*f* is defined by an end 378*w* of the support wall 378*s* and the lower end 378*u* of the upstream guide portion 378 of the deflection induction portion. The cut-out portion 378*f* allows the downstream part 347*b* of the deflection induction portion 347 and the vertical guide portion 345 of the linear panel structure 311 to project therethrough slightly downwardly at the ends 311*a* thereof (FIG. 31A), when the corner base member 370 is superposed on the linear panel 311.

The corner base outer frame portion 384 comprises, when viewed in a plane parallel to an extending plane of the corner base body portion 380 (e.g., FIG. 26B), an outer frame body portion 385 extending generally in an "L" shape along the two right-angled side edges 382*c*,382*d*, of the body portion 380, connected to each other at the arcuate corner 381*a*. More specifically, the outer frame body portion 385 comprises a linear part 385*b*,385*a* extending parallel to the sides 382*a*,382*b*, and an arcuate part 385*c* between the two linear parts 385*a*,385*b*. The parts 385*a*,385*b* and 385*c* of the outer frame body portion 385 are integrally connected at respective lower ends thereof with linear parts 378*sa*,378*sb* and an arcuate part 378*sc* of the vertically extending wall 378*s* of the corner base body portion 380 through the corresponding linear parts 386*a*,386*b* and arcuate part 386*c* of a horizontal connection portion 386. End faces 386*a* t and 386*b* t (not shown) of the horizontal connection portion 386 is also cut out to be substantially flush with the end face 378*w*. The outer frame body portion 385 is inclined to spread out slightly from the lower end thereof toward the upper end to be situated more remote from the air-conditioning apparatus 200 as approaching the ceiling surface 201, similar to the vertical inclined wall portion 341 of the linear cover member 340 of the linear panel 311, and has a wide leg part 387 at the upper end thereof. The leg part 387 is adapted to abut against the ceiling wall 201 at the upper end, and has linear parts 387*a*,387*b* and an arcuate part 387*c* therebetween to be configured, in plan view, in the shape of an "L". Reference characters 384*h*,384*g*,384*s* denote respectively a screw hole for mounting the corner base member 370, a recess for allowing a tool such as a screw driver to be inserted thereinto for mounting/removing the screw through the screw hole 384*h*, and a partially cylindrical wall part defining therein the recess 384*g*. It is preferred that each screw hole be configured as an elongated hole or an elongated-circular hole 384*hi*, as shown by an imaginary line for one of the holes in FIGS. 26B and 27, to enhance a degree of freedom for selecting the mounting position of the ceiling panel structure 310 on the ceiling surface 201 without considering positioning thereof relative to support frames at the back of, i.e. behind, the ceiling. Such being the case, associated screw-mounting tool insertion recess 384*gi* and recess-defining wall portion 384*si* are also shaped, as a matter of course, into an elongated-circular form as shown by the imaginary lines.

Figure 31A:
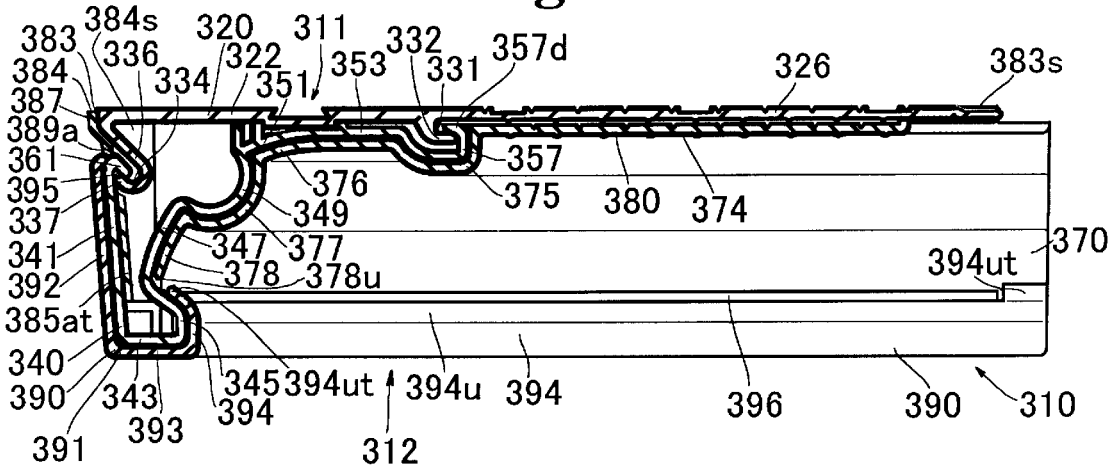
Figure 31B:
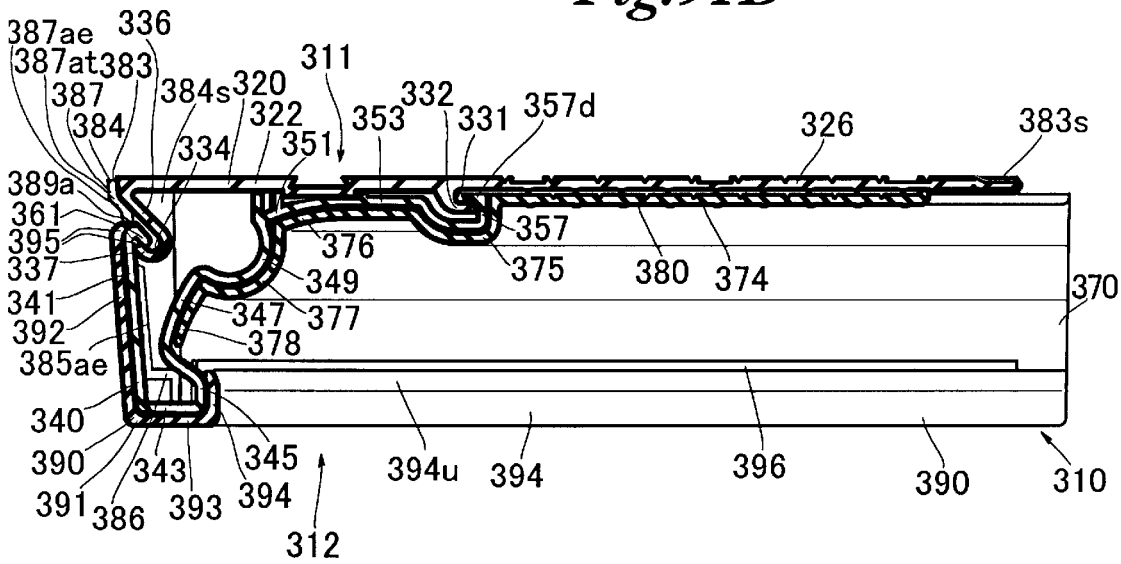

The leg part 387 of the corner base outer frame portion 384 extends to a region to be flush with the edges 382*a*,382*b* of the corner base body portion 380 so that free ends 387*ae*,387*be* of the linear parts 387*a*,387*b* defining both sides or legs of an "L" are engaged respectively with adjacent edges 333 of the linear base members 320 of the linear panels 311. Meanwhile, as shown in FIG. 31B, the free ends 387*ae* and 387*be* (not shown) of the leg part 387 may be cut to be flush approximately with the end face 386*at* and 386*bt* (not shown). In addition, the body portion 385 of the corner base outer frame 384 has thin walled protrusions 385*at*,385*bt* protruding from the free ends 385*ae*,385*be* of the linear part 385*a*,385*b* so that they may be slightly inserted into recesses between wall portions 341,347 defining the two leg parts of the U-shaped portion 340*u* of the linear cover member 340 of the linear panel 311. However, there may be a possibility that the thin wall protrusions 385*at*,385*bt* may prevent or adversely affect the ease of mounting the corner base member 370. Therefore, there are not a few configurational cases where the protrusions 385*at*, 385*bt* should be omitted. Thus, in a case where the protrusions 385*at*,385*bt* are formed, the lengths thereof should be minimized or the corners thereof should be preferably cut obliquely to enable the mounting/detaching of the corner base member 370 with ease, in comparison with the projections 385*at*,385*bt* exaggeratedly largely shown in the illustrated embodiment. In this connection, FIG. 31A shows an example in which the thin walled protrusion 385*at* is formed, while FIG. 31B shows an example in which the protrusion 385*at* is omitted. The corner base outer frame portion 384 further comprises, at an outer face of the body portion 385 thereof, an engaging recess 389 (FIG. 25A) with which the corner cover member 390 is engaged. In an embodiment illustrated in FIG. 26C, the engaged recesses 389*a* and 389*b* (not shown) at both ends are configured in the form of recess in free ends of the outer frame body part 385, while each of the intermediate cut-out 389*c* and 389*d* (not shown) is configured in the form of an aperture. However, for facilitating the mounting/detachment of the corner cover member 390, each cut-out part 389*c*,389*d* may be in the form of a shallow groove where one of the two cut-out parts or grooves may be omitted. The arrangement of the parts can be determined according to the number of parts. Further, each of the engaging recesses 389*a* and 389*b* (not shown) at both ends may be configured in the form of an aperture enclosed completely by a circumferential wall thereof instead of the cut-out part opened in at least one side thereof.

The corner cover member 390 comprises, as shown in FIGS. 28A–B,25A–B and 24A–B, a corner cover body portion 391 having as a whole a generally L-shaped configuration and a U-shaped cross-section, whereas one of two legs of the "U" is much shorter than the other of the two legs. The body portion 391 comprises a generally L-shaped long outer wall portion 392, a generally L-shaped end wall portion 393 extending from one (lower) end of the outer wall portion 392 almost perpendicular thereto (at a slightly obtuse angle), and a generally L-shaped short inner wall portion 394 extending from one (inner) end of the end wall portion 393 generally perpendicular thereto. More specifically, as shown in FIGS. 28A–B, the outer, end and inner wall portions 392,393,394 have respectively two linear wall parts 392*a*,393*a*,394*a* and 392*b*,393*b*,394*b* and circular arcuate wall parts 392*c*,393*c*,394*c* connecting the associated two linear wall parts 392*a*,393*a*,394*a* and 392*b*,393*b*,394*b* at regions therebetween. The outer wall portion 392 has, at an inner edge of the upper end thereof, an engaged projection portion 395 to be engaged with the cut-out portion 389 of the corner base member 370. In the illustrated embodiment, the projection portion 395 comprises substantially the same shape as projections 395*a*,395*b* protruding at an acute angle relative to the outer wall portion 392, and substantially the same shape as projections 395*c*,395*d* protruding at an approximately right angle relative thereto to be engaged respectively with the cut-out parts 389*a*, 389*b* (not shown), 389*c* and 389*d*. One of the projections 395*c*,395*d* may be omitted for facilitating detachment of the corner cover member 390, if desired. In addition, the inner projections 395*c*,395*d* may be configured in the form of an arcuate projection 395*f* projecting at an obtuse angle relative to the outer wall part 392 as shown in FIG. 28C to facilitate release of the engagement.

The corner cover body portion 391 has, on an inner face of the end face 393 thereof, a thin side wall 396 extending in the form of an "L" and being spaced by a generally constant distance from the inner wall portion 394. Reference character 396*r* denotes a rib supporting the side wall 396. The side wall 396 terminates before reaching regions where the corner cover body portion 391 covers the adjacent linear panel structures 311. The inner side wall 396 may be omitted. The end wall of the corner cover body portion 391 abuts against the lower end 378*t* of the extended wall part 378*s* of the corner base member 370 when the corner cover member 390 is put on the corner base member 370.

The L-shaped inner wall portion 394 of the corner cover body portion 391 comprises a band-like edge 394*u* bent outward (toward the inside of the "U") at upper parts of wall portion 394. The band-like edge 394*u* faces through a narrow gap to the wall part 378*s* extended from the lower end of the arcuate deflection wall portion 378 of the corner base member 370 when the corner cover member 390 is put on the corner base member 370, and serves as a lower part of the deflection induction portion. The L-shaped band-like edge part 394*u* comprises, at both of the longitudinal ends thereof, protrusion walls 394*ut*,394*ut*. The protrusion walls 394*ut*,394*ut* of the inner wall portion 394 are engaged with the downstream part 347*b* of the deflection induction portion 347 of the adjacent ends 311*a* of the linear panels 311 exposed through the cut-out part 378*f* of the corner base member 370, when the corner cover member 390 is put on the corner base member 370 in a state where the corner base member 370 has been already put on the adjacent ends 311*a* of the linear panels 311. However, the protrusion wall 394*ut* may be omitted. The embodiment with the wall 394*ut* is shown in FIG. 31A, while the embodiment without the wall 394*ut* is shown in FIG. 31B.

The corner panel 312 is mounted in such a manner as to be laid on the adjacent linear panels 311,311 after the linear panels 311,311 of predetermined lengths and predetermined widths have been mounted at predetermined positions. More specifically, at first, the corner base member 370 is attached so that the edges thereof 382*a*,382*b* are superposed on the adjacent ends 311*a*,311*a* of the linear panels 311,311 extending perpendicularly to each other. Thus superposed length of each of the edges 382*a*,382*b* of the corner base member 370 on each adjacent end 311*a*,311*a* of the linear panel 311,311 is selected to not be greater than a length or distance LE (FIG. 27) from each of the cut-out end 378*w* at the cut-out 378*f* and the end of the leg 383 for each associated edge 382*a*,382*b*. In other words, what is required is to have at least minimum superposition that should not be greater than LE. The length LE corresponds to the maximum tolerance (strictly, a half thereof) for the length of the linear panel 311. When the corner base member 370 is superposed on the linear panel 311 from the lower side, the corner base member 370 contacts (at the wall portions 374,375,376,377, 378 thereof) the respective complementary configured wall portions 326,357,353,349,347*a* of the linear panel 311 and at the leg 383 thereof against the ceiling surface 201, and is engaged at the leg 387 of the outer frame portion 384 with the end 333 of the linear panel 311 (refer to FIGS. 31A–B). In a case where the thin wall protrusions 385*at*,385*bt* are provided, for example, the corner cover member 370 is inclined in such a manner that the diagonally outer corner 381*a* is closer to the ceiling surface 201 than the diagonally inner corner 381*b*, and the legs 387,387 of the outer frame portion 384 are engaged with the adjacent ends 311*a*,311*a* of the linear panels 311,311 while inserting the thin wall protrusions 385*at*,385*bt* from the diagonally outer side. The diagonally inner corner 381*b* is then displaced closer to the ceiling surface 201 to complete the above-mentioned superposition. Then, as described above, the corner cover member 390 is superposed on the corner base member 370 so that the engaged projections 395 of the corner cover member 390 can be engaged with the engaging recesses 389 of the corner base member 370.

Now, the mounting of the thus constructed ceiling panel structure 310 on the ceiling surface is to be described.

At first, it is determined whether obstacles are present on the ceiling 201*a* round the air-conditioning apparatus 200. For example, suppose that an obstacle 202*a* is present, at the position G of FIG. 2, as shown in FIG. 18A. The width of the linear base member 320 is adjusted in the same manner as described with respect to the linear base member 20 if required. In this example, we assume, as shown in FIGS. 18A–B, that the obstacle 202*a* is situated remote enough and, therefore, that the linear base member 320R is cut along the widthwise outermost groove 327*a* (FIG. 20 etc.) to have the standard maximum width or can be used or applied without being cut. We further assume herein that there is not any other obstacle 202 on the ceiling surface 201 around the air-conditioning apparatus 200. If another obstacle 202 is present, the width of the linear base member 320 of the linear panel 311 to be mounted at the associated position is adjusted utilizing the grooves 327 depending on the position of the obstacle 202.

Then, the lengths of the linear panels 311R,311L,311U and 311D are adjusted. More specifically, the linear panels 311R,311L,311U,311D are respectively cut to be equal to the lengths of the side edges of the air-conditioning apparatus 200 along which they are disposed. In a case where a part of the linear panel 331 (e.g., 311U or 311D) is inserted between the ceiling surface 201 and the side wall or smoothly planed board of the air-conditioning apparatus 200, the corner panel 312 (e.g., 312RU or 312RD) is shifted in the vertical direction in FIG. 18A along the ceiling surface 201. Therefore, the length of the linear panel 311 (e.g., 311R) is appropriately adjusted according to the inserted length of the widthwise inner end of the adjacent linear panel 311 (e.g., 311U or 311D). Similarly, sizes of the other linear panel 311 and corner panel 312 are adjusted. In this example, however, we assume that all the linear and corner panels 311,312 are of the standard width, and that the widthwise inner end is not inserted between the air-conditioning apparatus 200 and the ceiling surface 201. Therefore, it is not necessary to cut any of them along the groove.

Then, four linear panels 311 are mounted at their predetermined positions according to the widths and lengths thereof on the ceiling 201, and the corner panels 312 are mounted at their predetermined corners so as to be superposed on the edges or ends 311*a* of the linear panel 311. Upon mounting each linear panel 311, the associated linear base member 320 is provisionally fixed on the ceiling 201 using a few (e.g., about 2–3) screws inserted through the elongated holes. Then, the linear cover member 340 is attached to the linear base member 320 so that a pair of engaged portions thereof are engaged with a pair of engaging portions of the linear base member 320 as described before. Further, the corner base member 370 of the corner panel 312 is put on the edges of the adjacent linear panel 311 among the four linear panels 311R,311L,311D,311U and is provisionally fixed to the ceiling surface 201 by a fixing means, such as screws. Thus, four corner base members 370 are provisionally fixed and the entire arrangement thus assembled is checked from the floor.

Figure 3:
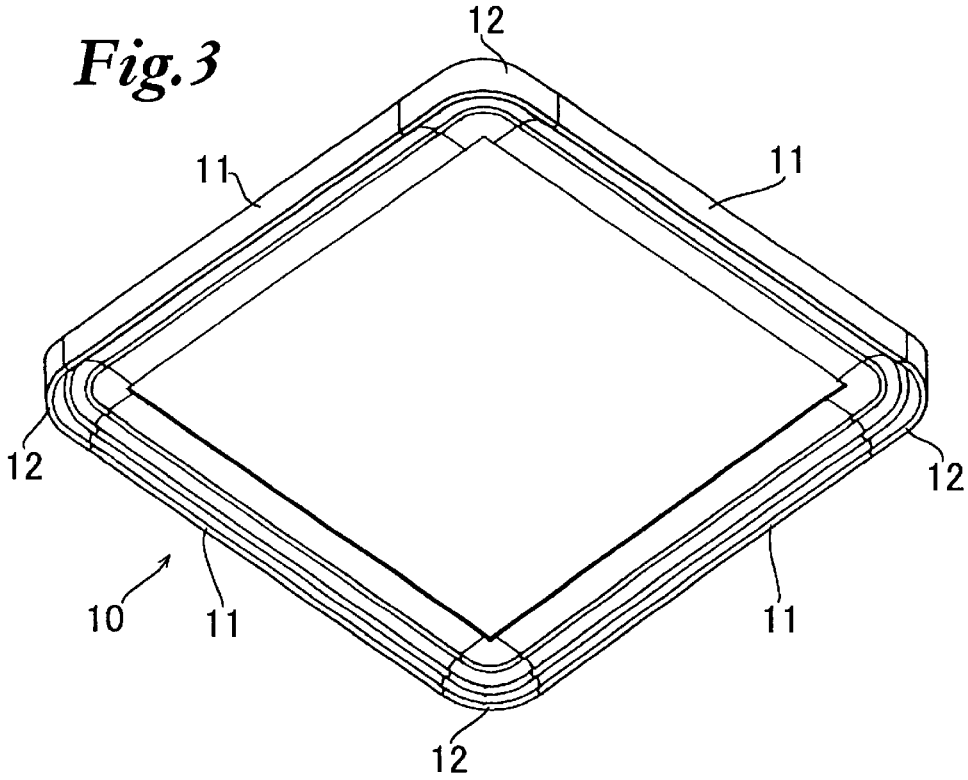
FIG. 3 is an explanatory oblique view of a ceiling panel structure, as viewed from an obliquely lower position, according to one preferred embodiment of the invention.
Figure 5A:
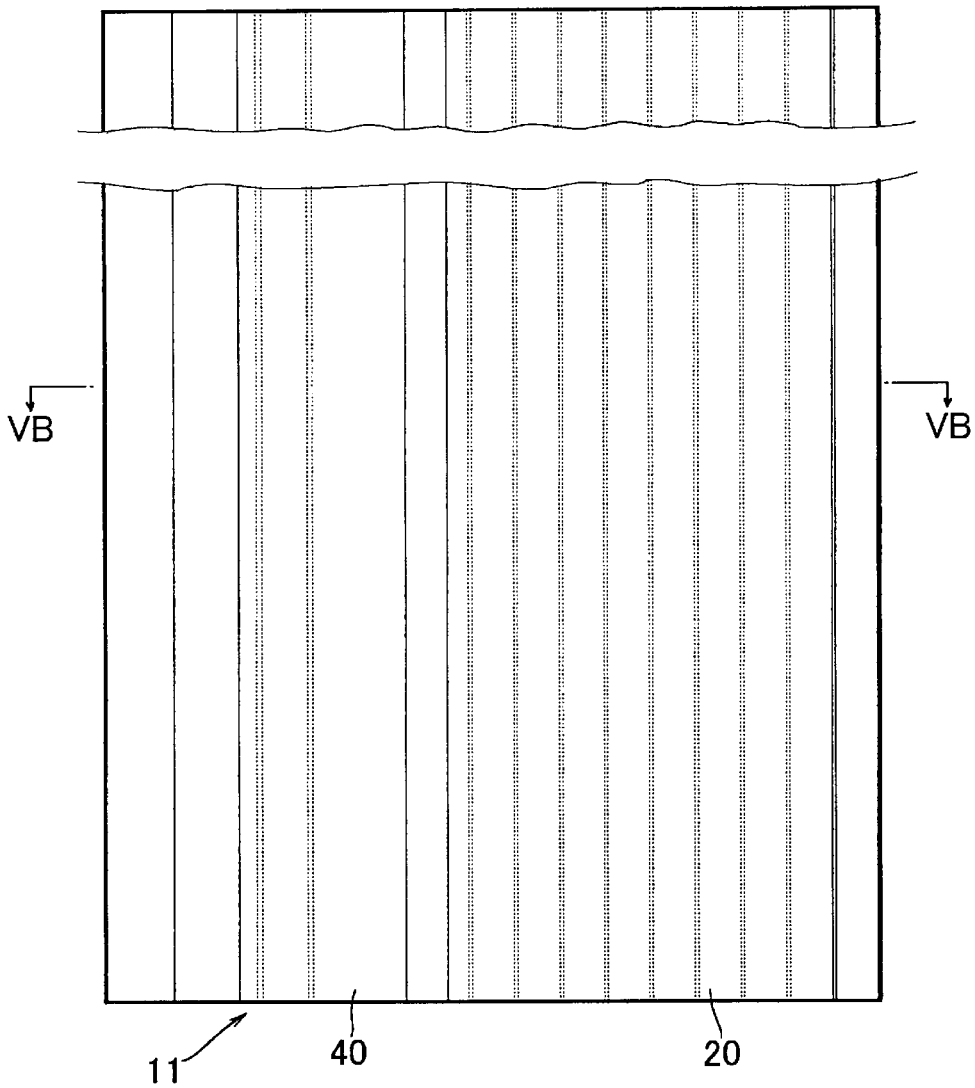
Figure 5B:
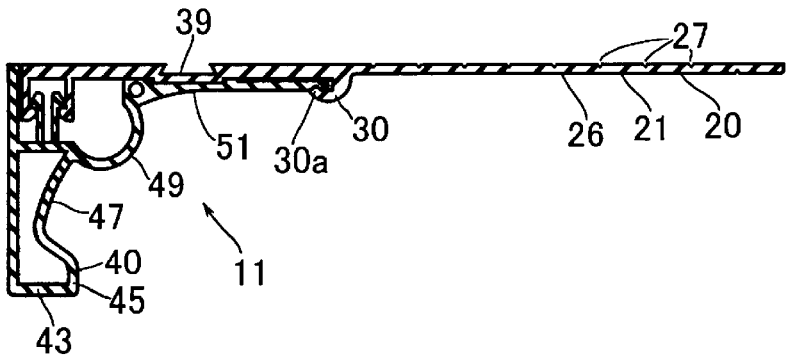

For example, in a case where the longitudinal position of the linear panel 311 is not appropriate, corner base panels 312 put on the inappropriately positioned linear panel 311 in question and provisionally fixed to the ceiling surface 201 are detached, and then the linear cover member 340 of the linear panel 311 in question is disengaged from the linear base member 320 thereof. The U-shaped portion 340*u* of the linear cover member 340 is then pressed toward the ceiling surface 201 to expand the leg portion 341 of the "U" to displace the engaged projection 361 thereof along the inclined face 336*b* to be disengaged as described before. Meanwhile, because each of the linear cover and base members 340,320 is configured to be produced by extrusion molding, i.e., in the constant or uniform cross-sectional shape, the linear cover member 340 may be disengaged from the linear base member 320 by drawing or pushing the member 340 in the longitudinal direction thereof relative to the member 320. Then, the screws are loosened to allow the linear base member 320 to be displaced or shifted to a new provisional fixing position. Thereafter, the linear cover member 340 and corner base member 370 are superposed again to be provisionally fixed. If desired, when the corner base member 370 is disengaged or when some of the corner base members 370 are provisionally fixed, the linear panel 311 as provisionally fixed by the screws through the elongated holes may be hit with a hammer or the like to adjust the longitudinal position thereof. Thus, when the width, length and mounting position of each linear panel 311 are finally determined, the linear cover members 340 are disengaged again, and each linear base member 320 is fixed to the ceiling surface 201 at a predetermined number of positions by screws or the like. Further, the linear cover members 340 are engaged with the associated linear base members 320 to be fixed thereto, thereby completing the mounting of the four linear panels 311. Then, the corner base members 370 having been adjusted to predetermined sizes if necessary are superposed on the associated adjacent ends of the linear panels 311,311 and fixed to the ceiling surface 201. Finally, the corner cover members 390 are put on the four corner base members 370 to complete the corner panels 312, thereby completing the assembly of the ceiling panel structure 310. The ceiling panel structure 310 thus mounted also looks as shown in FIG. 3 when viewed in an oblique view.

In the meantime, the ceiling surface 201 on which the ceiling panel structure 310 is to be mounted as described above is, however, not completely planar, i.e., not an ideal plane, but is more or less undulated or irregular in comparison with the ideal plane. In a case where the air-conditioning apparatus 200 is relatively large in size and has a length of, for example, about 2 meters, the undulation or irregularity of the ceiling surface 201 may not be negligible. In the ceiling panel structure 310 according to a preferred embodiment of this aspect of the invention, however, because most of the parts of the linear base member 320 is constituted by plate-like portions, because the length or height of the projection or protrusion portions of the plate-like portions of the linear base member 320 perpendicular thereto are relatively short while the width thereof is relatively narrow, and because the projection or protrusion portions extend over the whole length of the linear base member 320, the linear base member 320 can be relatively flexible in the directions Q1,Q2 in FIG. 20. Therefore, even in a case where the ceiling surface 201 is undulated in the longitudinal direction of the linear base member 320, the linear base member 320 can be mounted on the ceiling surface 201 while being deformed along or according to the undulation of the ceiling surface 201.

Then, when the linear cover member 340 is engaged with and fixed to the linear base member 320 having been undulated along the longitudinal direction thereof, the engaged projection 357*d* of the linear cover member 340 having the inwardly tapered wedge-like distal end is fitted by force into the inwardly widely opened engaging recess 331 of the linear base member 320 along the plane 328 of the guide plate portion 326 of base member 320. Fitting of the tapered engaged projection 357 into the widely opened engaging recess 331 is ensured even when the linear base member 320 is undulated to some extent, by pushing or drawing the engaged projection 357*d* along the plane of the guide plate portion 326 of the linear base member 320. Meanwhile, because both the engaged projection 357*d* of the linear cover member 340 and the projecting wall part 332 of the engaging recess 331 of the linear base member 320 extend continuously along the longitudinal direction of the members 340,320, even assuming that there should be areas where the fitting or insertion cannot be easily performed, according to the progress of the engagement (i.e., increase in the insertion depth of the projection into the associated recess) at regions continuously adjacent to the not-easily-inserted areas, the not-easily-inserted areas of the engaged portion 357 of the linear cover member 340 can be gradually deformed to be undulated in the direction(s) Q1,Q2 (refer to FIG. 22). Thus, the fitting or insertion at the not-easily-inserted areas can proceed. Herein, it should be noted that some extent of flexion or bending of the linear cover member 340 can be generated because the length of projection of the engaged portion 357 of the linear cover member 340 from the generally plate-like portions 353,351 of the cover member 340 in a direction perpendicular to the cover member 340 is relatively short, although the engaged portion 357 is generally not easily flexed or bent to be undulated in the longitudinal direction in comparison with the simple plate. When the engaging recess 331 is opened to be wider widthwise inwardly, the engaged projection 357*d* need not be wedge-like or not tapered. When the engaged projection 357*d* is tapered or has a wedge-like shape, the engaging recess may be opened to have a constant width in the widthwise direction.

After completing the engagement of the engaged projection 357*d* with the engaging recess 331, the widthwise outer engaged projection 361 of the linear cover member 340 is engaged with the widthwise outer engaging recess 334 of the linear base member 320. As for this engagement, there is actually an allowance or tolerance in the vertical position of the projection 361 relative to the engaged recess 334 by a height corresponding to the length of the upper inclined face 336*b*. Therefore, some degree of undulation can be absorbed or compensated for by variation in the vertical position of the projection 361. In addition, deviation of the widthwise position of the engaged projection 361 associated with the displacement or deviation in the vertical position can be absorbed or compensated for by flexure or bending of the U-shaped portion 340 of the linear cover member 340 in the direction B1 or B2.

Thus, even in the case where the ceiling surface 201 is undulated, the engagement of the linear cover member 340 with the linear base member 320 is ensured so that the linear cover and base members 340,320 can be assembled into the linear panel 311. Meanwhile, undulation of the ceiling surface 201 can be substantially negligible within a narrow region defined by the sizes of the corner panel 312.

Figure 32:
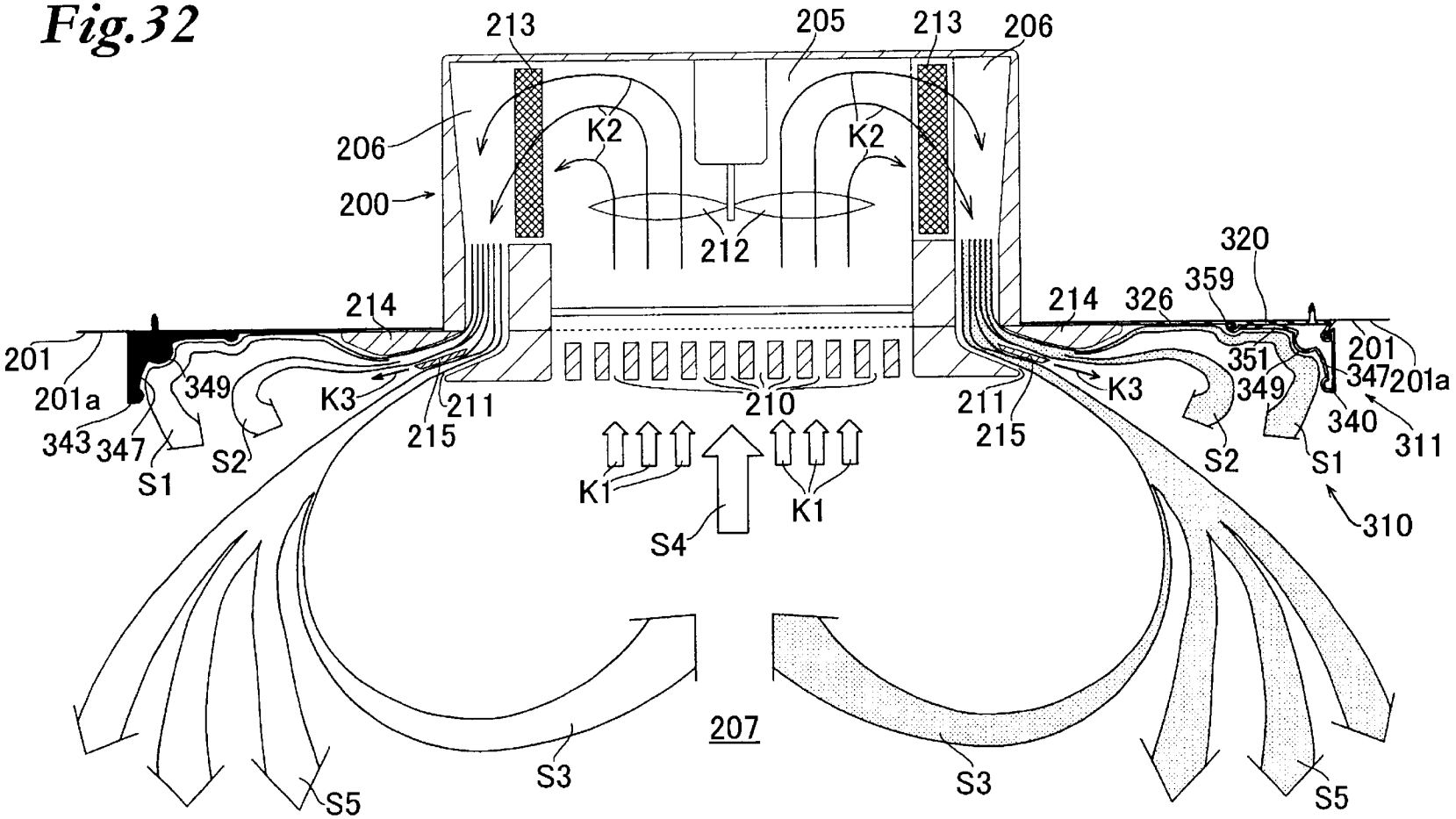
FIG. 32 is a diagrammatic sectional view illustrating a state of flow of conditioning air adjusted by ceiling panel structure of FIG. 18A according to the preferred embodiment of one aspect of the invention.
Figures 33A, 33B, 33C, 33D, 33E, 33F:
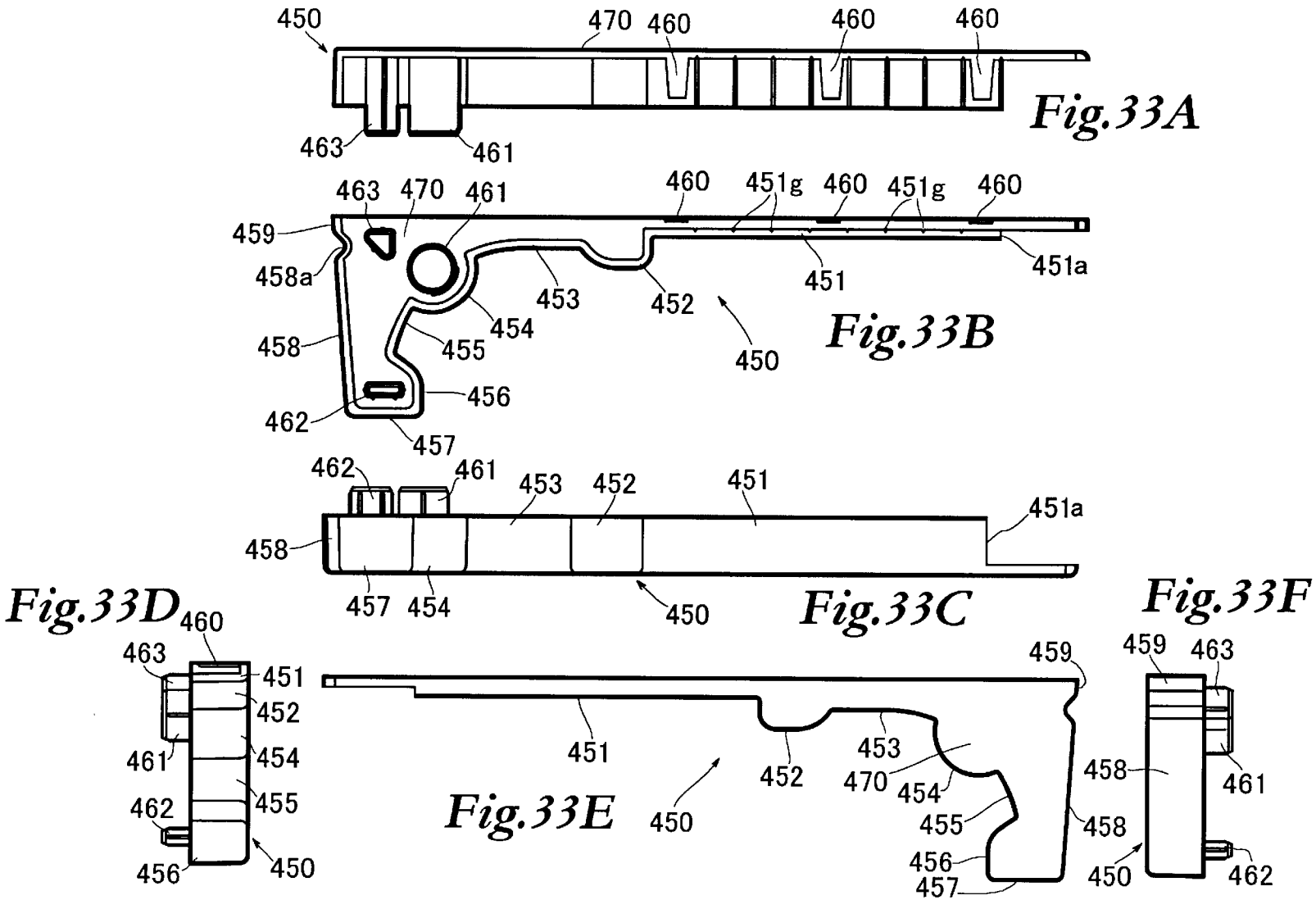

The function of the ceiling panel structure 310 upon operation of the air-conditioning apparatus 200 is illustrated in FIG. 32, and is substantially the same as FIG. 13 for the ceiling panel structure 10. Therefore, a detailed description is omitted to avoid repetition. The description of the function of the ceiling panel structure 10 can be applied to the description for the ceiling panel structure 310 of FIG. 32, only if elements of the ceiling panel structure 10 in FIG. 13, such as the guide plate portion 26, the flow-resistant projections 30,49, the guide portion 51, the deflection guide wall portion 47 and the lower end 43 of the linear panel 11 and the corner panel 12, are substituted respectively by corresponding elements of the ceiling panel structure 310, such the guide plate portion 326, the flow-resistant projections 359,349, the guide portion 351, the deflection guide wall portion 347 and the lower end 343 of the linear panel 311 and the corner panel 312.

As described before, in a case where the air-outlet is provided, for example, along two parallel sides or only along one side of the quadrilateral air-conditioning apparatus as in the one-way (or unidirectional flow type) or two-way (or two-directional flow type) of ceiling-mounted air-conditioning apparatus, the linear panel structure may be mounted only along the sides adjacent and opposed to the air-outlets, preferably over a range longer than that of the air-outlets.

In this regard, when the linear panel 311 is mounted without the corner panels 312, an end cap 450 as shown in FIGS. 33A–F is fitted on around either end of the linear panel 311. The end cap shown in FIGS. 33A–F is configured to be fitted on one end (right end when viewed toward downstream of the airflow) of the linear panel 311 and the end cap for another (left) end thereof should be, as a matter of course, configured mirror symmetrical with respect to the end cap 450 shown in FIGS. 33A–F, the detailed description of which is omitted herein.

The end cap 450 comprises an end wall portion 470 and projecting portions projecting from an inner face thereof, such as projecting wall portions and projection portions, and is configured to be fitted on and around the end portions 311*a* (FIG. 19A) of the linear panel 311. More specifically, lower wall portions 451,452,453,454 of the end cap 450 are configured substantially the same, respectively, as the associated wall portions 374,375*a*,376*a*,377*a* of the corner base member 320 of the corner panel 312. Lower wall portions 455,456,457,458,459 have inner faces, respectively, configured to be complementary with the outer faces of the associated wall portions 347,345,343,341,333 of the linear panel 311. Between the wall portions 458,459 is formed a concave wall portion 458*a*, an inwardly convex inner face of which contacts a concave face defined by an inclined face near the distal end 341 of the linear cover member 340 of the linear panel 311 and by the inclined face 336*b* of the linear base member 320 (refer for example to FIG. 19B as to the shape or configuration of the linear panel 311). Grooves 451*g* are formed at regular intervals in an inner face of the wall portion 451, for allowing adjustment of a widthwise length of wall portion 451 according to the width-adjustment of the linear panel 311. Upper projections 460 are engaged with the recess 327*c* in the upper face of the linear panel 311. Each projection 460 has a width smaller than that of the recess 327*c*, and is relatively long and tapered toward the distal end. Therefore, the end cap 450 can cover the end of the linear panel 311 even in a case where the end is cut along a direction which deviates to some extent from the direction perpendicular to the longitudinal direction. In addition, even in a case where lengths of the linear base member 320 and linear cover member 340 of the linear panel are different to some extent from each other, the difference can be covered by the wall portions 451–459 of the end cap 450. Although the end cap 450 has three upper projections 460 in the illustrated embodiment, the number may be much greater or smaller. The end cap 450 further comprises, on the end wall 470, a cylindrical projection 461 to be fitted in a recess defined by the partially cylindrical wall portion 349 among recesses of the U-shaped portion 340*u* of the linear cover member 340 of the linear panel 311, a tubular projection 462 of a generally quadrilateral cross-section to be fitted in the lower recess defined by parts of the wall portions 345,343, 341 near lower ends thereof, and a tubular projection 463 having a generally triangular cross-section to fit in a triangle space or cavity portion defined by the wall portion 336 and the main plate portion 322 of the linear base member 320.

The end cap 450 and another end cap mirror symmetrical thereto are fitted on and around the respective ends the linear panel 311, after the linear panel 311 has been mounted on the ceiling surface at the predetermined position and after the end caps have been adjusted in size to be adapted to the width of the linear panel 311, thereby completing the linear panel structure apparatus. The lower wall portion 451 of the end cap 450 is cut out at a distal end 451*a* thereof and, therefore, a narrow part of the end wall portion 470 situated more upstream than the distal end 451*a* can be inserted into between the ceiling surface 201 and the outer frame such as a smoothly planed board of the air-conditioning apparatus 200. In a case where the projection 327*e* (imaginary line in FIG. 20) is formed on the surface 328 of the linear base member 320 of the linear panel 311, the cut-out end 451*a* abuts the downstream face of the projection 327*e*. If desired for regulating or suppressing airflow flowing over the end cap 450 in the longitudinal direction of the linear panel 311, the wall portions 451–456 may be curved similarly to the corner base member 370, to be situated more upstream as approaching closer to the end wall portion 470.

The description of the preferred embodiments heretofore have been made based on an assumption that the ceiling panel structure 310, i.e., panel 311 and/or panel 312, is mounted or installed on the ceiling surface 201 downstream of the air-outlet 211 of the ceiling mounted air-conditioning apparatus having the room air-inlet 210 at the central portion thereof and the conditioning air-outlet at the peripheral portion thereof. However, the features of the ceiling panel structure 310, i.e., panel 311 and/or panel 312, is also effective, except for a part of the conditioning air is returned to the air-inlet 210, even in a case where the structure is mounted or installed on or embedded in the ceiling surface 201 downstream of the conditioning air-outlet 211 of an conditioning air discharge or blowout apparatus having only the air-outlet 211, i.e., having no air-inlet at the ceiling surface 201, instead of the ceiling-mounted air-conditioning apparatus 200. Therefore, the ceiling panel structures, such as those illustrated in the drawings hereinbefore, according to the embodiments of the invention can also be applied to the ceiling-mounted or embedded type of conditioning air discharge apparatus, such as the air-conditioning duct having an air-outlet with an aperture at the ceiling surface, in which the whole region of the aperture serves as the air-outlet or air discharge aperture but not as the air-inlet. Therefore, smudging or contamination of the ceiling surface 201 around the apparatus can be minimized or eliminated. A typical conditioning air discharge apparatus includes, for example, one having plural coaxial and circular or annular discharge apertures between adjacent hollow frusto-conical discharge passage-defining walls known as "anemometer" as shown in FIG. 1G. For the apparatus having a circular outer circumference, a further guide plate may be added to cover a ceiling surface between the circular conditioning-air-discharge apparatus and the inner edge of the quadrilateral or square ceiling panel structure, if desired.

What is claimed is:

1. A ceiling panel structure to be mounted to a ceiling surface downstream of an air outlet of a ceiling-mounted air-conditioning unit, the air-conditioning unit having a central air inlet and having the air outlet arranged at a periphery of the air inlet, said ceiling panel structure comprising:

a plurality of linear panels, each of said linear panels including:

a base member having a first side surface and a second side surface opposite said first side surface, said base member to be mounted to the ceiling surface so as to extend along a corresponding linear side edge of the air-conditioning unit with said first side surface against the ceiling surface, said base member having an engaging portion at said second side surface, and having an adjustable length and width; and a cover member having an adjustable length, having an engaging portion for engaging said engaging portion of said base member so as to fix said cover member to said base member, and having a substantially rigid deflection induction portion for deflecting a portion of the conditioned air discharged from the air outlet of the air-conditioning unit back toward the air inlet of the air-conditioning unit; and a plurality of corner panels, each of said corner panels being operable to engage ends of adjacent linear panels when positioned between said ends of said adjacent linear panels.

2. The ceiling panel structure of claim 1, wherein each of said corner panels includes a base member having engaging portions, and includes a cover member having engaging projections for engaging said engaging portions of said base member so as to fix said cover member to said base member.

3. A ceiling panel structure to be mounted to a ceiling surface downstream of a periphery of an air outlet of a ceiling-mounted conditioning-air-discharge apparatus, the air outlet being arranged at the ceiling surface, said ceiling panel structure comprising:

a plurality of linear panels, each of said linear panels including:

a base member having a first side surface and a second side surface opposite said first side surface, said base member to be mounted to the ceiling surface so as to extend along a corresponding linear side edge of the conditioning-air-discharge apparatus with said first side surface against the ceiling surface, said base member having an engaging portion at said second side surface, and having an adjustable length and width; and a cover member having an adjustable length, having an engaging portion for engaging said engaging portion of said base member so as to fix said cover member to said base member, and having a substantially rigid deflection induction portion for deflecting a portion of the conditioned air discharged from the air outlet of the conditioning-air-discharge apparatus away from the ceiling surface; and a plurality of corner panels, each of said corner panels being operable to engage ends of adjacent linear panels when positioned between said ends of said adjacent linear panels.

4. The ceiling panel structure of claim 1, wherein each of said corner panels includes a base member having engaging portions, and includes a cover member having engaging projections for engaging said engaging portions of said base member so as to fix said cover member to said base member.

5. A ceiling panel structure comprising:

a plurality of linear panels to be mounted to a ceiling surface at a periphery of an air-conditioning outlet, each of said linear panels including:

a base member having a first side surface to face the ceiling surface and a second side surface opposite said first side surface, said base member having an engaging portion at said second side surface, and having an adjustable length and width; and a cover member having an adjustable length, having an engaging portion for engaging said engaging portion of said base member so as to fix said cover member to said base member, and having a substantially rigid deflection induction portion for deflecting a portion of the conditioned air discharged from the air outlet away from the ceiling surface; and a plurality of corner panels, each of said corner panels being operable to engage ends of adjacent linear panels when positioned between said ends of said adjacent linear panels.

6. The ceiling panel structure of claim 5, wherein each of said corner panels includes a base member having engaging portions, and includes a cover member having engaging projections for engaging said engaging portions of said base member so as to fix said cover member to said base member.

7. A ceiling panel structure to be mounted to a ceiling surface downstream of an air outlet of a ceiling-mounted air-conditioning unit, the air-conditioning unit having a central air inlet and having the air outlet arranged at a periphery of the air inlet, said ceiling panel structure comprising:

at least one panel to be mounted to the ceiling surface at an outer periphery of the air outlet of the air-conditioning unit, each of said at least one panel including an inner edge to be disposed adjacent to the air outlet, an outer edge opposite said inner edge, and a substantially rigid deflection induction portion protruding at said outer edge, said deflection induction portion being configured so as to deflect a portion of the conditioned air discharged toward said deflection induction portion from the air outlet back toward the said inner edge.

8. The ceiling panel structure of claim 7, wherein each of said at least one panel includes:

a base member having a first side surface to be mounted against the ceiling surface, having a second side surface opposite said first side surface, and having an engaging portion at said second side surface; and a cover member having an engaging portion for engaging said engaging portion of said base member so as to fix said cover member to said base member, said deflection induction portion being formed on said cover member.

9. The ceiling panel structure of claim 8, wherein said base member of each of said at least one panel comprises a corner base member to be mounted to the ceiling surface at a peripheral edge of a corner of the air-conditioning unit, and said cover member of each of said at least one panel comprises a linear cover member having a longitudinal end to be engaged with said corner base member and having an adjustable length, said at least one panel further including a corner cover member to be engaged with said corner base member adjacent to said longitudinal end of said linear cover member.

10. The ceiling panel structure of claim 8, wherein said cover member of each of said at least one panel further has a flow-resistance projection portion formed upstream of said deflection induction portion with respect to the airflow from the air outlet, said projection portion being configured to resist airflow from the air outlet so as to reduce a flow rate of the airflow from the air outlet.

11. The ceiling panel structure of claim 8, wherein said base member and said cover member of each of said at least one panel is formed of plastic material.

12. The ceiling panel structure of claim 8, wherein said base member and said cover member of each of said at least one panel is formed of substantially opaque material.

13. The ceiling panel structure of claim 8, wherein said base member of each of said at least one panel comprises a linear base member to be mounted to the ceiling surface so as to extend along at least one linear side edge of the air-conditioning unit, said linear base member having at least one of an adjustable width and an adjustable length; and wherein said cover member of each of said at least one panel comprises a linear cover member to be engaged with said linear base member and having an adjustable length.

14. The ceiling panel structure of claim 13, wherein said at least one panel comprises a linear panel including said linear base member and said linear cover member, and comprises a corner panel including a corner base member to be mounted to the ceiling surface adjacent to a longitudinal end of said linear base member and including a corner cover member to be engaged to said corner base member adjacent to a longitudinal end of said linear cover member.

15. The ceiling panel structure of claim 13, wherein said linear base member of each of said at least one panel has a conditioning airflow guide surface at a width-wise end of said second side surface closest to the air outlet of the ceiling-mounted air-conditioning unit, said engaging portion of said linear base member being arranged so as to be farther from the air outlet of the ceiling-mounted air-conditioning unit with respect to a width-wise direction of said linear base member.

16. The ceiling panel structure of claim 15, wherein said linear base member further has a flow-resistance projection portion at a width-wise outer end of said guide surface, said projection portion being configured to engage a width-wise inner end of said linear cover member, and being configured to resist airflow from the air outlet so as to reduce a flow rate of the airflow from the air outlet.

17. A ceiling panel structure to be mounted to a ceiling surface downstream of an air outlet of a ceiling-mounted air-conditioning unit, the air-conditioning unit having a central air inlet and having the air outlet arranged at a periphery of the air inlet, said ceiling panel structure comprising:

at least one panel to be mounted to the ceiling surface at an outer periphery of the air outlet of the air-conditioning unit, each of said at least one panel including:

a linear base member to be mounted to the ceiling surface so as to extend along at least one linear side edge of the air-conditioning unit, said linear base member having at least one of an adjustable width and an adjustable length;

a linear cover member to be engaged with said linear base member, said linear cover member having an adjustable length and having a substantially rigid deflection induction portion;

an inner edge to be disposed adjacent to the air outlet; and an outer edge opposite said inner edge, said deflection induction portion of said cover member protruding at said outer edge and being configured so as to deflect a portion of the conditioned air discharge toward said deflection induction portion from the air outlet back toward said inner edge.

18. The ceiling panel structure of claim 17, wherein said at least one panel comprises a linear panel including said linear base member and said linear cover member, and comprises a corner panel including a corner base member to be mounted to the ceiling surface adjacent to a longitudinal end of said linear base member and including a corner cover member to be engaged to said corner base member adjacent to a longitudinal end of said linear cover member.

19. The ceiling panel structure of claim 17, wherein said linear base member of each of said at least one panel has a conditioning airflow guide surface at a width-wise end of said second side surface closest to the air outlet of the ceiling-mounted air-conditioning unit, said engaging portion of said linear base member being arranged so as to be farther from the air outlet of the ceiling-mounted air-conditioning unit with respect to a width-wise direction of said linear base member.

20. The ceiling panel structure of claim 19, wherein said linear base member further has a flow-resistance projection portion at a width-wise outer end of said guide surface, said projection portion being configured to engage a width-wise inner end of said linear cover member, and being configured to resist airflow from the air outlet so as to reduce a flow rate of the airflow from the air outlet.

21. A ceiling panel structure to be mounted to a ceiling surface downstream of an air outlet of a ceiling-mounted air-conditioning unit, the air-conditioning unit having a central air inlet and having the air outlet arranged at a periphery of the air inlet, said ceiling panel structure comprising:

at least one panel to be mounted to the ceiling surface at an outer periphery of the air outlet of the air-conditioning unit, said at least one panel including:

a corner base member to be mounted to the ceiling surface at a peripheral edge of a corner of the air-conditioning unit a linear cover member having a longitudinal end to be engaged with said corner base member, having an adjustable length, and having a substantially rigid deflection induction portion for deflecting a portion of the conditioned air discharged from the air outlet toward the air inlet; and a corner cover member to be engaged with said corner base member adjacent to said longitudinal end of said linear cover member, said corner cover member having a substantially rigid deflection induction portion for deflecting a portion of the conditioned air discharged from the air outlet toward the air inlet.

22. A ceiling panel structure to be mounted to a ceiling surface downstream of an air outlet of a ceiling-mounted air-conditioning unit, the air-conditioning unit having a central air inlet and having the air outlet arranged at a periphery of the air inlet, said ceiling panel structure comprising:

at least one panel to be mounted to the ceiling surface at an outer periphery of the air outlet of the air-conditioning unit, each of said at least one panel including:

a base member;

a cover member having a substantially rigid deflection induction portion, and having a flow-resistance projection portion formed upstream of said deflection induction portion with respect to the airflow from the air outlet, said projection portion being configured to resist airflow from the air outlet so as to reduce a flow rate of the airflow from the air outlet;

an inner edge to be disposed adjacent to the air outlet; and an outer edge opposite said inner edge, said deflection induction portion of said cover member protruding at said outer edge and being configured so as to deflect a portion of the conditioned air discharge toward said deflection induction portion from the air outlet back toward said inner edge.

23. A ceiling panel structure to be mounted to a ceiling surface, said ceiling panel structure comprising:

a plurality of panels arranged around central area, each of said panels including:

an inner edge adjacent to the central area;

an outer edge opposite said inner edge; and a substantially rigid deflection induction portion protruding at said outer edge, said deflection induction portion being configured so as to deflect at least a portion of air flowing toward said deflection induction portion back toward said inner edge.

24. An apparatus comprising:

a ceiling-mounted air-conditioning unit including a central air inlet and an air outlet arranged at a periphery of said central air inlet; and a ceiling panel structure mounted downstream of said air outlet of said ceiling-mounted air-conditioning unit, said ceiling panel structure comprising at least one panel mounted at an outer periphery of said air outlet of said air-conditioning unit, each of said at least one panel including:

an inner edge disposed adjacent to said air outlet;

an outer edge opposite said inner edge; and a substantially rigid deflection induction portion protruding at said outer edge, said deflection induction portion being configured so as to deflect a portion of the conditioned air discharged toward said deflection induction portion from said air outlet back toward said central air inlet.

25. A ceiling panel structure to be mounted to a ceiling surface downstream of an air outlet of a ceiling-mounted air-conditioning unit, the air-conditioning unit having a central air inlet and having the air outlet arranged at a periphery of the air inlet, said ceiling panel structure comprising:

at least one panel to be mounted to the ceiling surface at an outer periphery of the air outlet of the air-conditioning unit, each of said at least one panel including:

a main portion having an inner edge to be disposed adjacent to the air outlet, and having an outer edge opposite said inner edge; and a substantially rigid deflection induction portion protruding at said outer edge of said main portion, said deflection induction portion having a proximate end connected to said outer edge of said main portion, and having a distal end opposite said proximate end, said distal end being bent towards an inner edge-side of said main portion.

* * * * *